US006899983B2

(12) United States Patent
Tamoto et al.

(10) Patent No.: US 6,899,983 B2
(45) Date of Patent: May 31, 2005

(54) ELECTROPHOTOGRAPHIC PHOTOCONDUCTOR, ELECTROPHOTOGRAPHIC APPARATUS AND PROCESS CARTRIDGE

(75) Inventors: Nozomu Tamoto, Shizuoka (JP); Yasuo Suzuki, Shizuoka (JP); Kazukiyo Nagai, Shizuoka (JP); Hongguo Li, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 10/405,843

(22) Filed: Apr. 3, 2003

(65) Prior Publication Data

US 2004/0048177 A1 Mar. 11, 2004

(30) Foreign Application Priority Data

Apr. 3, 2002 (JP) ..... 2002-100754

(51) Int. Cl.[7] ..... G03G 5/14

(52) U.S. Cl. ..... 430/58.2; 430/66; 399/116; 399/159

(58) Field of Search ..... 430/58.2, 66; 399/116, 399/159

(56) References Cited

U.S. PATENT DOCUMENTS

| | | | | | |
|---|---|---|---|---|---|
| 4,957,839 | A | * | 9/1990 | Rokutanzono et al. | 430/66 |
| 6,030,736 | A | * | 2/2000 | Ikegami et al. | 430/59.6 |
| 6,117,603 | A | * | 9/2000 | Yu et al. | 430/66 |
| 6,187,492 | B1 | * | 2/2001 | Ri et al. | 430/73 |
| 6,203,954 | B1 | * | 3/2001 | Anayama | 430/67 |
| 6,210,848 | B1 | | 4/2001 | Nagai et al. | |
| 6,444,387 | B2 | | 9/2002 | Ri et al. | |
| 6,492,079 | B2 | | 12/2002 | Shimada et al. | |

* cited by examiner

*Primary Examiner*—John L Goodrow
(74) *Attorney, Agent, or Firm*—Oblon, Spivak, McClelland, Maier & Neustadt, P.C.

(57) ABSTRACT

The present invention aims to provide a photoconductor having improved wear resistance, and which has reduced foreign matter attached on the photoconductor surface.

The electrophotographic photoconductor of the present invention is formed by sequentially disposing a photoconductive layer comprising at least one layer and a protective layer on an electroconductive support, and the protective layer comprises an acrylic resin and/or a methacrylic resin and a resin composition comprising an acryl-modified polyorganosiloxane compound which is dispersed in or compatible with the acrylic resin and/or the methacrylic resin.

54 Claims, 10 Drawing Sheets

ELECTROPHOTOGRAPHIC PHOTOCONDUCTOR, ELECTROPHOTOGRAPHIC APPARATUS AND PROCESS CARTRIDGE

BACKGROUND OF THE INVENTION

1. Field of the Invention

The present invention relates to an electrophotographic photoconductor which has high durability, high image quality and improved image stability over a long period of time, to an electrophotographic apparatus using the same, and to a process cartridge using the same.

2. Description of the Related Art

In an electrophotographic apparatus using the electrophotography method, such as a copying machine, facsimile, laser printer or direct digital machine, a toner image is formed on an electrophotographic photoconductor (also referred as photoconductor, hereinafter), mainly by charging, irradiating light imagewisely so as to form a latent electrostatic image and developing the latent electrostatic image. Thereafter, the toner image is transferred to a transfer medium such as a piece of paper, and then fixed on the paper. Further, the residual toner and the like on the surface of the photoconductor are removed so as to clean. By repeating this process, the image is formed on the paper.

As a photoconductor for the electrophotographic apparatus, such photoconductors are conventionally known in the art as the one containing a photoconductive layer having selenium or a selenium alloy on an electroconductive support, the one dispersing an inorganic photoconductive material such as zinc oxide or cadmium sulfide, and the one utilizing an amorphous silicone material. In recent years, due to advantages of cost, productivity, degree of freedom of photoconductor design and absence of pollution, organic photoconductors have come into wide use.

Organic photoconductors known in the art include a type of utilizing photoconductive resins such as polyvinyl carbazole (PVK), a charge transfer complexes type such as PVK-TNF (2,4,7-trinitrofluororene), a pigment dispersion type such as phthalocyanine-binder resins, and a separate function type combining a charge-generating material with a charge transport material. Of these, photoconductors of the separate function type are most common.

In a mechanism of latent electrostatic image formation in this separate function type of photoconductor, when the photoconductor is charged and exposed to light, the light passes through the transparent charge transport layer and is absorbed by the charge-generating material in the charge-generating layer. The charge-generating material, which absorbed the light, generates a charge carrier. This charge carrier is implanted into the charge transport layer, moves toward a surface of the photoconductor within the charge transport layer, under an electric field, and forms an electrostatic latent image by neutralizing the charge on the surface of the photoconductor.

In order to allow the charge to move, a charge transport material is added to the charge transport layer formed on the surface of the organic photoconductor. In general, the charge transport material is a low molecular weight compound, but as it does not have film-forming properties itself, it is usually formed by dispersing and mixing in an inert high polymer. However, the charge transport layer, which is formed of the charge transport material and inert polymer, is generally insufficient in hardness, and when used repetitively, it easily becomes worn due to the effect of charging, developing and cleaning. This low wear resistance is recognized to be a problem. The wear resistance is improved by increasing the proportion of inert polymer to the charge transport material, but as this causes the deterioration of sensitivity and the rise of residual potential, there is therefore a limit to increase wear resistance.

In recent years, according to increasing demands for a more compact electrophotographic apparatus, there is a trend towards smaller photoconductor diameters. Moreover, there have also been demands for higher speed, full color operation and maintenance free operation of electrophotographic apparatus. Thus, higher wear resistance of photoconductor becomes necessary. The wear resistance of an organic photoconductor may be improved by improving a binder resin (Japanese Patent Application Laid-Open (JP-A) No. 05-216250), or by including a polymer charge transport material (JP-A No. 51-73888, JP-A No. 54-8527, JP-A No. 54-11737, JP-A No. 56-150749, JP-A No. 57-78402, JP-A No. 63-285552, JP-A No. 64-1728, JP-A No. 64-13061, JP-A No. 64-19049, JP-A No. 03-50555, JP-A No. 04-175337, JP-A No. 04-225014, JP-A No. 04-230767, JP-A No. 05-232727, JP-A No. 05-310904). However, in the above-mentioned official publications, a low molecular weight charge transport material must be added even if the binder resin of the charge transport layer is improved, so the improvement of wear resistance is only slight. If a polymer charge transport material is used, on the other hand, wear resistance does improve due to the polymerization of the charge transport layer component, but the required properties is still not be able to be satisfied, and there is also a problem of cost and productivity, so it has not yet been realized.

An organic photoconductor having a protective layer provided on the charge transport layer, to which a wear-resistant function was added, has now come into wide use. For example, a method of adding a very hard metal oxide to the protective layer has been disclosed (JP-A No. 04-281461). In this method, residual electric potential and image blurring increase depending on the type of metal oxide added, but it is known to be effective for increasing wear resistance. Also, a method of crosslinking the protective layer has also been disclosed (JP-A No. 56-48637). This method has the side effect of a residual potential increase since the polymerization initiator and unreacted groups remain, but it has been found that this method offers the possibility of high wear resistance depending on crosslinking conditions and methods thereof.

Thus, there have been many attempts to improve wear resistance and achieve high durability of the organic photoconductor, which have now resulted in a remarkable increase of wear resistance. However, the increase of wear resistance has been associated with problems of considerable image defects, such as image blurring. This image blurring is due to a drop in the surface resistance of the photoconductor, which causes charge to move horizontally leading to blurring of the latent electrostatic image. It is thought that the decrease of surface resistance is caused by ions (hereafter referred to as discharge products) due to the interaction of ozone and $NO_x$ gas produced when the photoconductor is charged, with moisture in the air, and they are attracted to and deposit on the photoconductor. Also, external additives in the toner are attracted to and deposit on the photoconductor surface, and paper particles attracted to and deposit on it during transfer. These are also known to be the factors of leading the image defects including image blurring. The image defects were not a major problem on a conventional photoconductor because it had low wear resistance, so even if foreign matter, such as discharge products, toner external additives or paper particles, were not attracted to the photoconductor surface, they were removed due to wear. However, now that the wear resistance of the photoconductor has been improved, removal of this foreign matter is difficult, and the image defects tend to appear in an early stage.

Although it is now possible to improve wear resistance of the photoconductor, if image defects such as image blurring, or deterioration of image quality is more likely to occur, it does not mean that high durability has been achieved. To reduce these image defects, a method has been proposed to reduce the surface energy and frictional coefficient on the photoconductor surface, and another method has been proposed where a dehumidifier is provided which heats the photoconductor.

A method is known for reducing the surface energy and frictional coefficient on the photoconductor surface by adding various lubricants to the surface layer of the photoconductor. Methods of adding lubricants such as fluorinated silicone oil to the surface layer are disclosed in JP-A No. 07-295248, JP-A No. 07-301936 and JP-A No. 08-082940. Although this method is recognized to be effective for cleaning or removing foreign matters by reducing the surface energy of the photoconductor, these fluorinated silicone oils migrate near the surface during the formation of the protective layer, so the effect will be lost at an early stage due to small amounts of wear on the surface layer after repeated use. Therefore, this did not have much effect on increase of durability.

Moreover, various methods have been attempted to add particulate lubricants to the outermost layer of the photoconductor, for example, addition of silicone resin particles or fluorine-containing resin particles (JP-A No. 63-65449), or of melamine resin particles (JP-A No. 60-177349). JP-A No. 02-143257 discloses a method of adding polyethylene fine particles to the surface layer, JP-A No. 02-144550 discloses a method of adding fluorine-containing resin fine particles to the surface layer, JP-A No. 07-128872 and JP-A No. 10-254160 discloses a method of adding silicone particles to the surface layer, furthermore, JP-A No. 2000-010322 and the U.S. Pat. No. 5,998,072 discloses a method of adding crosslinked organic particles to the surface layer. Further, JP-A No. 08-190213 discloses a method of adding methyl siloxane resin particles to the surface layer. The dispersion of these particulate lubricants in the surface layer of the photoconductor is effective to improve durability, and it can be said to be more effective than addition of silicone oil for increasing durability. However, since the effect is maintained when the photoconductor surface wears out to some extent, there was a problem in that it was not effective in a photoconductor having increased wear resistance. If these particulate lubricants were covered with the binder resin, the effect was not demonstrated at all, so the photoconductor surface had to be worn down beforehand, and this method was therefore difficult to apply to a photoconductor with improved wear resistance.

The addition of these particulate lubricants caused a decrease of optical transmittance of the protective layer, or increase of residual potential leading to image deterioration, whereas if the addition amount was limited, sufficient durability was naturally not obtained. The addition of these particulate lubricants also tended to reduce the hardness of the photoconductor, which was detrimental to increasing durability. In addition, as these particulate lubricants had mold-release properties, their compatibility with the binder resin or organic solvent was very poor, so aggregation increased and there was a strong tendency to poor dispersibility. Low dispersibility of particulate lubricants leads to loss of optical transmittance, poor layer quality and loss of layer surface flatness. This not only promotes image deterioration, but also loss of homogeneity of the particulate lubricants in the layer. Thus, the reduction of surface energy could not be maintained and stability fell sharply, which adversely impacted continuity of effect.

Thus, although the wear resistance of photoconductors has been improved, image defects such as image blurring are a major problem, and this is currently the largest obstacle to increasing the durability of the photoconductor. If it is attempted to remove the foreign matter which causes image blurring, the wear resistance of the photoconductor falls, and the soiling of the photoconductor surface is worse, the higher the wear resistance is. Thus, it was extremely difficult to increase the wear resistance and prevent image defects at the same time.

To resolve this problem, a method of dehumidifying the photoconductor by heating is sometimes used. As image blurring is considered to be due to discharge products absorbing the moisture in the air, image blurring can be suppressed by dehumidifying the photoconductor surface. However, this method had many problems. For example, the photoconductor had to be heated continuously, power consumption increased by a large amount, and it required a long time to start the apparatus. The electrophotographic apparatus had to include a dehumidifier for heating the photoconductor, and as it was difficult to apply the dehumidifier to the small diameter photoconductors which have come into use in recent years, the electrophotographic apparatus was necessarily bulky.

Another solution to this problem is to apply particulate lubricants to the photoconductor surface. The continuous application of lubricant to the photoconductor surface is effective in maintaining continuity of the surface energy lowering effect regardless of the amount of wear on the photoconductor, and thus adhesion of foreign matter can be stably prevented over a long period of time. However, due to the inclusion of a step for applying lubricant to the photoconductor surface in the electrophotography process, the electrophotographic apparatus again became bulkier, and it was hard to apply to small diameter photoconductors which have come into use in recent years. In addition, lubricant was necessary to be supplied over time, and it was difficult to set the lubricant application amount. If the application amount was excessive, it occasionally caused image blurring and defective cleaning, or image defects such as thinning of characters, so many problems still remained.

In order to manufacture an electrophotographic apparatus which does not require replacement of the photoconductor or a dehumidifier, and which achieves high durability, high image quality, compactness and energy saving, the wear resistance of the photoconductor must be increased while at the same time, the foreign matter adhesion responsible for image blurring and image defects must be reduced. In particular, in electrophotographic apparatuses using a small diameter photoconductor which have become popular in recent years, since it is difficult to include a dehumidifier or lubricant supply, it was desired to incorporate these functions in the photoconductor itself. However, if the lubricants of the prior art were added to the photoconductor surface to implement these functions, they caused a decrease in the optical transmittance of the layer, less resistance to scratches, lower strength, higher residual potential, lower layer quality and reduced surface flatness. Hence, continuity of the surface energy reduction effect was inadequate, and this aggravated image deterioration. Lubricants added to reduce surface energy have the effect of increasing mold release properties, so their compatibility with the binder resin or organic solvent forming the surface layer was poor, and clumps tended to form. This reduced layer quality and surface flatness, led to less continuity of the surface energy reduction effect, and was considered to be a major factor interfering with the improvement of durability.

SUMMARY OF THE INVENTION

It is therefore an object of the present invention, which was conceived in view of the above problems, to inhibit blurred or other image defects by improving wear resistance and lessening adhesion of foreign matter to a photoconductor surface, to realize high image quality by improving transfer efficiency and cleaning properties, and by enhancing the continuation of these effects, to provide an electrophotographic photoconductor having improved image stability, together with an electrophotographic apparatus and electrophotographic cartridge using this photoconductor.

In an electrophotography process, it is thought that a foreign matter which is attracted to the photoconductor surface mainly includes discharge products which are attracted due to static electricity, toner components (in particular, toner external additives) which are attracted during development, and paper particles which are attracted during transfer. Therefore, it is desirable to decrease a surface energy of the photoconductor to reduce attraction forces of these foreign matters, and to increase mold release properties so that even if they are attached, they can easily be removed by cleaning. For this purpose, it is effective to incorporate a lubricant having mold release properties in the surface of the photoconductor.

However, when the mold release properties are increased in a lubricant of the related art, this effect is not easily maintained, and wear resistance has to be sacrificed to enhance the effect, hence it is incompatible with higher durability. Also, when the photoconductor is exposed to form an electrostatic latent image thereon, these lubricants tend to scatter the light which led to a decrease of optical transmittance and image deterioration. The strength decreased, and the photoconductor has lower resistance to scratches, which lowered wear resistance and lead to cleaning defects. Moreover, the addition of these lubricants causes a higher residual potential which adversely impacts image stability.

These lubricants, which are added to enhance mold release properties, by their very nature, cause a sharp drop of compatibility with the binder resin or organic solvents used in the photoconductor. Therefore, in the case of microfine particle lubricants, clumps tends to form, leading to a further loss of optical transmittance and decrease of surface flatness of the photoconductor, as well as deterioration of layer quality. As a result, there is not only less resistance to scratches and lower wear resistance, but unevenness occurs during charging, developing, transfer and cleaning. This makes it impossible to increase durability, and also have a serious adverse impact on the suppression of image defects. As these microfine particle lubricants are associated with many problems, as described above, a sufficient amount of them could not be added, so that foreign matter could not be sufficiently removed from the photoconductor surface, and higher durability could not be achieved.

To resolve the aforesaid problems, the present invention attempted to achieve a lower photoconductor surface energy together with stabilization. The aim was to reduce the decline of optical transmittance, suppress the rise of residual potential and loss of layer strength, and enhance compatibility with the binder resin and organic solvents, thereby permitting manufacture of an electrophotographic photoconductor with improved dispersion properties and surface flatness. It also attempted to provide a high durability electrophotographic apparatus wherein image deterioration and image defects, such as blurred images, are suppressed even after long period of repeated use, transfer efficiency and cleaning properties are improved, and high image quality is always obtained. As a result, it was found that the above problems could be resolved and the object of the invention could be achieved by incorporating a specific acryl-modified polyorganosiloxane compound as an active principle with an acrylic resin and/or a methacrylic resin in the outermost layer (protective layer) of the photoconductor.

(1) The electrophotographic photoconductor of the present invention comprises: an electroconductive support; a photoconductive layer on the electroconductive support, which is formed of at least one layer; and a protective layer on the photoconductive layer, which is an outermost layer of the electrophotographic photoconductor, in which the protective layer contains at least one of an acrylic resin and a methacrylic resin, and a resin composition comprising an acryl-modified polyorganosiloxane compound.

(2) In the electrophotographic photoconductor of the present invention, the acryl-modified polyorganosiloxane compound is a graft copolymer of an acrylic polymer, and siloxane as a principal chain.

(3) In the electrophotographic photoconductor of the present invention, the acryl-modified polyorganosiloxane compound is formed by emulsion graft copolymerization of (A) a polyorganosiloxane expressed by Formula 1:

Formula 1

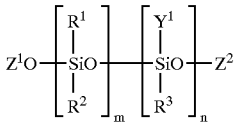

[wherein, each of "R1", "R2" and "R3" is one of a hydrocarbon group and a halogenated hydrocarbon group having 1 to 20 carbon atoms, and may be identical or different, "Y1" is one of a radical reactive group, an SH group and an organic group containing both, each of "Z1" and "Z2" is respectively one of a hydrogen atom, a lower alkyl group and a group expressed by the following formula, and may be identical or different:

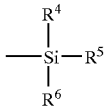

(each of "R4" and "R5" is respectively one of a hydrocarbon group and a halogenated hydrocarbon group having 1 to 20 carbon atoms, and may be identical or different, and "R6" is one of a hydrocarbon group, a halogenated hydrocarbon group, a radical reactive group, an SH group and an organic group containing both), "m" is a positive integer of 10,000 or less, and "n" is an integer of one or more], and (B) one of a (meth)acrylic ester expressed by Formula 2:

Formula 2

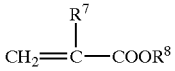

(wherein, "R7" in Formula 2 is one of a hydrogen atom and a methyl group, and "R8" is one of an alkyl group, alkoxy-substituted alkyl group, cycloalkyl group and an aryl group), and a mixture of 70% by weight or more of the (meth) acrylic ester with 30% by weight or less of a copolymerizable monomer, in a weight ratio of from 5:95 to 95:5.

(4) In the electrophotographic photoconductor of the present invention, a content of (A) the polyorganosiloxane expressed by Formula 1, is larger in weight than a content of (B) one of the (meth)acrylic ester expressed by Formula 2, and the mixture of 70% by weight or more of the (meth) acrylic ester with 30% by weight or less of the copolymerizable monomer.

(5) In the electrophotographic photoconductor of the present invention, the acrylic resin and/or the methacrylic resin, is a acrylic resin formed by copolymerization of one or more of curing acrylic monomers and curing acrylic oligomers, and/or a methacrylic resin formed by copolymerization of one or more of curing methacrylic monomers and curing methacrylic oligomers.

(6) In the electrophotographic photoconductor of the present invention, one or more of the curing methacrylic monomers and oligomers is hydroxyethylmethacrylate.

(7) In the electrophotographic photoconductor of the present invention, the protective layer further comprises a charge transport material.

(8) In the electrophotographic photoconductor of the present invention, the charge transport material is contained by polymerizing with the acrylic resin formed by copolymerization of one or more curing acrylic monomers and oligomers, or, the methacrylic resin formed by copolymerization of one or more curing methacrylic monomers and oligomers.

(9) In the electrophotographic photoconductor of the present invention, the protective layer further comprises metal oxide particles.

(10) In the electrophotographic photoconductor of the present invention, the protective layer further comprises a carboxylic acid compound.

(11) The electrophotographic apparatus of the present invention, comprises: a charger; a light irradiator; an image-developer; a transfer; and an electrophotographic photoconductor, and the electrophotographic photoconductor is the electrophotographic photoconductor of the present invention.

(12) The process cartridge of the present invention, comprises an electrophotographic photoconductor and an image-developer, where the process cartridge for electrophotography is freely detachable from and attachable to an electrophotographic apparatus, and the electrophotographic photoconductor is the electrophotoconductor of the present invention.

DESCRIPTION OF THE PREFERRED EMBODIMENTS

Figure 1:
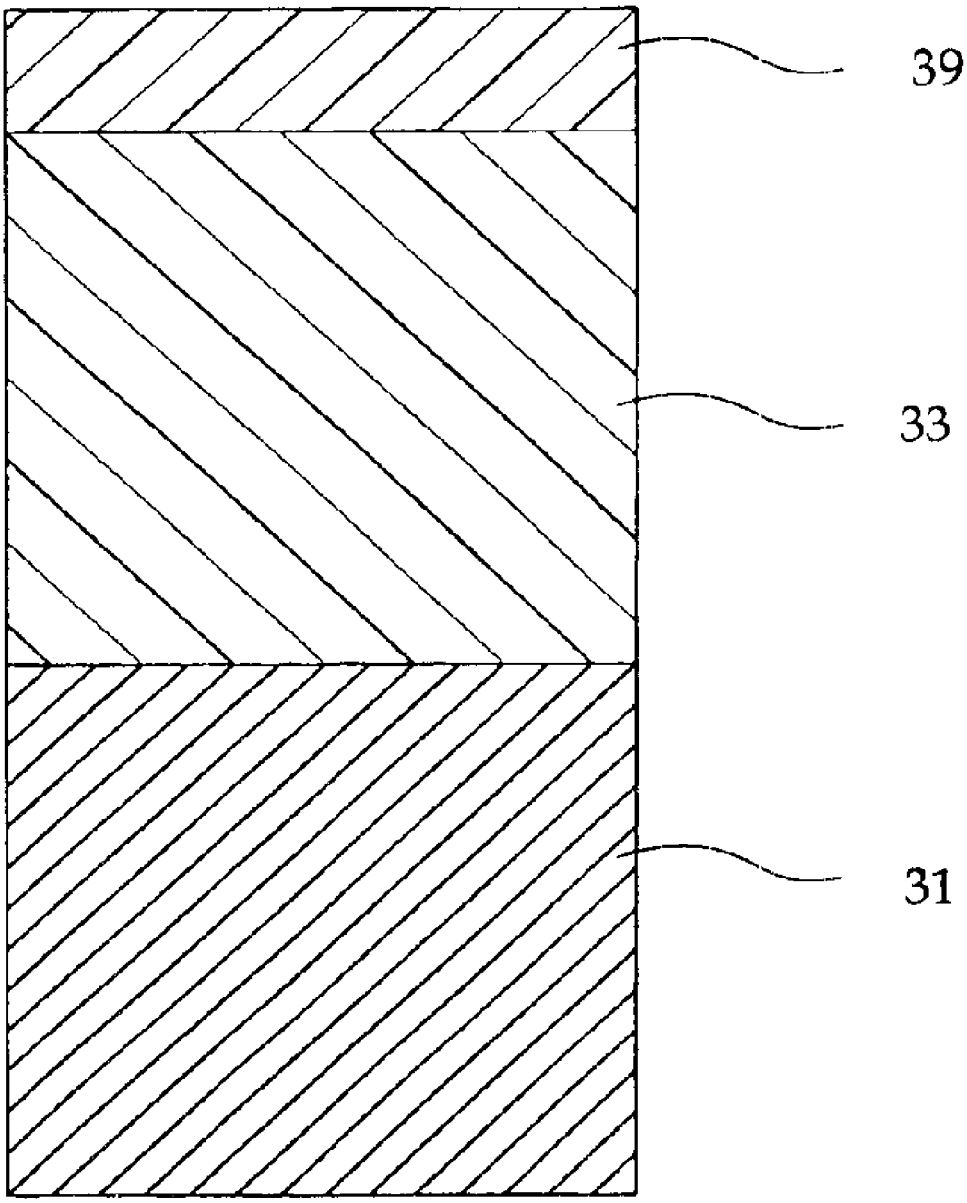
FIG. 1 is a sectional view showing an example of the laminar construction of the electrophotographic photoconductor relating to the present invention.

The present invention enables to remove foreign matters, such as discharge products, toner external additives and particles, from a surface of a photoconductor, by containing an acryl-modified polyorganosiloziane compound in an outermost layer, which is a protective layer, of the photoconductor. This is considered to be due to the decrease of surface energy of the photoconductor and enhancement of mold release properties.

By mixing and adding this acryl-modified polyorganosiloxane compound with an acrylic resin and/or a methacrylic resin, aggregation of the acryl-modified polyorganosiloxane compound is decreased remarkably, dispersibility improved sharply, and surface flatness and smoothness of the photoconductor are remarkably improved. It is thought that the acrylation of a siloxane having low compatibility with binder resins and organic solvents, increases compatibility with binder resins and organic solvents, and that this compatibility can be further enhanced by using the acrylic resin and/or a methacrylic resin as a binder resin.

In the present invention, a photoconductor having an outermost layer (protective layer) which contains the aforesaid acryl-modified polyorganosiloxane compound, the acrylic resin and/or methacrylic resin, has excellent optical transmittance. It is thought that this is because the acryl-modified polyorganosiloxane compound has a high optical transmittance, and since it has a much higher compatibility with the binder resin, this reduces aggregations and largely reduces light scattering at the interface.

The acryl-modified polyorganosiloxane compound has a large effect in suppressing residual potential increase of the photoconductor. The acryl-modified polyorganosiloxane compound has no negative influence to residual potential of the photoconductor, as well as it lessens the time-dependent residual potential increase by adding to the photoconductor, and gives a residual potential value effectively equal to the initial value even after repetitive use. The suppression of this residual potential increase means that it is possible to increase an addition amount of the acryl-modified polyorganosiloxane compound without affecting the image, and its superiority is still further enhanced in improving the continuity of the low surface energy effect.

The photoconductor of the present invention hardly has a loss in strength, and there are few adverse influences on scratch resistance or wear resistance. This is considered to be due to the addition of the acryl-modified polyorganosiloxane compound together with the acrylic resin and/or the methacrylic resin, which largely suppresses aggregates by reducing them to fine particles, and dispersing them uniformly in the layer.

The photoconductor of the present invention can maintain the surface energy reduction effect even after repetitive use. This sustains the long-term removal of foreign matter which tends to cause image defects by attaching to the photoconductor surface, and consistently achieves high image quality. The effect on transfer efficiency and cleaning properties is also stably maintained over a long period of time. It may be conjectured that, by adding this acryl-modified polyorganosiloxane compound together with the acrylic resin and/or the methacrylic resin, due to the marked increase of compatibility, the dispersibility and directionality of the acryl-modified polyorganosiloxane compound in the layer can be largely enhanced.

First-order particles of the acryl-modified polyorganosiloxane compound produced by emulsion-polymerization can form ultrafine particles of nano-order, and by using the above-mentioned acrylic resin and/or the above-mentioned methacrylic resin as a binder resin, this ultrafine particle state can be created as a layer without forming aggregates. When particulate lubricants of the prior art were dispersed in the surface layer of the photoconductor, dispersibility was poor, and there was local scatter in the addition effect of the lubricant. However, as it is now possible to disperse acryl-modified polyorganosiloxane compound uniformly in the layer in the ultrafine particle state, the scatter in surface energy reduction effect over the whole surface of the photoconductor is decreased, the uniformity of the effect is enhanced, and the effect is much more stable.

It is thought that the acryl-modified polyorganosiloxane compound has a more effective structure for improving compatibility with the binder resin due to the graft copolymerization between the siloxane as main chain and the principal chain as a side chain. This not only appears to confer a greater improvement of dispersibility and directionality, but the fact that this is maintained while the polymerization ratio of the siloxane in the acryl-modified polyorganosiloxane compound can be considerably increased, appears to be effective in improving the stability of the effect.

As the outermost layer (protective layer) of the photoconductor contains the acryl-modified polyorganosiloxane compound of the present invention, the surface energy of the photoconductor is reduced, and by simultaneously adding the acrylic resin and/or the methacrylic resin, aggregation of the acryl-modified polyorganosiloxane compound is sharply reduced so it can be uniformly dispersed in an ultrafine particle state. As a result, foreign matter, such as discharge products, toner external additives or paper particles, no longer attaches easily to the photoconductor surface, or even if they do, they can be easily removed. Further, by largely improving the stability of the effect, not only image blurring is not only suppressed, but also transfer efficiency is improved, cleaning properties are improved, filming or image defects due to foreign matter attachment is suppressed and wear resistance is improved, and this has a major combined effect on high durability and high image quality.

The protective layer of the photoconductor of the present invention comprises at least one of an acrylic resin and a methacrylic resin, and a resin composition comprising an acryl-modified polyorganosiloxane compound. It is preferred that the resin composition comprising an acryl-modified polyorganosiloxane compound is dispersed in or compatible with at least one of the acrylic resin and the methacrylic resin. The acryl-modified polyorganosiloxane compound in the protective layer is in the range of 1% by weight to 40% by weight, preferably 5% by weight to 20% by weight, in terms of total solids. Also, the acryl-modified polyorganosiloxane compound is uniformly dispersed in the binder resin at a particle diameter of 1.0 μm or less, preferably 0.6 μm or less. In this way, by dispersing it uniformly at a particle diameter of at least 1.0 μm or less and preferably 0.6 μm or less, the surface flatness and smoothness of the photoconductor can be greatly improved. By improving the surface flatness and smoothness of the photoconductor, there is less scatter of dots and resolution can be increased, while at the same time, the accompanying decrease of image density and decrease of gradation can be suppressed. Now, as image defects and wear of the photoconductor are also suppressed, surface energy must be reduced and surface smoothness/flatness must be maintained in order to achieve high image quality and high durability. One indicator of the surface flatness and smoothness of the photoconductor, Ten point height of irregularities (Rz), is defined by cutting out a standard length from the roughness curve in the direction of the average curve, calculating the sum of the average value of the absolute values of the height from the highest peak to the fifth peak and the average value of the absolute values of the heights of the troughs from the lowest trough to the fifth trough, measured perpendicular to the average curve of this cutout part, and expressing this in μm. It is preferred that Rz is 1.5 μm or less, preferably 1.0 μm or less.

The acryl-modified polyorganosiloxane compound used in the present invention will now be described in more detail.

The resin composition used for the protective layer of the photoconductor of the present invention, is prepared by an emulsion polymerization, preferably the graft polymerization of the polyorganosiloxane expressed by Formula 1:

Formula 1

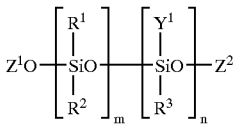

(where, "R1", "R2", "R3", "Y1", "Z1" and "Z2" are expressing the same as the above), and a (meth)acrylic ester expressed by Formula 2:

Formula 2

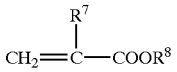

(where, "R7" and "R8" are expressing the same as the above), and a copolymerizable monomer which can be used if desired.

In the polyorganosiloxane expressed by the aforesaid Formula 1, "R1", "R2" and "R3" are respectively hydrocarbon groups having 1 to 20 carbon atoms, including alkyl groups such as methyl, ethyl, propyl, butyl, aryl groups such as phenyl, tolyl, xylyl, naphthyl, or halogenated hydrocarbon groups containing 1 to 20 carbon atoms wherein one or more of the hydrogen atoms bonded with carbon atoms in these hydrocarbon groups is replaced by a halogen atom. "R1", "R2" and "R3" may be identical or different. "Y1" is a radical reactive group such as vinyl, allyl, γ-acryloxypropyl, γ-methacryloxypropyl, γ-mercaptopropyl, or an SH group, and/or an organic group containing both. "Z1" and "Z2" are lower alkyl groups, such as hydrogen, methyl, ethyl, propyl, butyl, or a triorganosilyl group represented by:

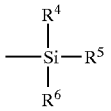

"R4" and "R5" in this triorganosilyl group are hydrocarbon groups or halogenated hydrocarbon groups respectively having 1 to 20 carbon atoms. "R6" is one of a hydrocarbon group or a halogenated hydrocarbon group having 1 to 20 carbon atoms, a radical reactive group, an SH group, or an organic group containing both. Examples of the hydrocarbon groups and halogenated hydrocarbon groups having 1 to 20 carbon atoms, radical reactive groups, SH groups, or organic groups containing both in this triorganosilyl group are those mentioned above. "Z1" and "Z2" are respectively identical or different. "m" is a positive integer equal to 10,000, and preferably an integer in the range of 500 to 8,000. "n" is an integer equal to one or more, preferably an integer in the range of 1 to 500.

The polyorganosiloxane expressed by Formula 1 (A), can be prepared by reacting cyclic polyorganosiloxane, liquid polydimethylsiloxane having a molecular chain capped, at both terminals, with hydroxyl groups, liquid polydimethylsiloxane having a molecular chain capped at both terminals with alkoxy groups or polydimethylsiloxane having a molecular chain capped at both terminals with trimethylsilyl groups; with, a radical reactive group, an SH group, a silane for introducing both or the hydrolysis product of this silane; and if desired, a trifunctional trialkoxysilane or its trifunctional hydrolysis product in such an amount that it does not interfere with the purpose of the present invention.

Next, some different examples of methods of preparing (A) the polyorganosiloxane expressed by Formula 1, will be given. The first method is a method of obtaining a high molecular weight polyorganosiloxane, by polymerizing the aforesaid cyclic low molecular weight siloxane such as octamethyl cyclotetrasiloxane using a dialkoxysilane compound having a radical reactive group, an SH group or both, or its hydrolyzate as starting materials, in the presence of a strong alkali or a strong acid catalyst. The high molecular weight polyorganosiloxane thus obtained is then subjected to emulsification dispersion in an aqueous medium in the presence of a suitable emulsifier as preparation for the emulsification graft copolymerization of the following step.

The second method is a method of emulsion polymerizing the above-mentioned low molecular weight polyorganosiloxane in an aqueous medium using a dialkoxysilane compound having a radical reactive group, an SH group or both, or its hydrolyzate as starting material in the presence of a sulfonic acid surfactant or a sulfate surfactant. In emulsion polymerization, emulsification dispersion is also be able to performed in an aqueous medium using the same starting materials by a cationic surfactant such as an alkyl trimethylammonium chloride or alkyl benzylammonium chloride, and a suitable amount of a strong alkali such as potassium hydroxide or sodium hydroxide can then be added to effect the polymerization.

If the molecular weight of (A) the polyorganosiloxane expressed by Formula 1 is small, it has an inferior ability to impart durable slidability and wear resistance to an article formed of from the composition. Thus, high a molecular weight as possible is preferred. For this purpose, in the first method, it is required to give the polyorganosiloxane a high molecular weight in the polymerization, and to subject this to emulsification dispersion, whereas in the second method, as the molecular weight of the polyorganosiloxane will become large if the temperature is lowered during the curing treatment performed after the emulsion polymerization, it is advantageous if the curing temperature is 30° C. or less, preferably 15° C. or less.

In the present invention, examples of the (meth)acrylic ester expressed by Formula 2 used as the monomer of component which is made to undergo graft polymerization with the polyorganosiloxane expressed by Formula 1, include alkyl (meth)acrylates such as methyl (meth)acrylate, ethyl (meth)acrylate, propyl (meth)acrylate, butyl (meth) acrylate, isobutyl (meth)acrylate, pentyl (meth)acrylate, hexyl (meth)acrylate, octyl (meth)acrylate, 2-ethylhexyl (meth)acrylate, lauryl (meth)acrylate, stearyl (meth)acrylate and the like; alkoxyalkyl (meth)acrylates such as methoxyethyl (meth)acrylate, butoxyethyl (meth)acrylate and the like; cyclohexyl (meth)acrylate, phenyl (meth)acrylate, benzyl (meth)acrylate, and the like. These (meth) acrylic esters may be used alone, or two or more may be used together.

Examples of the copolymerizable monomer used together with these (meth)acrylic esters, are polyfunctional monomers, ethylenic unsaturated monomers and the like. Examples of polyfunctional monomers are ethylenic unsaturated amides such as (meth)acrylamide, diacetone (meth) acrylamide, N-methylol (meth)acrylamide, N-butoxymethyl (meth)acrylamide, N-methoxymethyl (meth)acrylamide, alkylol or alkoxyalkyl derivatives thereof, and the like; oxirane group-containing unsaturated monomers such as a glycidyl (meth)acrylate, glycidyl allyl ether and the like; hydroxyl group-containing unsaturated monomers such as 2-hydroxyethyl (meth)acrylate, 2-hydroxypropyl (meth) acrylate and the like; carboxyl group-containing ethylenic unsaturated monomers such as (meth) acrylic acid, maleic anhydride, crotonic acid, itaconic acid and the like; amino group-containing unsaturated monomers such as N-dimethylaminoethyl (meth)acrylate, N-diethylaminoethyl (meth)acrylate and the like; polyalkylene oxide group-containing unsaturated monomers such as ethylene oxide adducts or propylene oxide adducts of (meth)acrylic acid and the like; perfect esters of (meth) acrylic acid and polyhydric alcohols such as ethylene glycol di(meth) acrylate, diethylene glycol di(meth)acrylate, trimethylolpropane tri(meth)acrylate and the like; allyl (meth)acrylate, divinylbenzene and the like. One of these may be used alone, or two or more may be used in combination. These polyfunctional monomers impart elasticity, durability and heat resistance by participating in crosslinking between the polymers in the acryl-modified polyorganosiloxane compound.

On the other hand, examples of ethylenic unsaturated monomers are styrene, α-methyl styrene, vinyltoluene, acrylonitrile, vinyl chloride, vinylidene chloride, vinyl acetate, vinyl propionate, versatic acid vinyl ester and the like. One of these monomers may be used, or two or more may be used in combination, also, one or more of these monomers may be combined with one or more of the aforesaid functional monomers.

The amount of the copolymerizable monomer is 30% by weight or less based on the sum total weight of the (meth) acrylic ester expressed by Formula 2 and the copolymerizable monomer. If this amount is more than 30% by weight, the miscibility of the acryl-modified polyorganosiloxane compound obtained with the binder resin, will fall.

The monomer component (b) for graft copolymerization, namely, the (meth)acrylic ester expressed by Formula 2, or a mixture of this with a copolymerizable monomer, has a glass transition temperature of 20° C., preferably 30° C. in order to confer excellent slidability and wear resistance on the article formed of the composition.

The acryl-modified polyorganosiloxane compound in the present invention is obtained by carrying out a graft copolymerization by emulsion polymerization of the polyorganosiloxane of component (A) and the monomer of component (B) in a weight ratio of from 5:95 to 95:5. If the blending proportion of the polyorganosiloxane of component (B) is less than the aforesaid range, the acryl-modified polyorganosiloxane compound obtained cannot fully exert the effect of the polyorganosiloxane, and the viscous tackiness which is a defect of acrylic polymers appears. On the other hand, if it is larger than the aforesaid range, compatibility of the acryl-modified polyorganosiloxane compound with the organic solvent or the binder resin falls, so aggregation easily occurs and surface flatness/smoothness may considerable decrease. Bleeding may then occur on the article formed of the composition, while slidability and wear resistance tend to decrease with time.

The graft copolymerization of the component (A) and component (B) can be performed by known emulsion polymerization methods using an aqueous emulsion of polyorganosiloxane as component (A), and a common radical initiator.

The preparation of acryl-modified polyorganosiloxane compound is described in detail in Japanese Patent Application Publication (JP-B) No. 07-5808 (Nissin Chemical Industry Co., Ltd.).

In the acryl-modified polyorganosiloxane compound used for the present invention, since residual impurities such as emulsifier, flocculant, and the like which are used during the polymerization, may impair electrical properties in imaging-forming members, especially in the electrophotographic photoconductor in which electrical properties are the main factors for image-forming, it is preferred that purification be performed in order to remove the residual impurities, if necessary. Examples of such purification methods are a method of stirring and washing with an acid, alkaline aqueous solution, water or alcohol, a method of solid-solution extraction by a Soxlet extractor and the like.

Now, some examples will be described wherein this is incorporated in an electrophotographic photoconductor, hereinafter.

FIG. 1 shows a photoconductive layer 33 having a charge-generating material and a binder resin as principal components on an electroconductive support 31, and a protective layer 39 is further provided on the photoconductive layer surface. In this case, the outermost layer which contains the acryl-modified polyorganosiloxane compound, the acrylic resin and/or the methacrylic resin is the protective layer 39. The outermost layer of the photoconductor may additionally contain any other materials such as metal oxide particles and a charge transport material.

Figure 2:
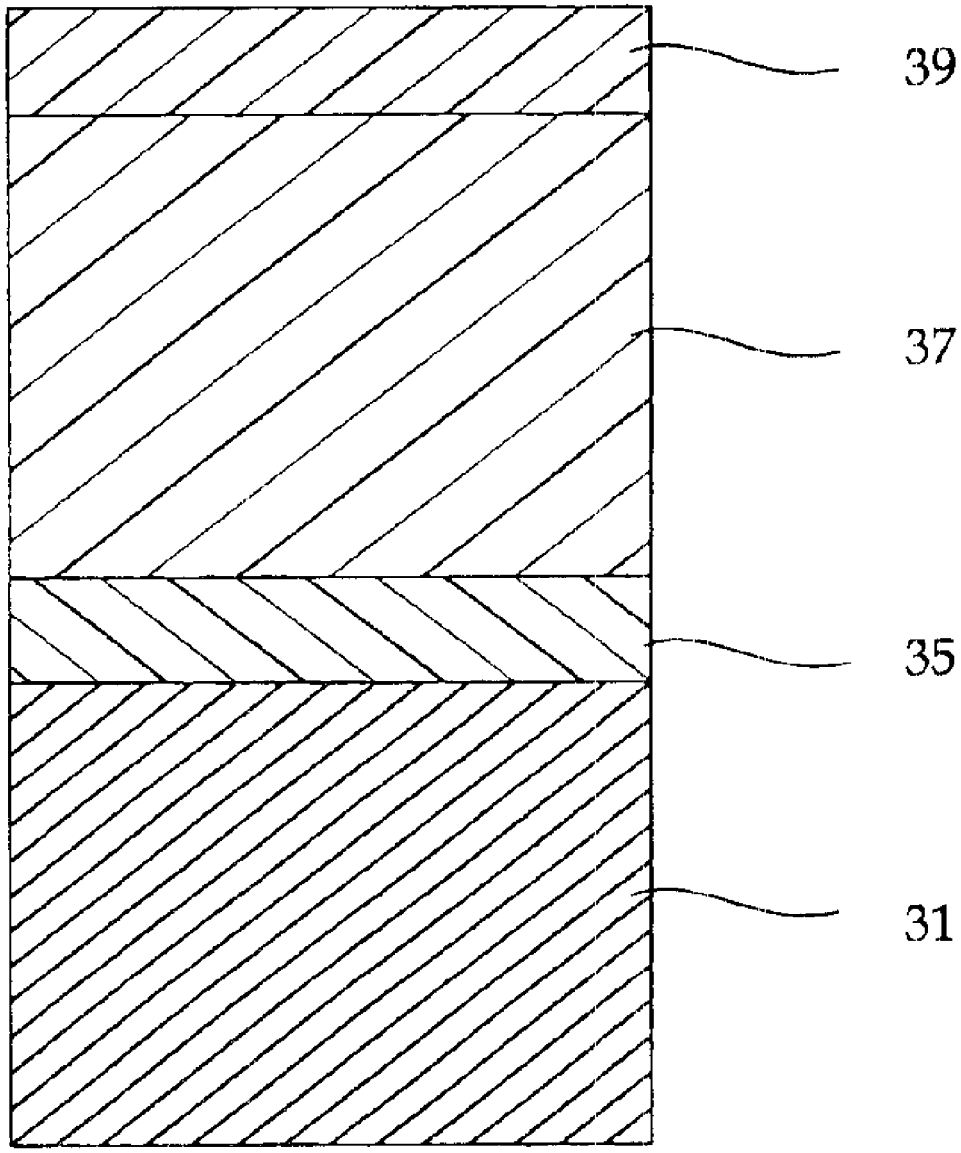
FIG. 2 is a sectional view showing an example of the laminar construction of the electrophotographic photoconductor relating to the present invention.

FIG. 2 shows a construction wherein a charge-generating layer 35 having a charge-generating material as principal component, and a charge transport layer 37 having a charge transport material as principal component, are disposed on the electroconductive support 31 in this order, and the protective layer 39 is provided on the charge transport layer 37. In this case, the outermost layer which contains the acryl-modified polyorganosiloxane compound, the acrylic resin and/or the methacrylic resin, is the protective layer 39. The outermost layer of the photoconductor may additionally contain any other materials such as metal oxide particles and a charge transport material.

Figure 3:
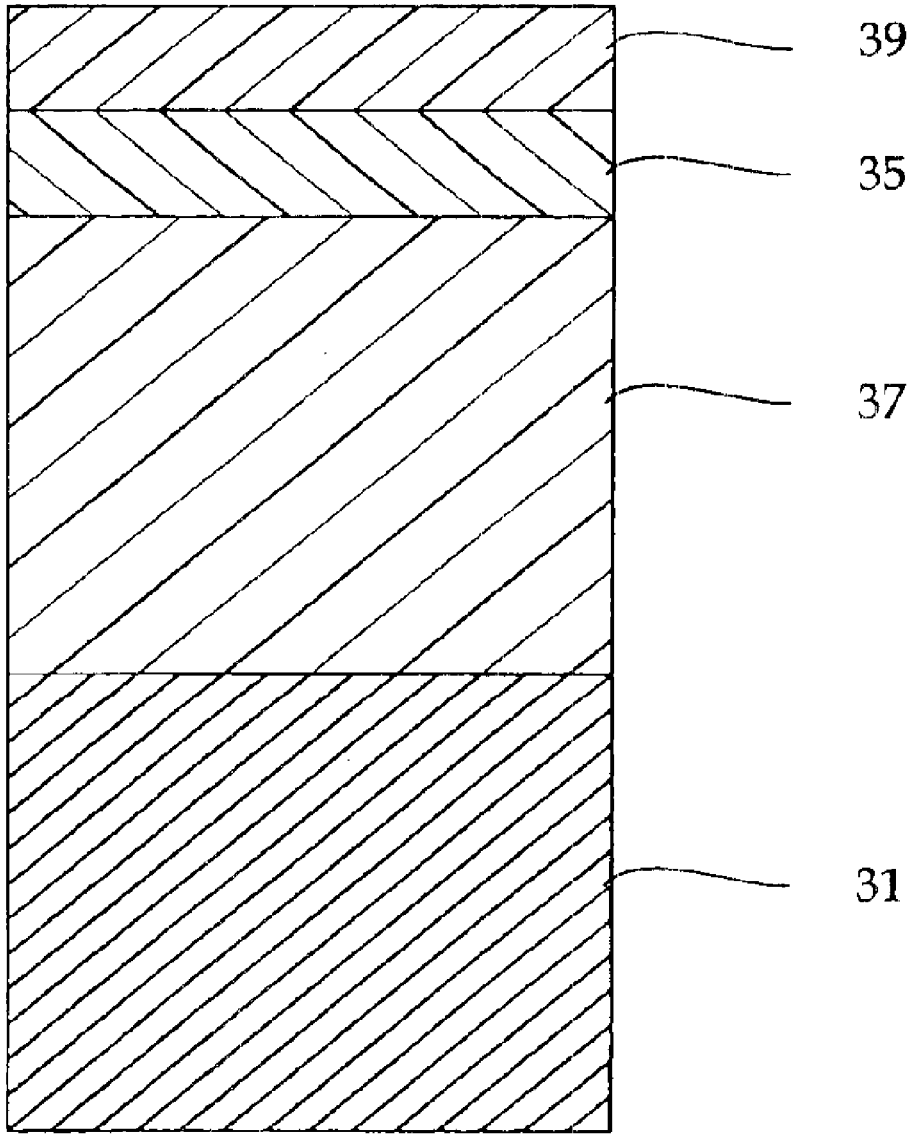
FIG. 3 is a sectional view showing an example of the laminar construction of the electrophotographic photoconductor relating to the present invention.

FIG. 3 shows a construction wherein the charge transport layer 37 having a charge transport material as principal component, and the charge-generating layer 35 having a charge-generating material as principal component, are disposed on the electroconductive support 31 in this order, and the protective layer 39 is provided on the charge-generating layer 35. In this case, the outermost layer which contains the acryl-modified polyorganosiloxane compound, the acrylic resin and/or the methacrylic resin, is the protective layer 39. The outermost layer of the photoconductor may additionally contain any other materials such as metal oxide particles and a charge transport material.

The electroconductive support 31 has a conductivity of $10^{10}$ Ω·cm or less in terms of volume resistivity, and is obtained for example by vacuum deposition or sputtering of metals such as aluminium, nickel, chromium, Nichrome, copper, gold, silver or platinum, or metal oxide particles such as tin oxide or indium oxide, on a film-shaped or cylindrical plastic body or paper. Alternatively, aluminium, aluminium alloy, nickel or stainless steel plates may be used, or these may be fashioned into a tube shape by extrusion and drawing, cut, and subjected to surface treatment such as super finishing and grinding. The endless nickel belt and endless stainless steel belt disclosed in JP-A No. 52-36016 can also be used as the electroconductive support 31.

In addition, conductive fine particles may be dispersed in a suitable binder resin, which is then coated on the above support and used as the electroconductive support 31 of the present invention. These conductive fine particles may be carbon black, acetylene black, metal powder of such as aluminium, nickel, iron, nichrome, copper, zinc, silver or the like; or metal oxide powder of such as electrically conductive tin oxide, ITO or the like. The binder resin used therefor may be thermoplastic resins, thermosetting resins or photocuring resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, a polyarylate resin, a phenoxy resin, polycarbonate, a cellulose acetate resin, an ethyl cellulose resin, polyvinyl butyral, polyvinyl formal, polyvinyl toluene, poly-N-vinylcarbazole, an acrylic resin, a silicone resin, an epoxy resin, a melamine resin, a urethane resin, a phenol resin, an alkyde resin and the like. The electroconductive layer can be provided by dispersing these conductive fine particles and the binder resin in a suitable solvent, for example, tetrahydrofuran, dichloromethane, methyl ethyl ketone, toluene, and the like, and then applying.

A electroconductive layer on a suitable cylindrical substrate formed by a heat-shrinkable tubing, in which conductive fine particles are contained in a material such as polyvinyl chloride, polypropylene, polyester, polystyrene, polyvinylidene chloride, polyethylene, chlorinated rubber or Teflon (registered trademark), can also be used as the electroconductive support 31 of the present invention.

Next, the photoconductive layer will be described. The photoconductive layer may be a single layer, or it may have a multilayer composition.

First, the case of a multilayer construction comprising the charge-generating layer 35 and charge transport layer 37, will be described. The charge-generating layer and charge transport layer may respectively have one layer, or plural layers. The charge transport layer may be disposed on the charge-generating layer, or the reverse.

First, the charge-generating layer 35 will be described. The charge-generating layer 35 is a layer which uses a charge-generating material as a principal component, and can also use a binder resin together if necessary. An inorganic material or organic material may be used as the charge-generating material.

Examples of the inorganic materials are crystalline selenium, amorphous selenium, selenium-tellurium, selenium-tellurium-halogen, selenium-arsenic compound, cadmium sulfide, cadmium sulfide-selenium, amorphous silicon and the like.

The amorphous silicon may have dangling bonds terminated with hydrogen atoms or halogen atoms, or it may be doped with boron atoms or phosphorus atoms.

The organic material may be a material known in the art. Examples thereof may include, an azo pigments such as a disazo pigment, an unsymmetrical disazo pigment, a trisazo pigment, an azo pigment having a carbazole skeleton (JP-A No. 53-95033), an azo pigment having a distylbenzene skeleton (JP-A No. 53-133445), an azo pigment having a triphenylamine skeleton (JP-A No. 53-132347), an azo pigment having a diphenylamine skeleton, an azo pigment having a dibenzothiophene skeleton (JP-A No. 54-21728), an azo pigment having a fluorenone skeleton (JP-A No. 54-22834), an azo pigment having an oxadiazole skeleton (JP-A No. 54-12742), an azo pigment having a bis-stilbene skeleton (JP-A No. 54-17733), an azo pigment having a distyloxadiazole skeleton (JP-A No. 54-2129), an azo pigment having a distearyl carbazole skeleton (JP-A No. 54-14967 and the like; an azulenium salt pigment, a squearic acid methine pigment, a perylene pigment, an anthraquinone or polycyclic quinone pigment, a quinoneimine pigment, diphenylmethane pigment and triphenylmethane pigments, benzoquinone and naphthoquinone pigments, cyanine and azomethine pigments, an indigoid pigment, a bis-benzimidazole pigment, and phthalocyanine pigments such as the metal phthalocyanine and non-metal phthalocyanine, expressed by Formula 3.

Formula 3

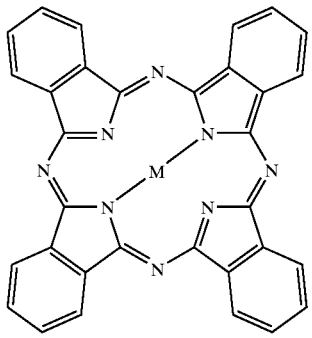

In the above formula, "M" (the central metal) expresses a metal or a non-metal (hydrogen) element. Herein, "M" (the central metal) is a single material such as H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, TI, La, Ce, Pr, Nd, Pm, Sm, Eu, Gd, Th, Dy, Ho, Er, Tm, Yb, Lu, Th, Pa, U, Np, Am and the like, or comprises two or more elements thereof such as in an oxide, chloride, fluoride, hydroxide, bromide and the like. The central metal is not limited to these elements. The charge-generating material which has a phthalocyanine skeleton in the present invention, may have at least the basic skeleton of Formula (N), and may have a polymer structure, such as that of a dimer or trimer, or a higher order polymer structure. The basic skeleton may also have various substituents.

Among these various phthalocyanines, oxo-titanium phthalocyanine which has TiO as the central metal, non-metal phthalocyanine and chlorogallium phthalocyanine are particularly preferred from photoconductor characteristics. These phthalocyanines are known to have various crystal structures, for example, for oxo-titanium phthalocyanine, it is α, γ, m or Y type, and in the case of copper phthalocyanine, it is α, β or γ. Also in phthalocyanines with the same central metal, the properties also change when the crystal structure changes. It is reported that the properties of a photoconductor using a phthalocyanine pigment having various crystal systems also change accordingly (Society of Electrophotography of Japan, Volume 29, No. 4 (1990)). From this, it can be understood that selection of the crystal system of phthalocyanine is dramatically important as regards photoconductor characteristics, and Y type oxo-titanium phthalocyanine is particularly effective and useful for increasing sensitivity. These charge-generating materials can be used alone, or two or more may be used in combination.

The binder resin used in the charge-generating layer 35 may be a polyamide, polyurethane, an epoxy resin, polyketone, polycarbonate, a silicone resin, an acrylic resin, polyvinyl butyral, polyvinyl formal, polyvinyl ketone, polystyrene, poly-N-vinyl carbazole, polyacrylamide and the like. These binder resins can be used alone, or two or more may be used in combination. Also, the binder resin used in the charge-generating layer may also include the polymeric charge transport materials described as follow (for example, JP-A No. 64-1728, JP-A No. 64-13061, JP-A No. 64-19049, JP-A No. 04-11627, JP-A No. 04-225014, JP-A No. 04-230767, JP-A No. 04-320420, JP-A No. 05-232727, JP-A No. 06-234838, JP-A No. 06-234839, JP-A No. 06-295077, JP-A No. 07-56374, JP-A No. 07-325409, JP-A No. 09-80772, JP-A No. 09-80783, JP-A No. 09-80784, JP-A No. 09-127713, JP-A No. 09-211877, JP-A No. 09-222740, JP-A No. 09-265197, JP-A No. 09-265201, JP-A No. 09-297419 and JP-A No. 09-304956). The amount of the binder resin used in the charge-generating layer 35 may be 0 part by weight to 500 parts by weight, preferably 0 part by weight to 200 parts by weight, relative to 100 parts by weight of charge-generating material. Various additives, for example, a leveling agent such as dimethyl silicone oil, methyl phenyl silicone oil or the like, a sensitizer, a dispersant and the like, can be added if necessary.

Broadly speaking, the charge-generating layer 35 may be formed by vacuum thin film forming methods or by methods of casting from a solution dispersion. The former methods include a vacuum deposition method, glow discharge electrolysis, an ion plating method, a sputtering method, a reactive-sputtering method and CVD method, which can satisfactory form the above-mentioned inorganic material or organic material. To provide the charge-generating layer by the casting method, the above-mentioned inorganic or organic charge-generating material is dispersed, together with a binder resin if necessary, by a ball mill, attriter, sand mill or bead mill using an organic solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, butyl acetate or the like, moderately diluting the dispersion liquid, and applying it. The application can be performed using known methods in the art, such as impregnation coating, spray coating, bead coating, ring coating or the like. The thickness of the charge-generating layer provided as mentioned above may be approximately 0.01 μm to 5 μm, preferably 0.05 μm to 2 μm.

The charge transport layer 37 can be formed by dissolving or dispersing at least the charge transport material and the binder resin in a suitable solvent, applying this on the charge-generating layer 35, and drying.

The charge transport material may include a hole transport material and electron transport material. Examples of the electron transport material are electron acceptors such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b] thiophene-4-one, 1,3,7-trinitrodibenzothiophene-5,5-dioxide, diphenoquinone derivatives and the like. These electron transport materials can be used alone, or two or more may be used in combination.

The hole transport material may be any of electron donor materials represented as follow which may be used without problem. Examples of the positive hole transport material are the electron donor materials such as oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives, pyrene derivatives, bis-stilbene derivatives, enamine derivatives and other known materials may be used. These hole transport materials can be used alone, or two or more can be used in combination.

Examples of the binder resin are polystyrene, styrene-acrylonitrile copolymer, styrene-butadiene copolymer, styrene-maleic anhydride copolymer, a polyester resin, polyvinyl chloride, vinyl chloride-vinyl acetate copolymer, polyvinyl acetate, polyvinylidene chloride, polyarylate, a phenoxy resin, an acrylic resin, a methacrylic resin, polycarbonate, an epoxy resin, a melamine resin, a urethane resin, a silicone resin, a fluoro resin, a cellulose acetate resin, an ethyl cellulose resin and the like. These may be used alone, or two or more resins may be used in combination.

The charge transport layer 37 may also be a polymeric charge transport material having both functions of a binder resin and a charge transport material. The charge transport layer formed of such a polymeric charge transport material excels in wear resistance. In the present invention, it is also possible to mix the above-mentioned binder resins and low molecular weight charge transport material with these polymeric charge transport materials. Although any polymeric charge transport material known in the art can be used, a polycarbonate having a triarylamine structure in the principal chain and/or side chain is preferable. In particular, polymeric charge transport materials expressed by the following Formulas 4 to 13 are suitably used.

Formula 4

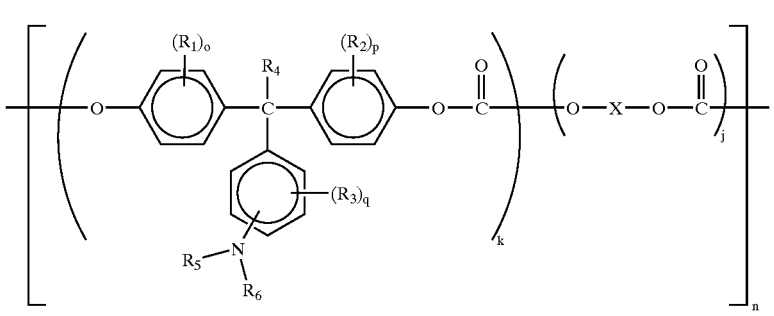

[in Formula 4, each of "R1", "R2", and "R3" is respectively a substituted alkyl group and/or an unsubstituted alkyl group or a halogen atom, "R4" is a hydrogen atom or a substituted alkyl group and/or an unsubstituted alkyl group, each of "R5" and "R6" is a substituted aryl group and/or an unsubstituted aryl group, "o", "p" and "q" are integers in the range of 0 to 4, "k", "j" each represent compositional (molar) fractions where $0.1 \leqq k \leqq 1$, $0 \leqq j \leqq 0.9$, "n" represents the number of repeating units and is an integer in the range 5 to 5000. "X" is an aliphatic divalent group, a cyclic aliphatic divalent group, or the divalent group shown by the following formula:

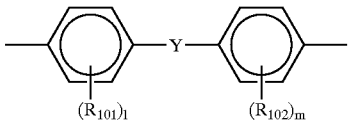

(in the formula, each of "R101" and "R102" is respectively a substituted alkyl group and/or an unsubstituted alkyl group, an aryl group, or a halogen atom, "1" and "m" are integers in the range of 0 to 4, "Y" is a single bond, straight-chain, branched and/or cyclic alkylene group having 1 to 12 carbon atoms), —O—, —S—, —SO—, —SO2-, —CO—, —CO—O—Z—O—CO— (Z is an aliphatic divalent group), or:

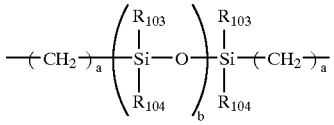

("a" is an integer in the range of 1 to 20, "b" is an integer in the range of 1 to 2000, each of "R103" and "R104" is a substituted/unsubstituted alkyl group or aryl group). Herein, "R101", "R102", "R103" and "R104" may be respectively identical or different].

Formula 5

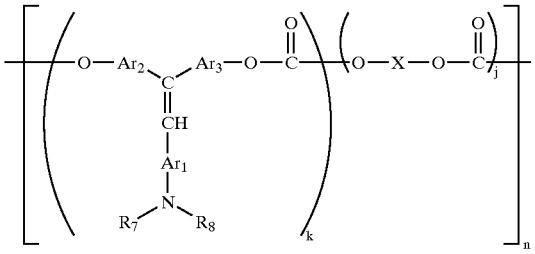

(in Formula 5, each of "R7" and "R8" is a substituted aryl group and/or an unsubstituted aryl group, "Ar1", "Ar2" and "Ar3" are allylene groups which may be identical or different to each other, "X", "k", "j" and "n" are the same as in Formula 4).

Formula 6

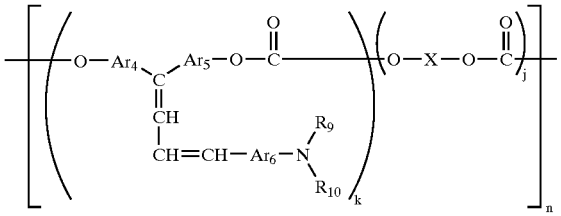

(in Formula 6, each of "R9" and "R10" is a substituted aryl group and/or an unsubstituted aryl groups, "Ar4", "Ar5" and "Ar6" are allylene groups which may be identical or different to each other, "X", "k", "j" and "n" are the same as in Formula 4).

Formula 7

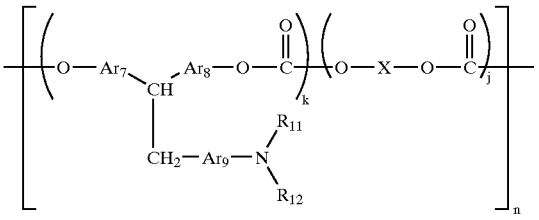

(in Formula 7, each of "R11" and "R12" is a substituted aryl group and/or an unsubstituted aryl group, "Ar7", "Ar8" are "Ar9" are allylene groups which may be identical or different to each other, "p" is an integer in the range 1 to 5, "X", "k", "j" and "n" are the same as in Formula 4).

Formula 8

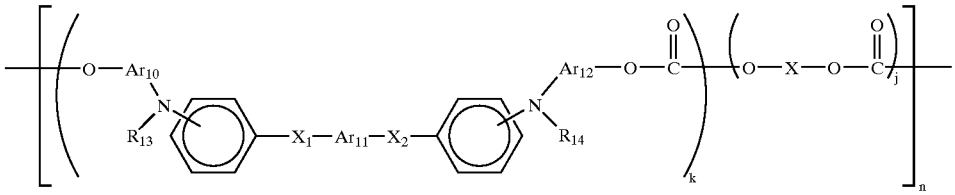

(in Formula 8, each of "R13" and "R14" is a substituted aryl group and/or an unsubstituted aryl group, "Ar10", "Ar11" and "Ar12" are allylene groups which may be identical or different to each other, "X1" and "X2" are a substituted ethylene group and/or an unsubstituted ethylene group, or a substituted vinylene group and/or an unsubstituted vinylene group. "X", "k", "j" and "n" are the same as in Formula 4).

Formula 9

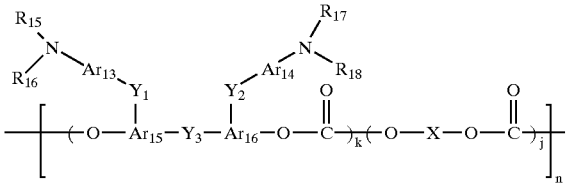

(in Formula 9, each of "R15", "R16", "R17" and "R18" is a substituted aryl group and/or an unsubstituted aryl group, "Ar1", "Ar2" and "Ar3" are allylene groups which may be identical or different, each of "Y1", "Y2" and "Y3" is single bond, a substituted alkylene group and/or an unsubstituted alkylene group, a substituted cycloalkylene group and/or an unsubstituted cycloalkylene group, a substituted alkylene ether group and/or an unsubstituted alkylene ether group, an oxygen atom, a sulfur atom or a vinylene group. "X", "k", "j" and "n" are the same as in Formula 4).

Formula 10

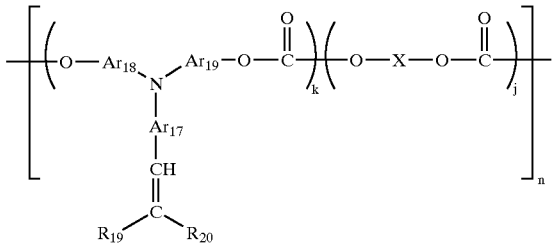

(in Formula 10, each of "R19" and "R20" is a hydrogen atom, or a substituted aryl group and/or an unsubstituted aryl group, and "R19" and "R20" may form a ring. "Ar17", "A18" and "A19" are allylene groups which may be identical or different. "X", "k", "j" and "n" are the same as in Formula 4).

Formula 11

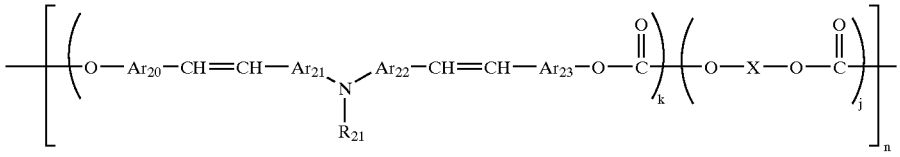

(in Formula 11, "R21" is a substituted aryl group and/or an unsubstituted aryl group, "Ar20", "Ar21", "Ar22" and "Ar23" are allylene groups which may be identical or different, "X", "k", "j" and "n" are the same as in Formula 4).

Formula 12

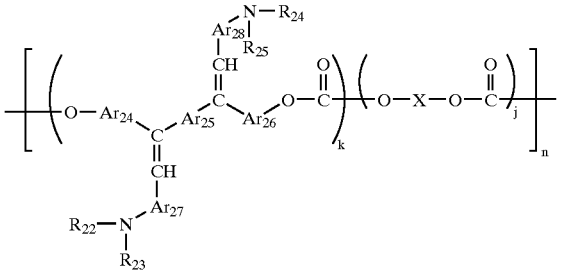

(in Formula 12, each of "R22", "R23", "R24" and "R25" is a substituted aryl group and/or an unsubstituted aryl group, "Ar24", "Ar25", "Ar26", "Ar27" and "Ar28" are allylene groups which may be identical or different. "X", "k", "j" and "n" are the same as in Formula 4).

Formula 13

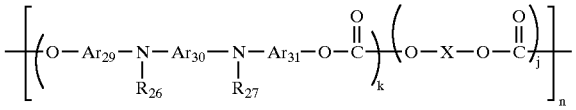

(Formula 13, each of "R26" and "R27" is a substituted aryl group and/or an unsubstituted aryl group, "Ar29", "Ar30" and "Ar31" are allylene groups which may be identical or different. "X", "k", "j" and "n" are the same as in Formula 4).

Hereinafter, some examples of the polycarbonate having a triarylamine structure in the main chain and/or side chain are shown (Compounds 1 to 34), but the present invention is not limited to these examples.

Compound 1

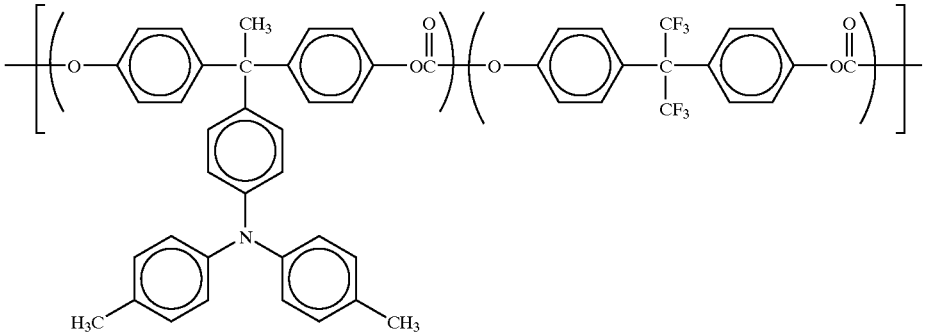

Compound 2

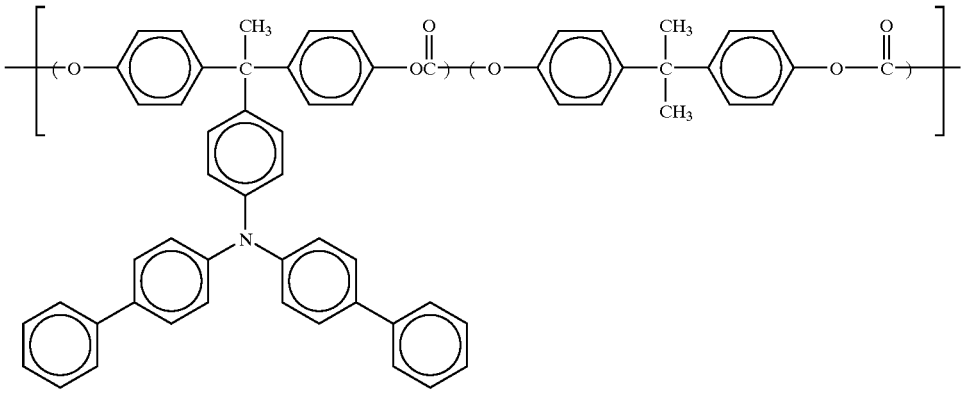

-continued
Compound 3
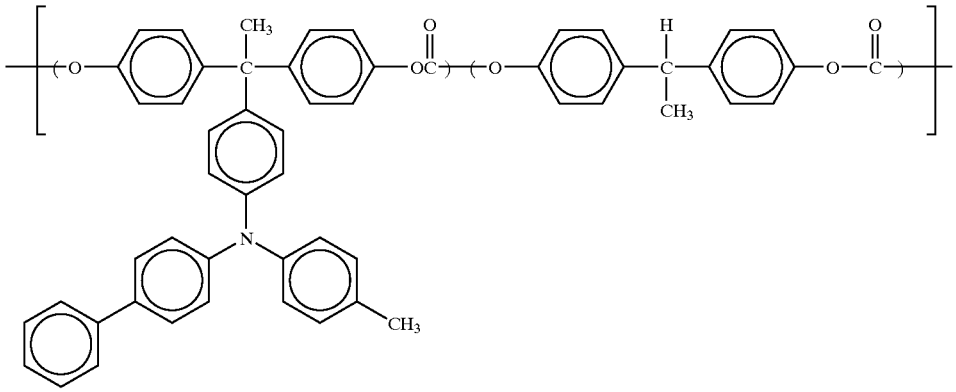
Compound 4
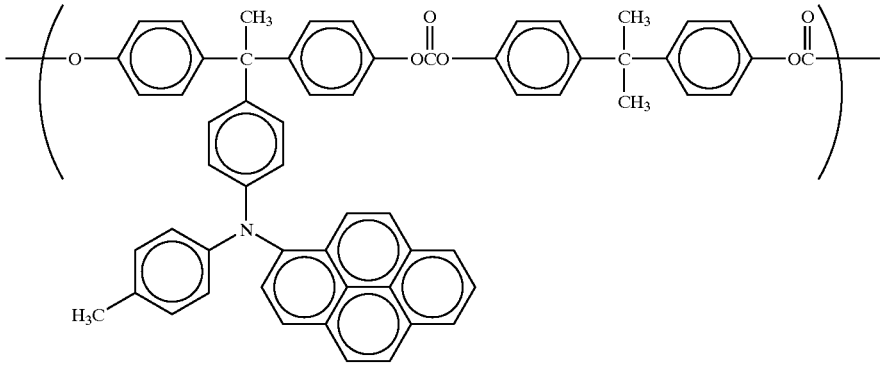
Compound 5
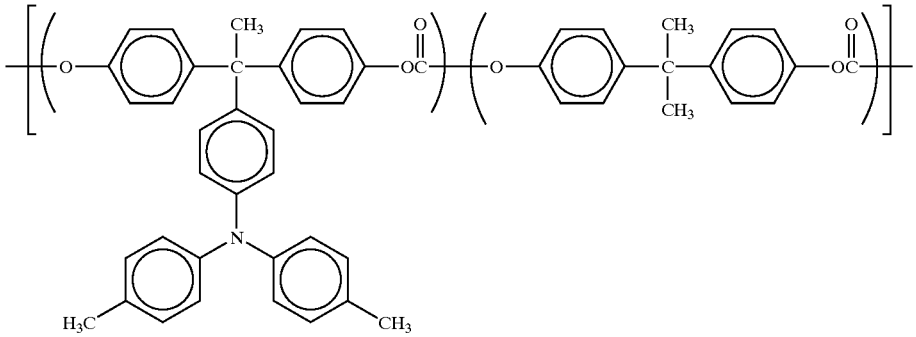
Compound 6
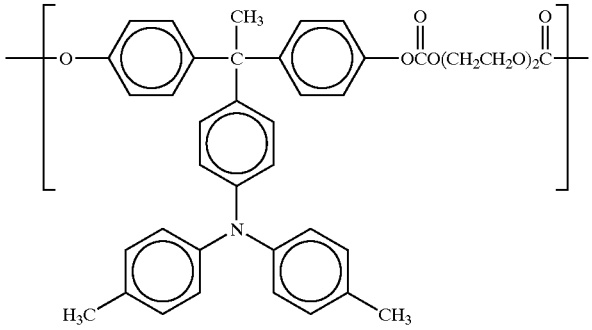

-continued
Compound 7
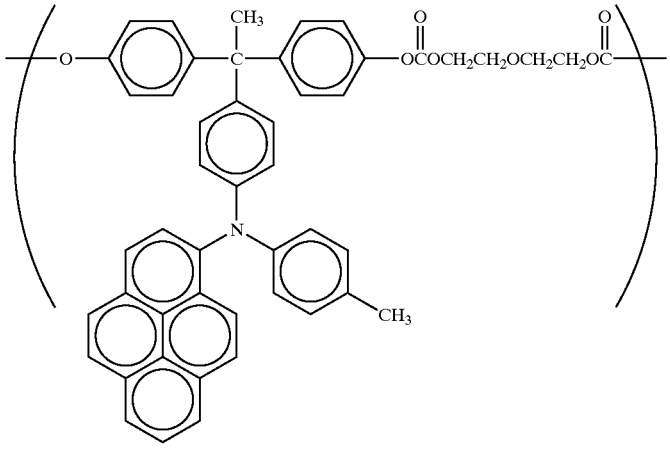
Compound 8
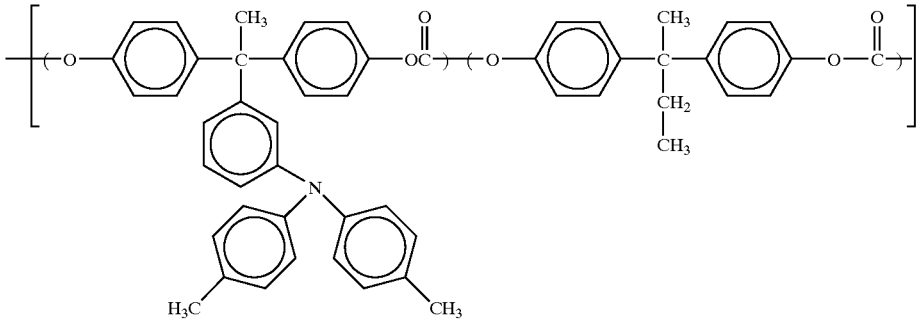
Compound 9
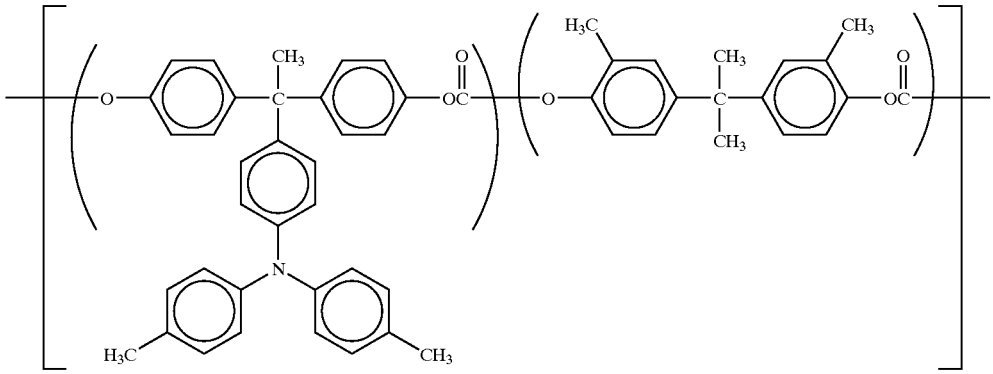
Compound 10
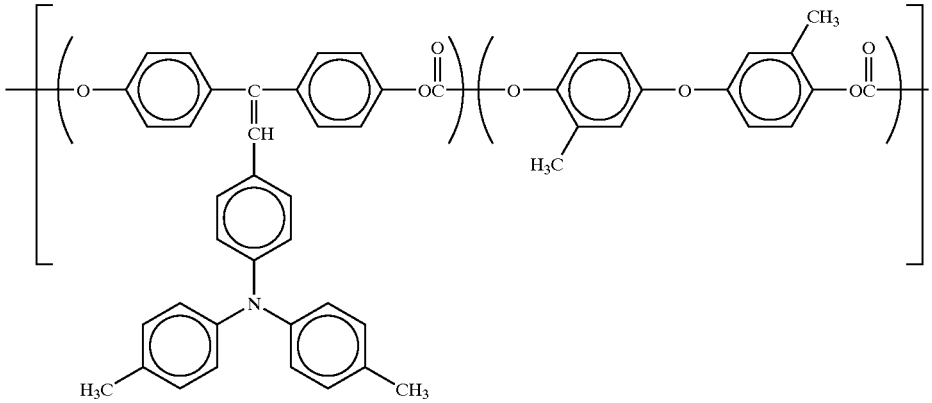

-continued
Compound 11
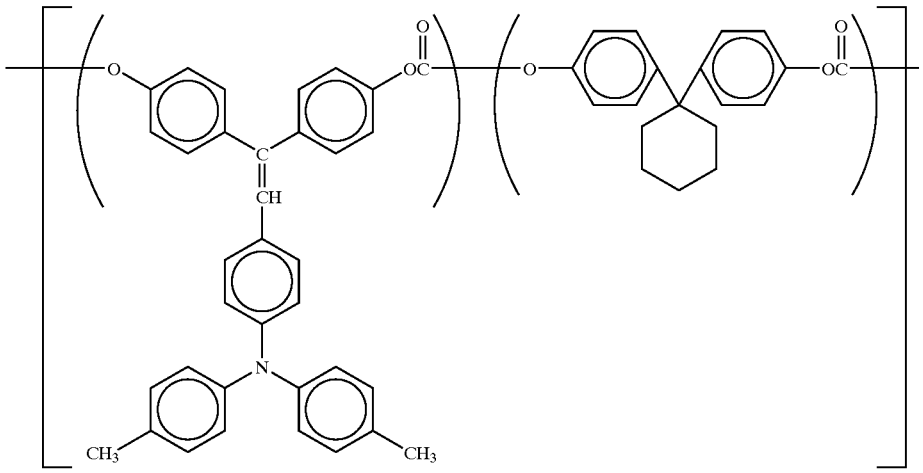
Compound 12
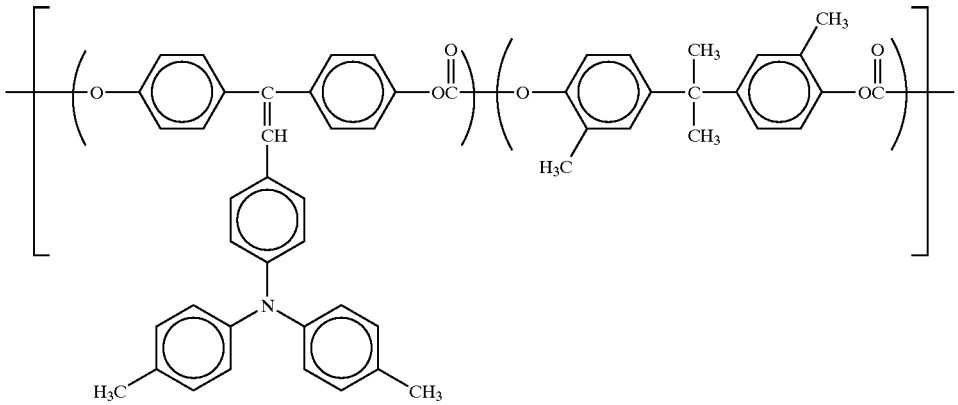
Compound 13
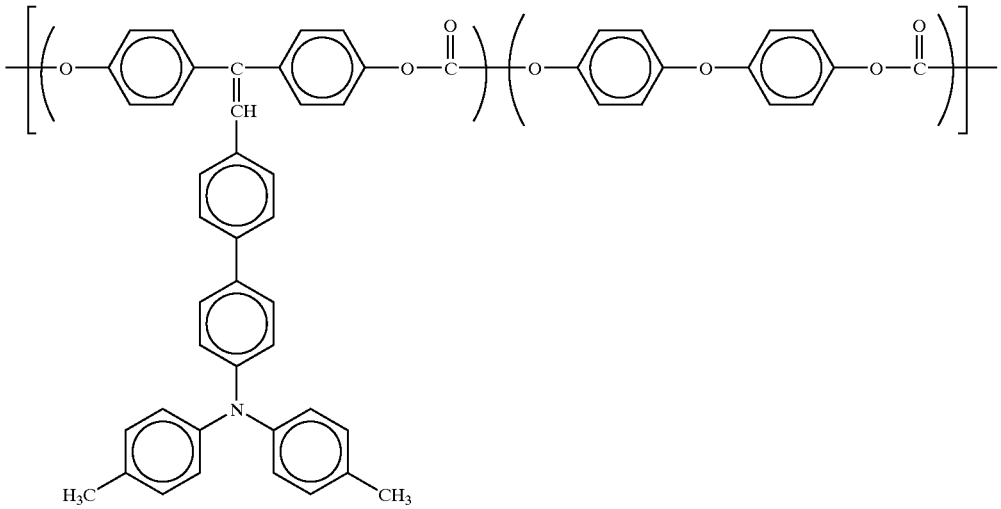

-continued
Compound 14
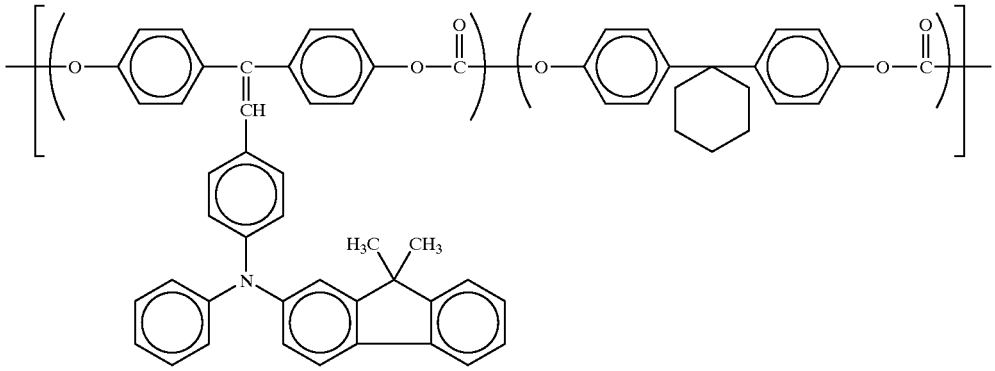
Compound 15
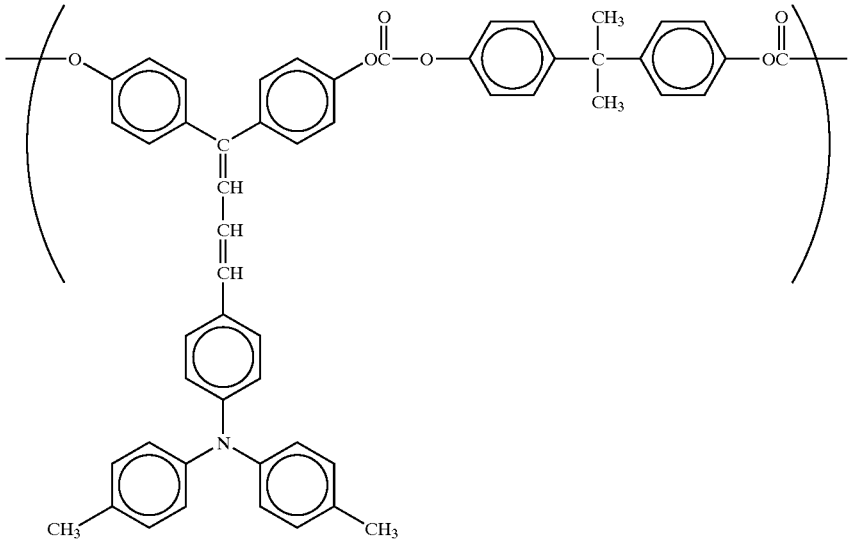
Compound 16
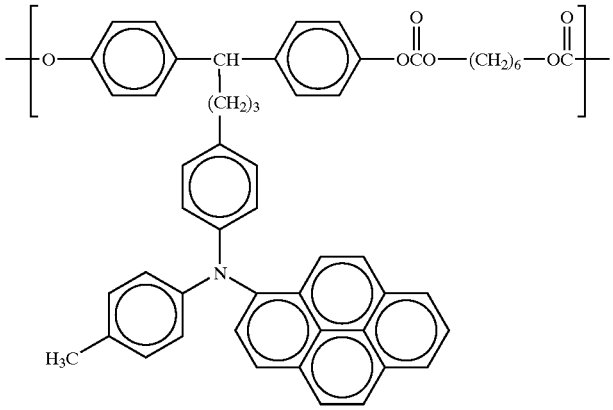

-continued
Compound 17
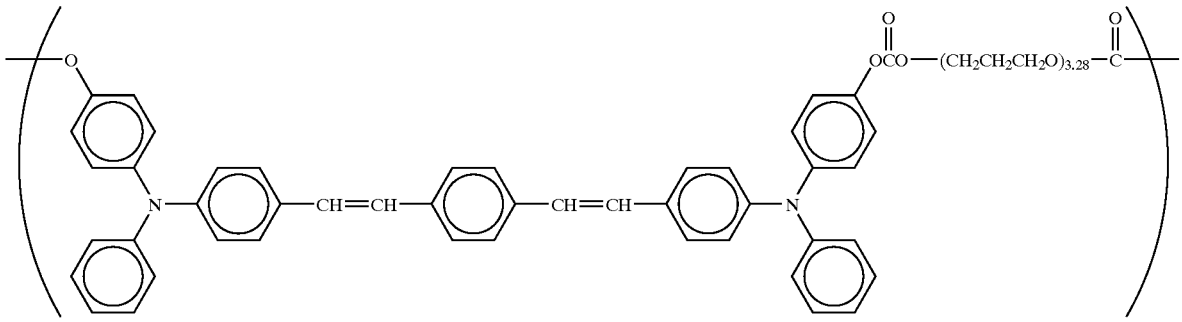
Compound 18
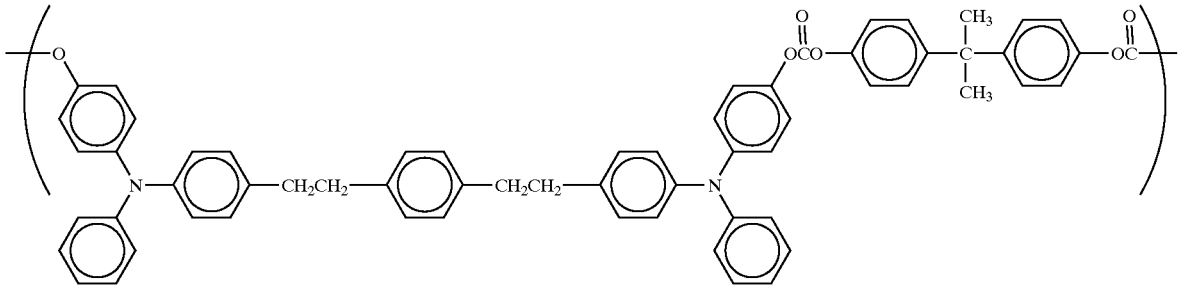
Compound 19
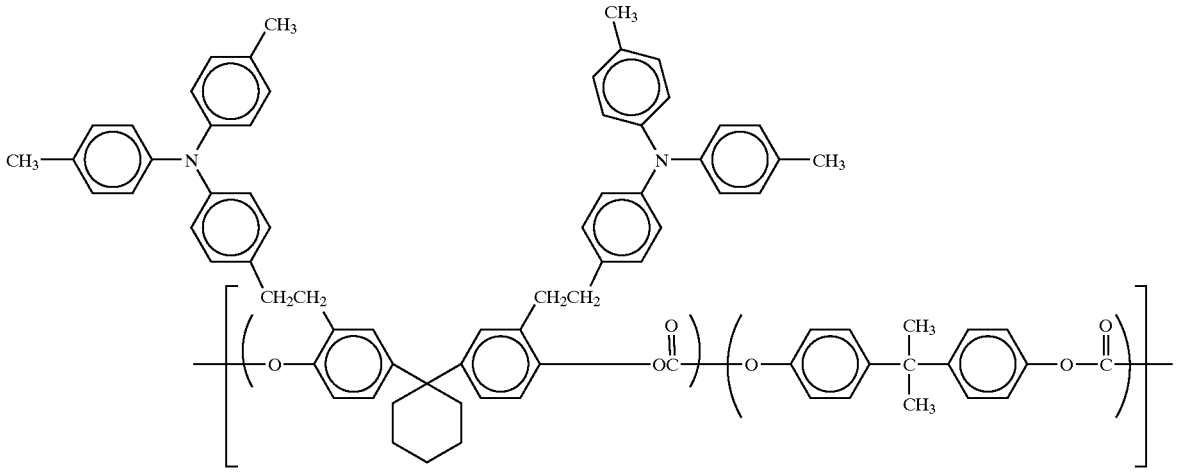
Compound 20
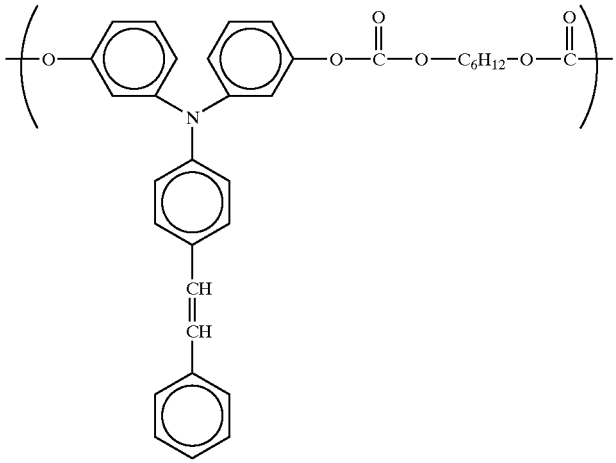

-continued
Compound 21
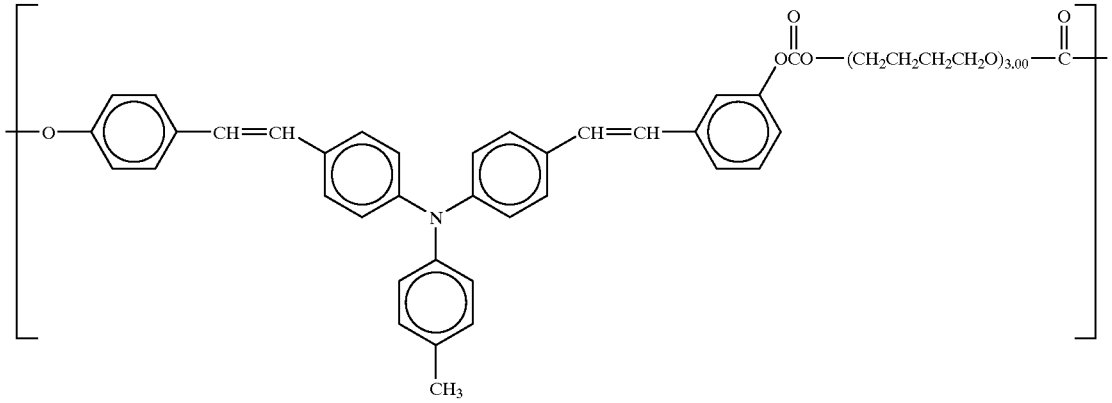
Compound 22
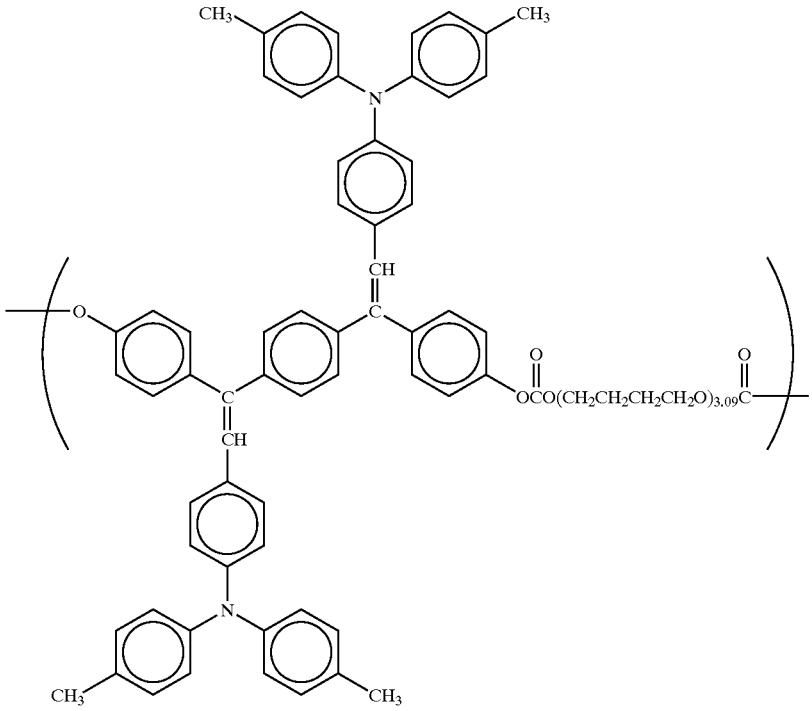
Compound 23
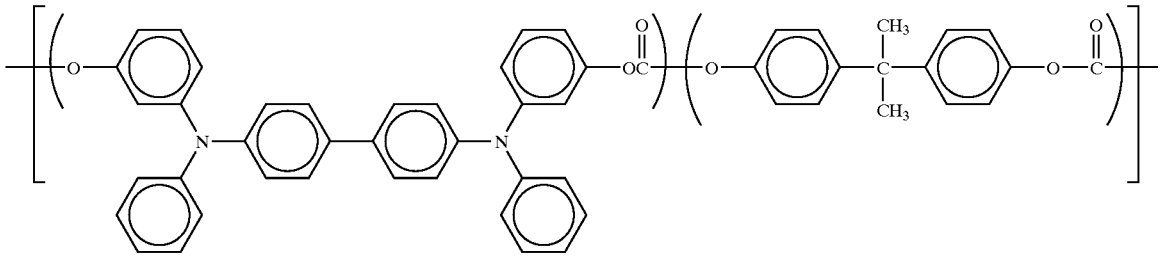
Compound 24
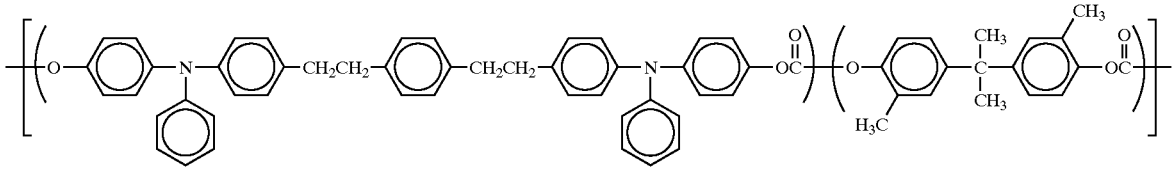

-continued
Compound 25
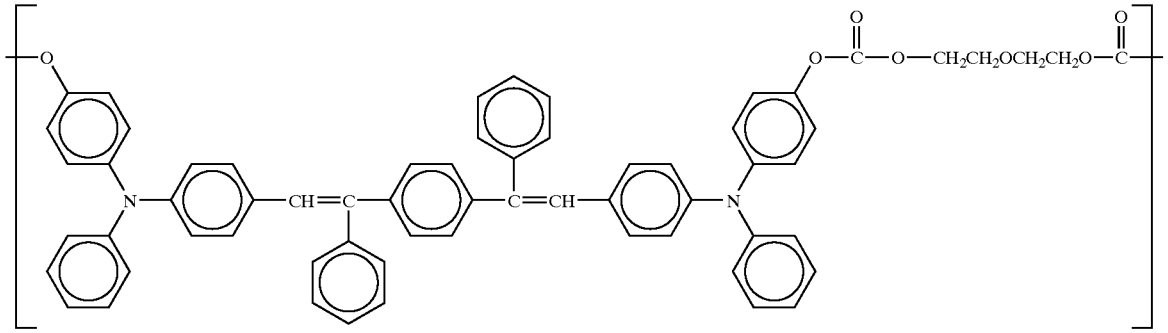
Compound 26
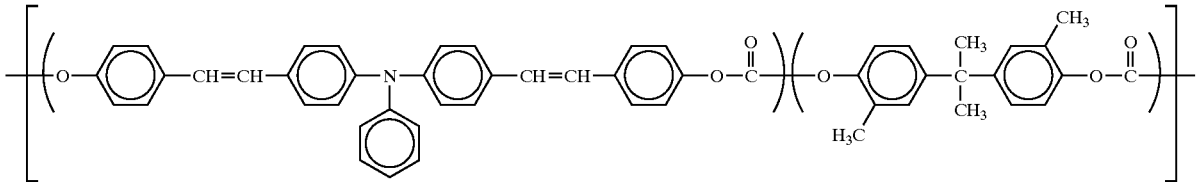
Compound 27
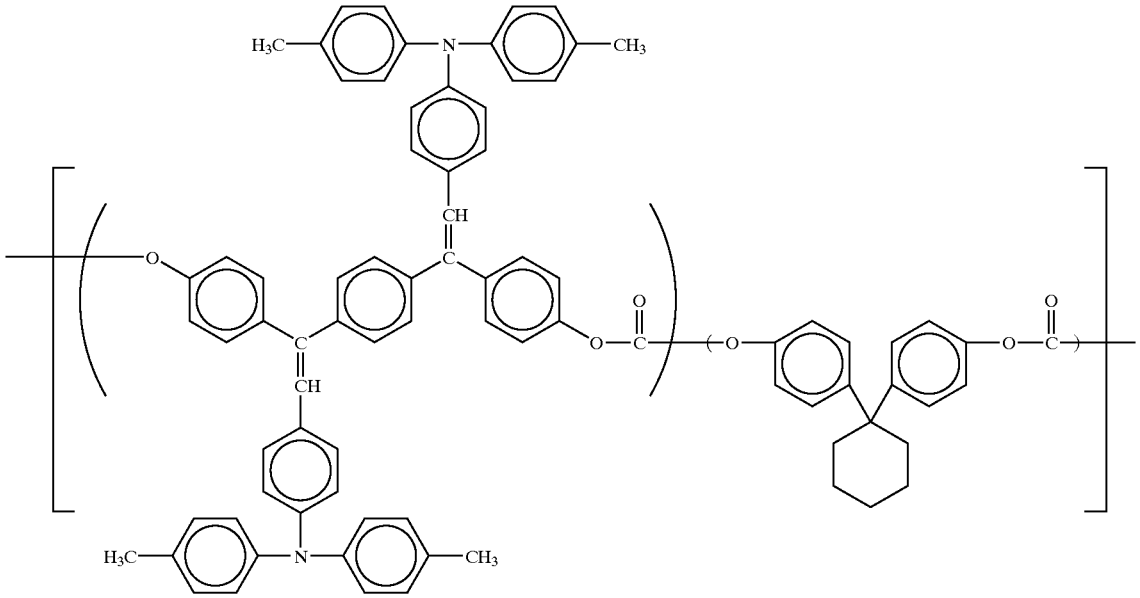
Compound 28
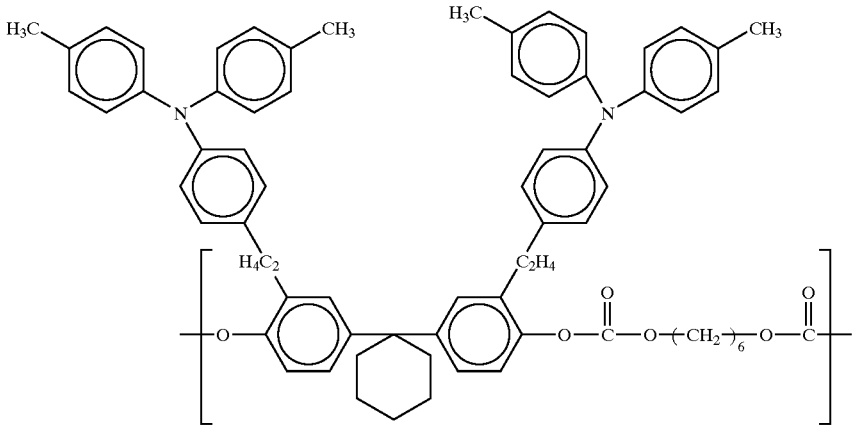

-continued
Compound 29
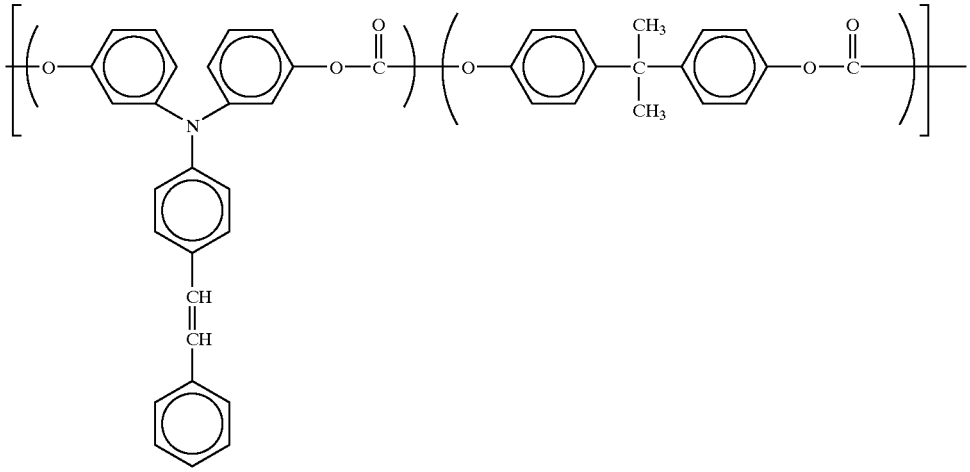
Compound 30
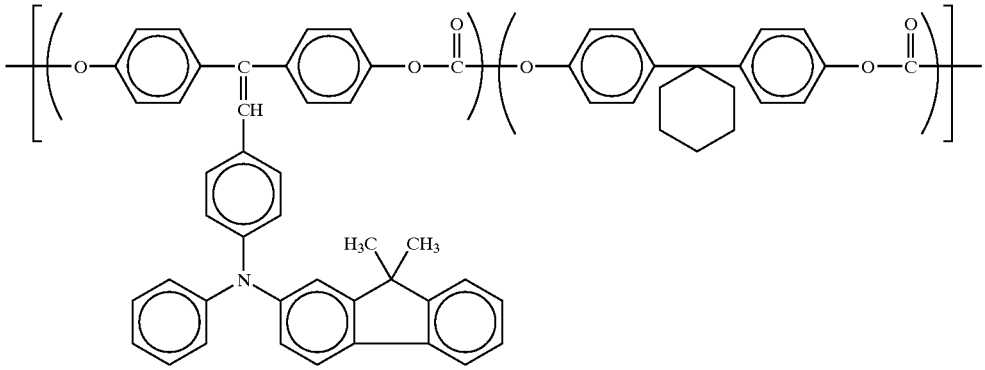
Compound 31
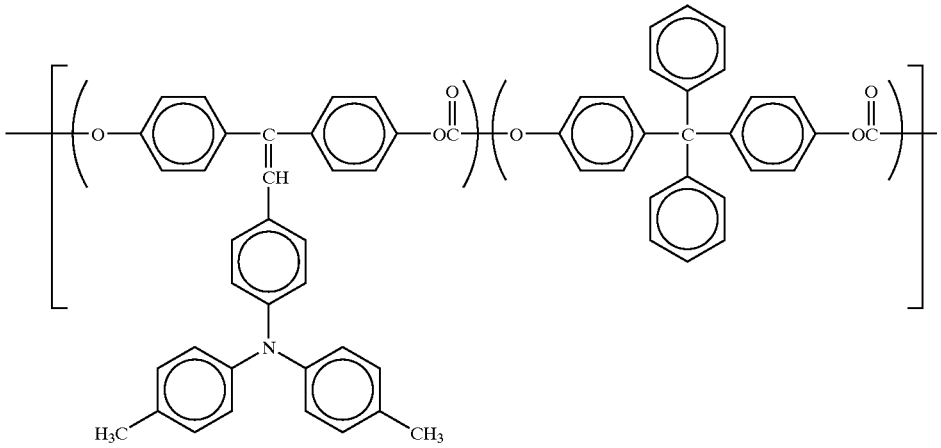

-continued

Compound 32

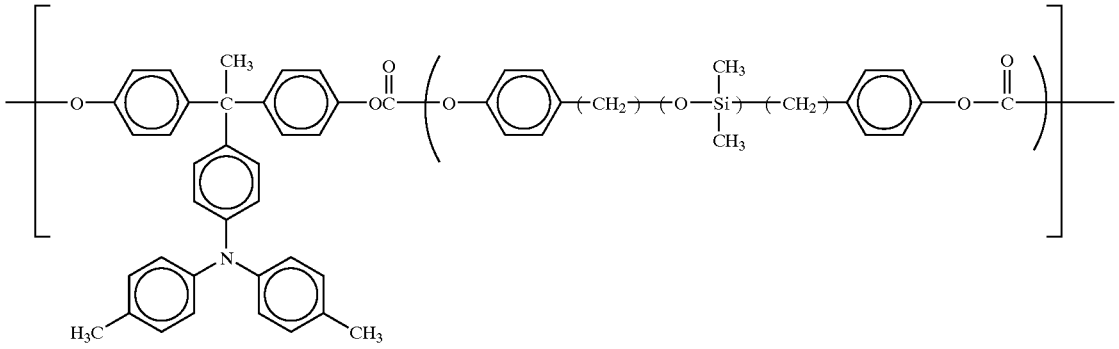

Compound 33

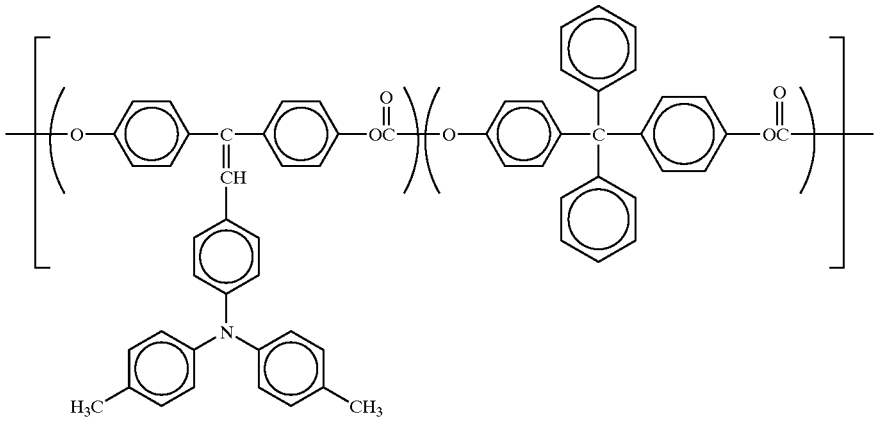

Compound 34

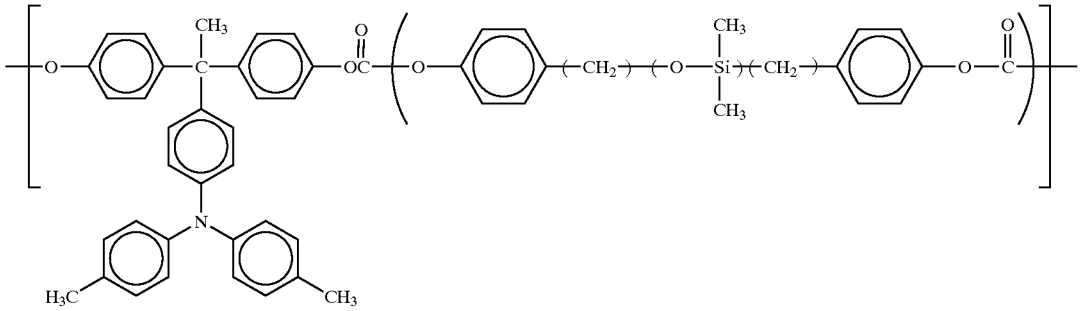

These polymeric charge transport materials having a triarylamine structure in the main chain or side chain are polymerized as a single polymer, random copolymer, alternating copolymer and block copolymer. The polymeric charge transport materials also have the function of a binder resin, and are required to be able to form a layer. Therefore, when measured by GPC, the molecular weight should be 10,000 to 500,000 and preferably 50,000 to 400,000 as the polystyrene equivalent molecular weight Mw.

These polymeric charge transport materials are disclosed in JP-A No. 08-269183, JP-A No. 09-71642, JP-A No. 09-104746, JP-A No. 09-272735, JP-A No. 11-29634, JP-A No. 09-235367, JP-A No. 09-87376, JP-A No. 09-110976, JP-A No. 09-268226, JP-A No. 09-221544, JP-A No. 09-227669, JP-A No. 09-157378, JP-A No. 09-302084, JP-A No. 09-302085 and JP-A No. 2000-26590.

The content of charge transport material is 20 parts by weight to 300 parts by weight, preferably 40 parts by weight to 150 parts by weight, relative to 100 parts by weight of binder resin. When using the polymeric charge transport material, it may be used alone or in combination with other binder resins.

The solvent used for applying the charge transport layer 37 may be identical to that used for the charge-generating layer 35. Examples are solvents such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, butyl acetate and the like. Of these, solvents, which easily dissolve the charge transport material and the binder resin, are suitable. These solvents may be used alone, or two or more may be used in combination.

A leveling agent, antioxidant, a plasticizer and the like, may be added to the charge transport layer 37, if necessary. Examples of leveling agent, which can be added thereto, are silicone oils such as dimethyl silicone oil, methylphenyl oil and the like, polymers or oligomers having a perfluoralkyl group in the side chain. The content thereof is approximately 0 part by weight to 1 parts by weight relative to 100 parts by weight of binder resin. Examples of antioxidant which can be added thereto, are any known antioxidants in the art, such as phenol compounds, hindered phenol compounds, hindered amine compounds, paraphenyldiamines, hydroquinones, organosulfur compounds, organic phosphorous compounds, benzophenones, salicylates, benzotriazoles, quenchers (metal complexes) and the like. The content thereof is approximately 0 part by weight to 5 parts by weight relative to 100 parts by weight of binder resin. Examples of plasticizer, which can be added thereto, are any common resin plasticizer such as dibutyl phthalate, dioctyl phthalate and the like which can be used without modification, the content being approximately 0 parts by weight to 30 parts by weight relative to 100 parts by weight of binder resin.

Application of the charge transport layer can be performed using methods known in the art, such as impregnation coating in the same way as for the charge-generating layer 35, or spray coating, bead coating and ring coating. Of these, impregnation coating is most preferred. The application thickness of the charge transport layer 37 is approximately 5 $\mu$m to 50 $\mu$m, preferably approximately 10 $\mu$m to 30 $\mu$m from the viewpoint of image properties such as resolution and toner deposition on the background of images, and electrical properties such as charge potential and sensitivity.

Next, the case where the photoconductive layer has a single layer construction 33, will be described. The photoconductive layer 33 is formed by dissolving and/or dispersing the above-mentioned charge-generating material, charge transport material and a binder resin in a suitable solvent, applying the solvent on the electroconductive support and drying. The charge-generating material and the charge transport material may comprise any of the materials given for the aforesaid charge-generating layer 35 and charge transport layer 37. The binder resin may be any resin given for the charge transport layer 37, but the resin given for the charge-generating layer 35 may also be mixed with it. The aforesaid polymer charge transport material can also be used as the binder resin. The content of the charge-generating material relative to the binder resin is preferably 5 parts by weight to 40 parts by weight but more preferably 10 parts by weight to 30 parts by weight, and the content of charge transport material is preferably 0 part by weight to 190 parts by weight but more preferably 50 parts by weight to 150 parts by weight, relative to 100 parts by weight of binder resin. The photoconductive layer may be formed by dissolving and/or dispersing the above-mentioned charge-generating material and binder resin together with the charge transport material in a solvent such as tetrahydrofuran, dioxane, dichloroethane, cyclohexanone, toluene, methyl ethyl ketone, acetone and the like, and applying it by impregnation coating, spray coating, bead coating, ring coating or the like. Various additives, such as the above-mentioned plasticizers, leveling agent, antioxidant, or a lubricant, can also be added, if necessary. The thickness of the photoconductive layer 33 is approximately 5 $\mu$m to 25 $\mu$m.

In the present invention, a protective layer is formed as an outermost layer on the above-mentioned charge transport layer, charge-generating layer or photoconductive layer. This protective layer contains the aforesaid acryl-modified polyorganosiloxane compound, an acrylic resin and/or a methacrylic resin.

The acryl-modified polyorganosiloxane compound of the present invention contained in the protective layer of the photoconductor is as described above, specific examples being commercially available as CHALINE R-170S, R-170 and R-210 from Nissin Chemical Industry Co., Ltd, and the like. Of these, R-170S and R-170 have a very high silicone content of about 70%, and are particularly effective and useful. R-170S, which has a spherical form and a smaller average particle diameter has the highest effect, and is the most useful.

The content of the acryl-modified polyorganosiloxane compound is preferably 1% by weight to 40% by weight, more preferably 5% by weight to 20% by weight, relative to total solids. If the content is less than this range, the durability of the surface energy reduction effect on the photoconductor surface falls, and if the content is more than this range, layer defects may occur and surface flatness/smoothness may be compromised.

As the binder resin contained in the outermost layer of the photoconductor, an acrylic resin and/or a methacrylic resin are mainly used. The acrylic resins and/or methacrylic resins in the present invention include all resins having one or more acrylic groups and/or methacrylic groups, or their copolymers, regardless of whether they are crosslinked. In the present invention, other binder resins known in the art, for example, polystyrene, styrene-acrylonitrile copolymer, styrene-butadiene copolymer, styrene-maleic anhydride copolymer, polyester resin, polyvinyl chloride, vinyl chloride-vinyl acetate copolymer, polyvinyl acetate, polyvinylidene chloride, polyarylate, phenoxy resin, polycarbonate, epoxy resin, melamine resin, urethane resin, silicone resin, fluororesin, cellulose acetate resin and ethyl cellulose resin, can be mixed and used together with the aforesaid acrylic resin and/or methacrylic resin.

It is very effective to form a layer using a solution containing at least the aforesaid acryl-modified polyorganosiloxane compound and one or more acrylic monomers or oligomers and/or methacrylic monomers or oligomers, and then curing by the action of light or heat, as this remarkably improves the dispersibility of the aforesaid acryl-modified polyorganosiloxane compound. The acrylic monomer or oligomer and/or the methacrylic monomer or oligomer in the present invention means compounds having one or more acrylic groups and/or methacrylic groups, and all resins or copolymers polymerized using these monomers or oligomers. Examples of these acrylic and/or methacrylic monomers or oligomers are methyl acrylate, methyl methacrylate, ethyl acrylate, ethyl methacrylate, n-butyl acrylate, n-butyl methacrylate, iso-butyl acrylate, iso-butyl methacrylate, propyl acrylate, propyl methacrylate, hexyl acrylate, hexyl methacrylate, cyclohexyl acrylate, cyclohexyl methacrylate, benzyl acrylate, benzyl methacrylate and the like. As the dispersibility of the acryl-modified polyorganosiloxane compound improves remarkably by copolymerizing hydroxyethyl acrylate or hydroxy ethyl methacrylate as the methacrylic monomer or oligomer, the aforesaid acrylic resins and/or methacrylic resins having a hydroxyl value are particular effective. Example of such monomers are 2-hydroxyethyl acrylate, 2-hydroxyethyl methacrylate, 2-hydroxypropyl acrylate, 2-hydroxypropyl methacrylate, 3-hydroxypropyl acrylate, 3-hydroxypropyl methacrylate and the like. The acrylic and/or methacrylic monomers or oligomers, or their copolymers, may also be copolymerized with other monomers, oligomers or various cross linking agents, which is effective in improving wear-resistance and dispersibility of the acryl-modified polyorganosiloxane compound. The cross linking agents may be any of those known in the art, such as isocyanates, benzoguanamine resin, melamine resin and the like. When these acrylic monomers or oligomers, and/or methacrylic monomers or oligomers, are cured, any means such as light and heat may be used, and any additives such as a polymerization initiator may also be added. The cured resins or copolymers obtained in this way may also be mixed and used with the above-mentioned binder resins.

The protective layer of the photoconductor may further contain metal oxide particles for the purpose of wear-resistance improvement, and this is effective in increasing durability. Examples of metal oxide particles are silica, tin oxide, zinc oxide, titanium oxide, alumina, zirconia, indium oxide, antimony oxide, bismuth oxide, calcium oxide, tin oxide doped with antimony, indium oxide doped with tin and the like. Of these metal oxide particles, metal oxide particles with high electrical insulating properties are preferred as they do not easily allow image blurring to occur. Examples of such metal oxide particles are alumina, zirconia and titanium oxide. On the other hand, when the outermost surface of the photoconductor contains electrically conductive metal oxide particles, surface resistance falls, horizontal charge transfer takes place and image blurring easily occurs, so the addition amount must be limited to control resistance. Examples of these metal oxide particles are electrically conductive materials such as tin oxide, zinc oxide, indium oxide, antimony oxide, tin oxide doped with antimony and indium oxide doped with tin.

When the acrylic resin and/or methacrylic resin is used for the binder resin, the use of metal oxide particles which exhibit basic properties may improve dispersibility of the metal oxide particles, and as these metal oxide particles have a higher degree of margin to image blurring, they are very effective. The basic properties of the metal oxide particles can be determined by finding the pH at the isoelectric point. Examples of such metal oxide particles are titanium oxide, zirconia and alumina, but of these, alumina is preferred. In particular, $\alpha$ type alumina which has a hexagonal fine structure with excellent wear resistance in addition to high optical transmittance and high thermal stability, can be effectively used from viewpoints such as suppression of image blurring, improvement of wear resistance, quality and optical transmittance.

The metal oxide particles used in the present invention can usefully be subjected to at least one kind of surface treatment. In a photoconductor wherein metal oxide particles are contained in the protective layer, a tendency to greater image blurring due to ozone or $NO_x$ gas is seen, but by giving a surface treatment, the specific resistance of the metal oxide particles and their pH at the isoelectric point can be controlled. Thus, by giving a surface treatment, the suppression of image blurring may be considerably enhanced. The surface treatment of metal oxide particles not only suppresses image blurring, but also improves the dispersibility of the metal oxide particles. It is effective also for improving the optical transmittance of the layer, suppression of layer defects, improvement of wear resistance and suppression of uneven wear.

The surface treatment agent may be any of the surface treatment agents used in the art, but surface treatment agents which can maintain the aforesaid specific resistance of the metal oxide particles and pH at the isoelectric point are preferred. The pH of the metal oxide particles at the isoelectric point can be changed by surface treatment. That is, the isoelectric point shifts to the acid side for metal oxide particles treated by an acidic treatment agent and shifts to the basic side for metal oxide particles treated by a basic treatment agent, so in the present invention, the use of a surface treatment agent showing basic properties is preferred from the viewpoint of dispersibility of the metal oxide particles and suppression of image blurring. For example, titanate coupling agents, aluminium coupling agents, zircoaluminate coupling agents and the like are particularly effective. Treatment by $Al_2O_3$, $TiO_2$, $ZrO_2$, silicone, aluminum stearate or mixtures thereof is also preferable from the viewpoint of dispersibility of the metal oxide particles and image blurring.

From the viewpoint of optical transmittance and wear-resistance, the average first-order particle diameter of the metal oxide particles is preferably 0.01 $\mu$m to 0.9 $\mu$m, more preferably 0.1 $\mu$m to 0.5 $\mu$m. If the average first-order particle diameter of the metal oxide particles is smaller than this range, aggregation and decrease of wear-resistance tend to occur, and due to the increase in the specific surface area of the metal oxide particles, image blurring may increase. If the average first-order particle diameter of the metal oxide particles is larger than this range, sedimentation of the metal oxide particles may be promoted, layer quality may decline, or image deterioration may occur in electrophotographic apparatuses using them.

In order to increase the dispersibility of the above-mentioned metal oxide particles, it is useful to add various additives. In particular, carboxylic acid compounds enables not only increase the dispersibility of metal oxide particles and their stability, but also suppress the residual potential rise due to the addition of the metal oxide particles. Of these, polycarboxylic acid wet dispersants are very effective and highly useful. Any carboxylic acid compound may be used so long as it is a compound containing a carboxyl group in the molecular structure, such as an organic fatty acid, high acid value resin or copolymer known in the art. Examples are saturated fatty acids, unsaturated fatty acids or aromatic carboxylic acids such as lauric acid, stearic acid, arachidic acid, behenic acid, adipic acid, oleic acid, maleic acid, maleic anhydride, salicylic acid, phthalic acid, isophthalic acid, terephthalic acid, pyromellitic acid and the like. Also included are all polymers, oligomers and copolymers having a saturated or unsaturated hydrocarbon as their basic skeleton bonded to one or more carboxyl groups, such as saturated polyesters, unsaturated polyesters, terminal carboxylic acid unsaturated polyesters, styrene-maleic acid copolymer, styrene-maleic anhydride and the like. These not only suppress the residual potential increase, but as they strongly improve the dispersibility of metal oxide particles, they may be used even more effectively. Of these carboxylic acid compounds, polycarboxylic acid compounds having two or more carboxylic acid residues which are miscible with organic solvents have a high acid value, and tend to have improved adsorption onto the metal oxide particles, so they are particularly effective in reducing the residual potential and improving the dispersibility of the metal oxide particles. Of these polycarboxylic acid compounds, "BYK-P104" manufactured by the BYK Chemical Corp., which is a polycarboxylic acid type wet dispersant, is the most effective.

Apparently, the reduction of residual potential is due to the acid value of these compounds, and due to their adsorption onto the metal oxide particles. It is thought that the rise of residual potential due to addition of metal oxide particles occurs because a polar group on the metal oxide particle surface is a charge trap site. These carboxyl groups tend to be absorbed by this polar group, and the reduction of residual potential is therefore enhanced. They create an affinity between the metal oxide particles and the binder resin, promoting wettability. Also, due to steric hindrance or electrical repulsion, they decrease the interaction between metal oxide particles and increase stability, which improves the dispersibility of the metal oxide particles.

It is also found that these carboxylic acid compounds not only improve the dispersibility of the metal oxide particles, but also that of the aforesaid acryl-modified polyorganosiloxane compound. Prior art lubricants do not show any particular efficacy when mixed with these carboxylic acid compounds, but as the acryl-modified polyorganosiloxane compound of the present invention contains an acrylic group in molecular structure, it has an affinity with these carboxylic acid compounds, and dispersibility is improved. An improvement in layer quality is also realized, and is effective in stabilizing the image quality. Therefore, when the acryl-modified polyorganosiloxane compound and metal oxide particles are co-present, carboxylic acid compounds improve the dispersibility of both, and are also very effective in suppressing residual potential increase.

The protective layer can also be made to contain a charge transport material. By containing a charge transport material in the protective layer, residual potential is reduced and sensitivity decline is suppressed. However, depending on the type of charge transport material, the charge transport material may deteriorate due to ozone and $NO_x$, and may induce image blurring. If the protective layer contains the above-mentioned polymeric charge transport material, on the other hand, there are cases that suppression of image blurring may be enhanced. Also, if fine cracks remain on the photoconductor surface, it may be difficult to remove discharge products, and this also increases image blurring. Polymeric charge transport materials have excellent crack resistance compared with mixtures of charge transport materials and binder resins, and have the effect of improving image quality. Thus by including a polymeric charge transport material, detrimental effects can be alleviated, and the suppression of image blurring can be enhanced. The charge transport material and polymeric charge transport material used for the protective layer may be any of, or materials similar to, the charge transport materials and polymeric charge transport materials in the charge transport layer 37.

In the case of a protective layer formed by curing an acrylic resin and/or a methacrylic resin, the charge transport material may be crosslinked together with the curing acrylic monomer and/or oligomer, or curing methacrylic monomer and/or oligomer, which is effective to maintain strength. To crosslink the charge transport material, functional groups such as hydroxyl group may be introduced into the charge transport material. When a charge transport material is contained in a crosslinking, curing protective layer using an acrylic resin and/or methacrylic resin, the charge transport material is preferably crosslinked together as described above so as not to interfere with curing.

To the protective layer of the photoconductor, various antioxidants may also be usefully added. The antioxidants which can be contained in the present invention are all additives of antioxidants, UV absorbers and optical stabilizers known in the art, such as phenol compounds, hindered phenol compounds, hindered amine compounds, paraphenylenediamines, hydroquinones, organosulfur compounds, organic phosphorous compounds, benzophenones, salicylates, benzotriazoles, quenchers (metal complexes) and the like. It is known that, of these antioxidants, compounds having both a hindered phenol structure and a hindered amine structure are useful in suppressing deterioration of the photoconductor due to activated gases such as ozone and $NO_x$ after prolonged repetitive use, and have a large effect in improving image stability. In a hindered phenol structure, there are bulky atomic groups at both ortho positions of the phenolic hydroxyl group. On the other hand, in the hindered amine structure, there is a bulky atomic group near the amino nitrogen atom. Aromatic amines and fatty amines correspond to this, but compounds including a 2,2,6,6-tetra methyl piperidine structure are more preferable. Although the details of the mechanism of action of compounds having both structures is not clear, it may be conjectured that when a bulky atomic group is present, it increases steric hindrance, suppresses thermal vibration of amino nitrogen atoms and phenolic hydroxyl groups, and by raising the stability of the radical state, stops the influence of external activated gases. There are various examples of compounds having both a hindered phenol structure and hindered amine structure, but of these, 1-[2-[3-(3,5-di-t-butyl-4-hydroxyphenyl)propionyloxy]ethyl]-4-[3-(3,5-di-t-butyl-4-hydroxyphenyl) propionyloxy]-2,2,6,6-tetramethylpyridine expressed by the following formula, is particularly effective and useful for countering the decrease of resolution due to ozone or $NO_x$ gas.

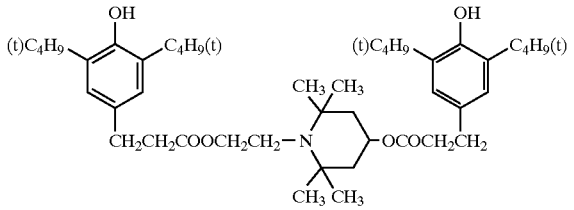

In the present invention, although an effect can be obtained by making the outermost layer of the photoconductor contain the acryl-modified polyorganosiloxane compound and acrylic resin and/or methacrylic resin, it is more preferred that the outermost layer of the photoconductor is the protective layer rather than the charge transport layer and photoconductive layer. By forming the protective layer, the thickness of the layer containing the acryl-modified polyorganosiloxane compound can be made thinner, so the density of the acryl-modified polyorganosiloxane compound can be increased which is desirable for stabilizing the surface energy reduction effect. The lesser thickness of the protective layer is advantageous for curing the acrylic resin and/or methacrylic resin, and thus is effective for enhancing the dispersibility of the acryl-modified polyorganosiloxane compound. Also, if the protective layer is formed, it is effective for enhancing the dispersibility of the added metal oxide, and effective for increasing durability. For these reasons, the thickness of the protective layer is preferably 0.5 $\mu$m to 10 $\mu$m, more preferably 2 $\mu$m to 6 $\mu$m.

The acryl-modified polyorganosiloxane compound, acrylic resin and/or methacrylic resin are mixed with an organic solvent, and dispersion treatment is performed if necessary to prepare a dispersion solution. Depending on the case, it is also possible to use the method of dispersing the acryl-modified polyorganosiloxane compound in an organic solvent, and then adding a resin solution. A charge transport material and various additives may also be added to these dispersion solutions if required. Examples of organic solvents which may be used are tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, butyl acetate and the like. Mixtures of these solvents are also effective. Any known dispersion means, such as a ball mill, attriter, sand mill, bead mill and ultrasonic waves can be used. Alternatively, mechanical mixing can be performed using an apparatus known in the art such as a Banbury mixer, roll mill or 2 axis extruder, so that pellets are made. The extruded pellets can be cast over a broad temperature range, the usual injection briquetting machine being used for pelleting.

Likewise, when using an acrylic and/or methacrylic curing resin, the acryl-modified polyorganosiloxane compound is mixed with at least an acrylic monomer or oligomer and/or methacrylic monomer or oligomer and an organic solvent, and metal oxide particles are added if necessary to make a dispersion and obtain a dispersion solution. In some cases, the acryl-modified polyorganosiloxane compound can be mixed with an organic solvent, metal oxide particles added if necessary to make a dispersion, and the monomer or oligomer then added. Subsequently, a cross linking agent, charge transport material, various additives, and the like can be added, and a coating solution obtained. The above-mentioned organic solvent may be any of the aforesaid organic solvents, and the dispersion means may be any of the aforesaid means.

The protective layer can be formed by any coating method of the prior art, such as impregnation coating, spray coating, bead coating, nozzle coating, spinner coating, ring coating and the like. Of these, spray coating is preferred as it permits easy application thickness control, makes it possible to maintain the dispersibility of the acryl-modified polyorganosiloxane compound and the metal oxide particles, and gives a superior quality.

The applied photoconductor is prepared through the process of a drying step by heating. When a curing acrylic resin and/or a methacrylic resin is used, light irradiation and/or heating step are added for curing.

In the photoconductor of the present invention, an underlayer can be provided between the electroconductive support 31 and the photoconductive layer. Although the underlayer generally contains a resin as principal component, considering that a photoconductive layer will be applied onto it with a solvent, it is preferred that the resin has high resistance towards common organic solvents. Examples of such resins are water-soluble resins such as polyvinyl alcohol, casein, sodium polyacrylate and the like; alcohol-soluble resins such as copolymer nylon, methoxymethylated nylon and the like; and curing resins which form a three-dimensional network such as polyurethane, a melamine resin, a phenol resin, an alkyde-melamine resin, an epoxy resin and the like. Also, fine powder pigments of metal oxide such as titanium oxide, silica, alumina, zirconium oxide, tin oxide, indium oxide and the like may also be added to the underlayer to prevent Moire patterns, and to reduce residual potential.

These underlayers can be formed using a suitable solvent and coating method as for the above-mentioned photoconductive layer. A silane coupling agent, titanium coupling agent or chromium coupling agent and the like can be used as the underlayer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ and the like prepared by the vacuum thin film-forming method, can be used for the underlayer of the present invention. Other materials known in the art may also be used. The thickness of the underlayer is in the range of 0 $\mu$m to 5 $\mu$m.

In the photoconductor of the present invention, an interlayer may also be provided between the underlayer and the photoconductive layer, or between the photoconductive layer and protective layer. Generally, a binder resin is used as the principal component of the interlayer. Examples of these resins are polyamide, alcohol-soluble nylon, water-soluble polyvinyl butyral, polyvinyl butyral, polyvinyl alcohol and the like. To form the interlayer, the usual coating methods can be used as described above. The thickness of the interlayer may be approximately 0.05 $\mu$m to 2 $\mu$m.

In the present invention, an antioxidant, plasticizer, lubricant, ultraviolet absorber, low molecular weight charge transport material and leveling agent can be added to at least one layer or to each of the charge-generating layer, charge transport layer, underlayer, protective layer and interlayer to improve environmental robustness, specifically, to prevent sensitivity decline and residual potential increase. Typical examples of these compounds are given below.

Examples of antioxidants which can be added to each layer are the following, although they are not limited to these examples:

(i—i) Phenol Compounds 2,6-di-t-butyl-p-cresol, butylated hydroxyanisole, 2 6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl) butylic acid]crecol ester, tocopherols, and the like.

(i-ii) Paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(i-iii) Hydroquinones 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone, and the like.

(i-iv) Organosulfur Compounds

Dilauryl-3,3'-thiodipropionate, distearyl-3,3'-thiodipropionate, ditetradecyl-3,3'-thiodipropionate., and the like (i-v) Organophosphorus Compounds Triphenylphosphine, tri(nonylphenyl)phosphine, tri(dinonylphenyl)phosphine, tricresylphosphine, tri(2,4-dibutylphenoxy)phosphine, and the like.

Examples of plasticizers which can be added to each layer are as the follow, although they are not limited these examples:

(ii-i) Phosphate Plasticizers

Triphenyl phosphate, tricresyl phosphate, trioctyl phosphate, octyldiphenyl phosphate, trichlorethyl phosphate, cresyldiphenyl phosphate, tributyl phosphate, tri-2-ethylhexyl phosphate, triphenyl phosphate, and the like.

(ii—ii) Phthalate Ester Plasticizers

Dimethyl phthalate, diethyl phthalate, diisobutyl phthalate, dibutyl phthalate, diheptyl phthalate, di-2-ethyl hexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate and the like.

(ii-iii) Aromatic Carboxylic Acid Ester Plasticizers

Trioctyl trimellitate, tri-n-octyl trimellitate, octyl oxybenzoate and the like.

(ii-iv) Aliphatic Dibasic Acid Ester Plasticizers

Dibutyl adipate, di-n-hexyl adipate, di-2-ethylhexyl adipate, di-n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(ii-v) Fatty Acid Ester Derivatives

Butyl oleate, glycerol monochrome oleate, acetyl methyl ricinoleate, pentaerythritol ester, dipentaerythritol hexaester, triacetin, tributylene, and the like.

(ii-vi) Oxyacid Ester Plasticizers

Acetyl methyl ricinoleate, acetyl butyl ricinoleate, butyl phthalyl butyl glycolate, acetyl tributyl citrate, and the like.

(ii-vii) Epoxy Plasticizers

Epoxidized soybean oil, epoxidized linseed oil, epoxy butyl stearate, epoxy decyl stearate, epoxy octyl stearate, epoxy benzyl stearate, epoxy dioctyl hexahydrophthalate, epoxy didecyl hexahydrophthalate, and the like.

(ii-viii) Dihydric Alcohol Ester Plasticizers

Diethylene glycol dibenzoate, triethylene glycol di-2-ethyl butyrate, and the like.

(ii-ix) Chlorine-Containing Plasticizers

Chlorinated paraffin, chlorinated diphenyl, chlorinated methyl fatty acid, methoxychlorinated methyl fatty acid and the like.

(ii-xi) Polyester Plasticizers

Polypropylene adipate, polypropylene sebacate, polyester, acetylated polyester, and the like.

(ii-xii) Sulfonic Acid Derivatives p-toluenesulfonamide, o-toluenesulfonamide, p-toluene sulfone ethylamide, o-toluene sulfone ethyl amide, toluene sulfone-N-ethylamide, p-toluene sulfone-N-cyclohexylamide, and the like.

(ii-xiii) Citric Acid Derivatives

Triethyl citrate, acetyl triethyl citrate, tributyl citrate, acetyl tributyl citrate, acetyl tri-2-ethylhexyl citrate, acetyl n-octyldecyl citrate, and the like.

(ii-xiv) Others

Terphenyl, partially hydrated terphenyl, camphor, 2-nitrodiphenyl, dinonylnaphthalene, methyl abietate, and the like.

Examples of lubricants which can be added to each layer are the following, they are not limited to these examples:

(iii-i) Hydrocarbon Compounds

Liquid paraffin, paraffin wax, micro wax, low molecular weight polyethylene, and the like.

(iii-ii) Fatty Acid Compounds

Lauric acid, myristic acid, palmitic acid, stearic acid, arachidic acid, behenic acid, and the like.

(iii—iii) Fatty Acid Amide Compounds

Stearyl amides, palmityl amides, olein amides, methylene bis-stearoamides, ethylene bis-stearoamides, and the like.

(iii-iv) Ester Compounds

Lower alcohol esters of fatty acids, polyhydric alcohol esters of fatty acids, polyglycol esters of fatty acids, and the like.

(iii-v) Alcohol Compounds

Cetyl alcohol, stearyl alcohol, ethylene glycol, polyethylene glycol, polyglycerol, and the like.

(iii-vi) Metal Soaps

Lead stearate, stearic acid cadmium, barium stearate, calcium stearate, zinc stearate, magnesium stearate, and the like.

(iii-vii) Natural Wax

Carnauva wax, candelilla wax, bees wax, spermaceti wax, ibota wax, montan wax, and the like.

(iii-viii) Other

Silicone compounds, fluorine compounds, and the like.

Examples of ultraviolet absorbers which can be added to each layer are the following, although they are not limited to these examples:

(iv-i) Benzophenones 2-hydroxybenzophenone, 2,4-dihydroxybenzophenone, 2,2',4-trihydroxybenzophenone, 2,2'4,4'-tetra hydroxybenzophenone, 2,2'-dihydroxy-4-methoxybenzophenone, and the like.

(iv-ii) Salicylates

Phenylsalicylate, 2,4-di-t-butylphenyl 3,5-di-t-butyl-4-hydroxybenzoate, and the like.

(iv-iii) Benzotriazoles (2'-hydroxyphenyl)benzotriazole, (2'-hydroxy-5'-methylphenyl)benzotriazole, (2'-hydroxy-5'-methylphenyl) benzotriazole, (2'-hydroxy-3'-tert-butyl-5'-methylphenyl)-5-chlorobenzotriazole, and the like.

(iv—iv) Cyanoacrylates

Ethyl-2-cyano-3,3-diphenylacrylate, methyl-2-carbomethoxy-3-(p-methoxy)acrylate, and the like.

(iv-v) Quenchers (Metal Complexes)

Nickel (2,2'-thiobis(4-t-octyl)phenolate)-n-butylamine, nickel dibutyl dithiocarbamate, nickel dibutyl dithiocarbamate, cobalt dicyclohexyldithiophosphate, and the like.

(iv-vi) HALS (Hindered Amines)

Bis-(2,2,6,6-tetramethyl-4-piperidyl) sebacate, bis-(1 2,2,6,6-pentamethyl-4-piperidyl) sebacate, 1-[2-[3-(3,5-di-t-butyl-4-hydroxyphenyl) propionyloxy]ethyl]-4-[3-(3,5-di-t-butyl-4-hydroxyphenyl) propionyloxy-]-2,2,6,6-tetramethylpyridine, 8-benzyl-7,7,9,9-tetramethyl-3-octyl-1,3,8-triazaspiro[4,5]undecane-2,4-dione, 4-benzoyl oxy-2,2,6,6-tetramethyl piperidine, and the like.

Next, the electrophotography process and electrophotographic apparatus of the present invention will be described in detail referring to the figures. It should be noted that the outermost layer (protective layer) of the electrophotographic photoconductor comprises the acryl-modified polyorganosiloxane compound, an acrylic resin and/or a methacrylic resin. The following figures and description are only for the purpose of describing the invention, which is not to be construed as being limited in any way thereby.

Figure 4:
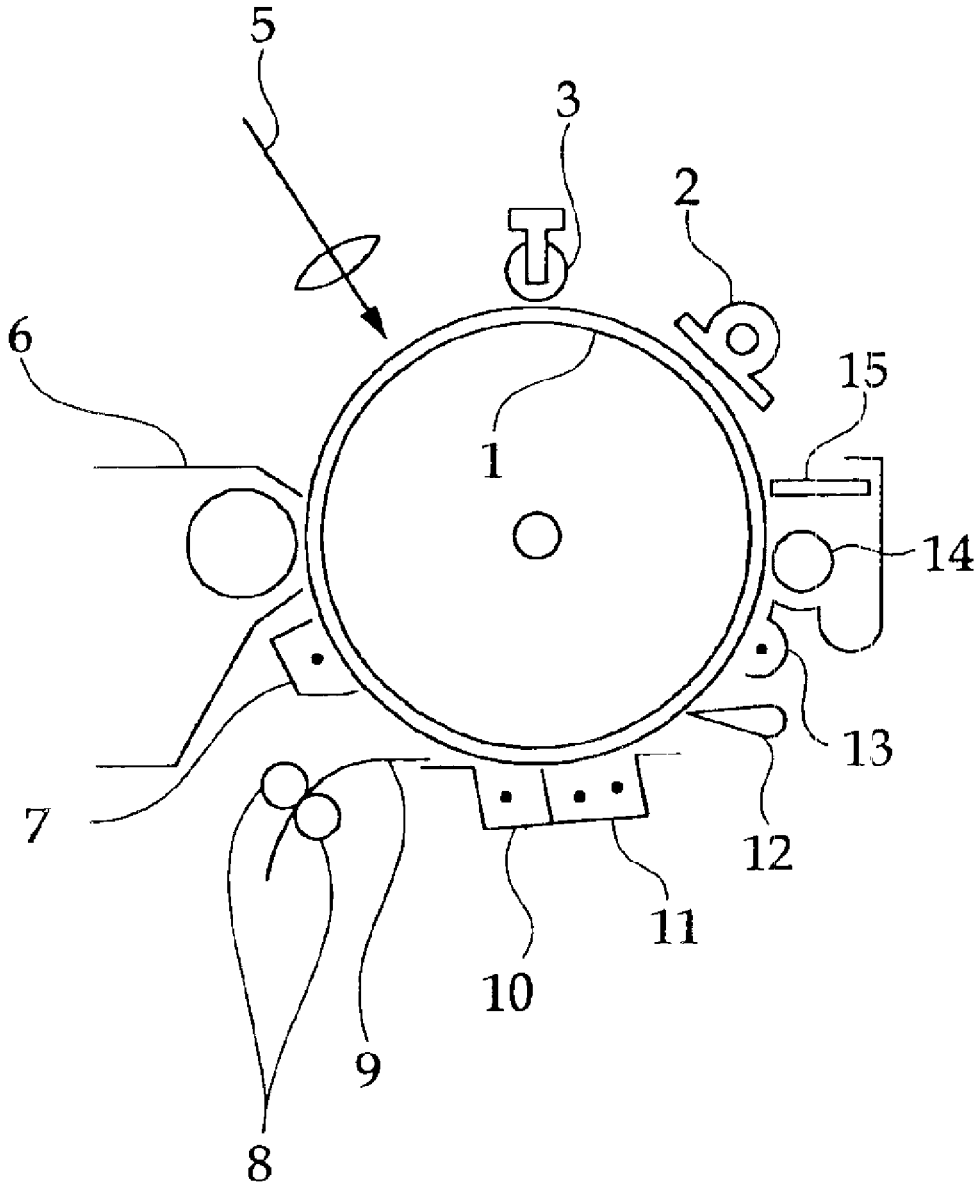
FIG. 4 is a schematic view describing an example of the process cartridge and electrophotographic apparatus of the present invention.

FIG. 4 is a diagram showing an example of the electrophotographic apparatus of the present invention. The photoconductor 1 utilizes the photoconductor of the present invention. Although the photoconductor 1 is shown with a drum-like form, it may be in the shape of a sheet or of an endless belt.

As the charger, both non-contact charge by a charger such as 7, 10, 11 and 13, and contact charge by a charge roller such as 3 or a charge brush, may be used.

Figure 5:
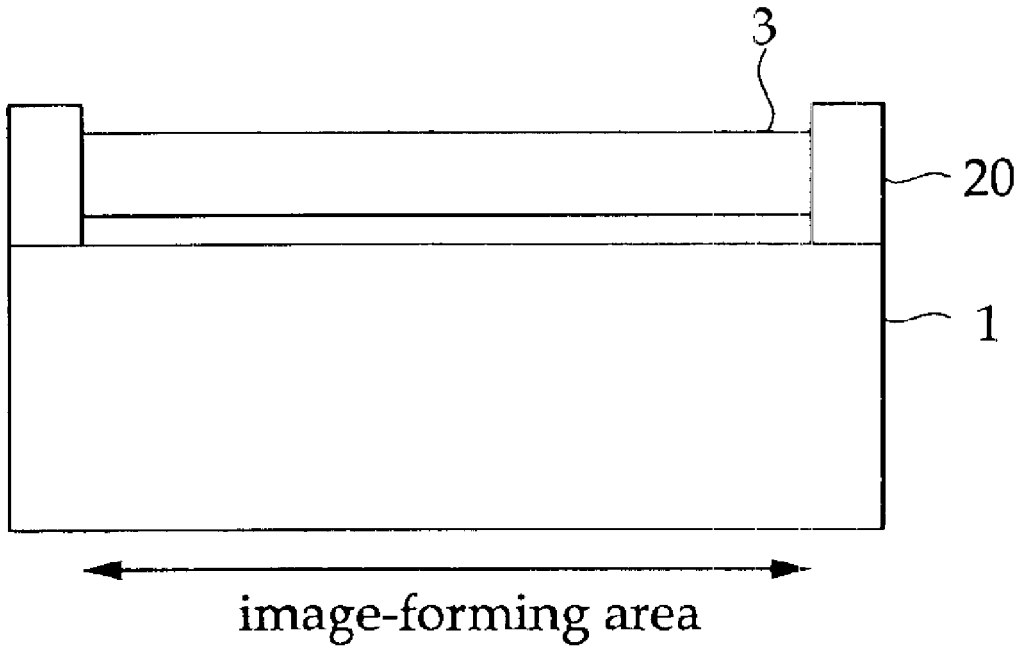
FIG. 5 is a schematic view describing an example of a charger relating to the present invention.

When using a charge roller, it is also possible to provide a gap between the photoconductor 1 and the charge roller 3, as shown in FIG. 5, and to arrange the photoconductor 1 and the charge roller 3 near to each other so that they are not in contact. In a photoconductor where the surface energy on the outermost layer (protective layer) of the photoconductor is reduced, as in the present invention, placing the charge roller and photoconductor in close proximity makes it possible to prevent soiling of the optical body surface, and may be effective in enhancing maintenance of the surface energy reduction effect. To place the charge member in close proximity to the photoconductor, a gap must be introduced in the non-image forming region of the photoconductor. In the present invention, provided that the photoconductor and charge member are disposed in close proximity, this may be achieved by any suitable method, for example by placing a gap member 20 in the charger or in the photoconductor, or in a flange part set at both ends of the photoconductor.

If a gap member is used, the gap member must have insulating properties, and materials having a high wear resistance are effective. The gap member may take any form such as a tape, seal or chip. The thickness of the gap is preferably 10 $\mu$m to 200 $\mu$m, more preferably 20 $\mu$m to 100 $\mu$m and still more preferably 40 $\mu$m to 80 $\mu$m. If the gap is smaller than this, contact between the charger and photoconductor increases, there is no advantage in placing them in proximity, and image deterioration increases. If the gap is larger than this, charge stability may decrease and the charge may not be uniform. It is then necessary to increase the applied voltage in order to maintain the required charge level, and as this leads to further increase in discharge products, this results in increasing image blurring. Also, the photoconductor can be charged by superimposing an alternating current component on the direct current component by the charger. By superimposing the alternating current component, non-uniformity of charge can be reduced, so image density fluctuations and loss of contrast can be suppressed.

Next, the light irradiator 5 is used to form a latent electrostatic image on the uniformly-charged photoconductor 1. The light source may be any luminous body such as a fluorescent lamp, a tungsten lamp, a halogen lamp, a mercury-vapor lamp, a sodium-vapor lamp, a light emitting diode (LED), a semiconductor laser (LD), an electroluminescence (EL) and the like. To irradiate only with light of a desired wavelength band, various filters, such as a sharp cut filter, a band pass filter, a near-infrared ray cut-off-filter, a dichroic filter, an interference filter, a color temperature conversion filter and the like can also be used.

Next, the image-developer 6 is used to render the latent electrostatic image formed on the photoconductor 1, visible. The developing method may be a one-component developing method or a two-component developing method using a dry toner, or a wet developing method using a wet toner. When a positive (negative) charge is given to the photoconductor and image exposure is performed, a positive (negative) electrostatic latent image will be formed on the photoconductor surface. If this is developed with a toner (charge detecting particles) of negative (positive) polarity, a positive image will be obtained, and a negative image will be obtained if the image is developed with a toner of positive (negative) polarity.

The image-developer in a full color electrophotographic apparatus has image-developers corresponding to at least four colors, of yellow, magenta, cyanogen and black. In one method, four color image-developers are brought into proximity with one photoconductor, in the revolving bar method, toner of four colors is filled in one image-developer and four colors are successively developed by rotating the image developer in four steps, and in the tandem method, four photoconductors are disposed relative to each of four image-developers filled with toner of four colors.

Figure 6:
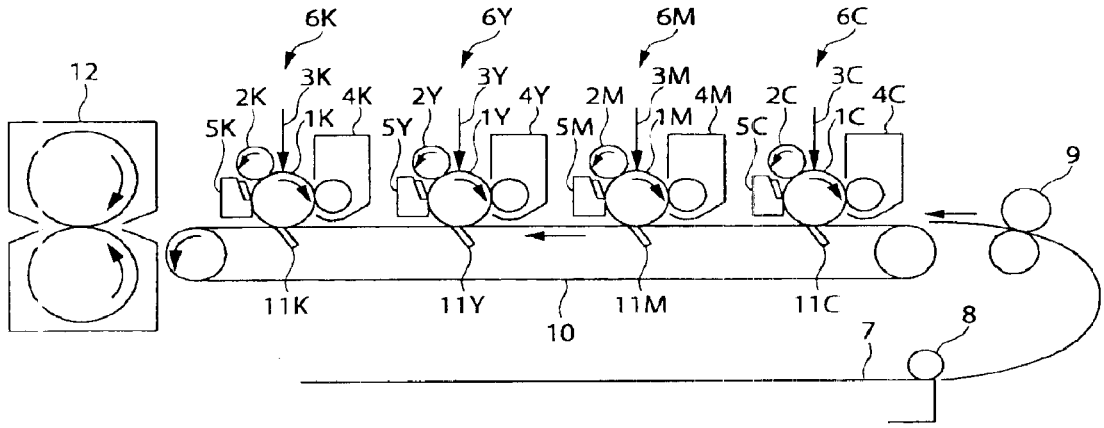
FIG. 6 is a schematic view describing an example of a tandem type electrophotographic apparatus relating to the present invention.

FIG. 6 is a diagram for describing an example of a tandem type electrophotographic apparatus according to the present invention.

In FIG. 6, symbols 1C, 1M, 1Y and 1K are drum-like photoconductors. These photoconductors 1C, 1M, 1Y and 1K rotate in the direction of the arrows in the figure, and at least, chargers 2C, 2M, 2Y and 2K, image-developers 4C, 4M, 4Y and 4K and cleaners 5C, 5M, 5Y and 5K are disposed around it. Laser light 3C, 3M, 3Y and 3K from a light irradiator is irradiated on the photoconductor surface between these chargers 2C, 2M, 2Y and 2K and image-developers 4C, 4M, 4Y and 4K, and a latent electrostatic image is formed on the photoconductors 1C, 1M, 1Y and 1K. Four image-forming units 6C, 6M, 6Y and 6K centered on the photoconductors 1C, 1M, 1Y and 1K are juxtaposed along a transport belt 10 which is a transfer to transfer a transfer medium. The transport belt 10 comes in contact with the photoconductors 1C, 1M, 1Y and 1K between the image-developers 4C, 4M, 4Y and 4K, and the cleaners 5C, 5M, 5Y and 5K, of the image-forming units 6C, 6M, 6Y and 6K. Further, transfer brushes 11C, 11M, 11Y and 11K for applying a transfer bias are arranged in the contact part of the photoconductor on the inner side of the transport belt 10.

In the full color electrophotographic apparatus shown in FIG. 6, the image-forming is performed as follows. First, in each of the image-forming units 6C, 6M, 6Y and 6K, the photoconductors 1C, 1M, 1Y and 1K are charged by the chargers 2C, 2M, 2Y and 2K which rotate in the direction of the arrows (direction of rotation around the photoconductors), and then latent electrostatic images corresponding to images of each color are formed by the laser light 3C, 3M, 3Y and 3K in the exposure parts. Next, the latent electrostatic images are developed by the image-developers 4C, 4M, 4Y and 4K, and then toner images are formed. The image-developers 4C, 4M, 4Y and 4K are developing members which develop using C (cyan), M (magenta), Y (yellow) and K (black) toner, respectively, and toner images of each color formed on the four photoconductors 1C, 1M, 1Y and 1K are superimposed on a transfer medium. A transfer medium 7 is sent out by a paper feeding roller 8 from a tray, stops momentarily at a pair of resist rollers 9, and is sent to the transport belt 10 at the correct timing for image-forming on the photoconductors. The transfer medium 7 retained on the transport belt 10 is transported, and color toner images are transferred at a contact point (transfer part) with each of the photoconductors 1C, 1M, 1Y and 1K. The toner image on the photoconductor is transferred to the transfer medium 7 by an electric field formed by a potential difference between the transfer bias applied by the transfer brushes 11C, 11M, 11Y and 11K and the photoconductors 1C, 1M, 1Y and 1K. The recording medium 7 which passed through the four transfer parts for superimposing toner images of four colors, is transported to a fixer 12 where the toner image is fixed, and delivered to a delivery unit (not shown). The toner remaining on the photoconductors 1C, 1M, 1Y and 1K without being transferred at the transfer part is recovered by the cleaners 5C, 5M, 5Y and 5K. In the example of FIG. 6, the image-forming units are arranged in a line from upstream to downstream in the transfer paper transport direction in the order C (cyan), M (magenta), Y (yellow) and K (black), but the present invention is not limited to this arrangement, and any color sequence may be set. If a document of only black color is to be prepared, it is particularly useful in the present invention to provide a mechanism wherein image-forming units other than black (6C, 6M, 6Y) are stopped.

Figure 7:
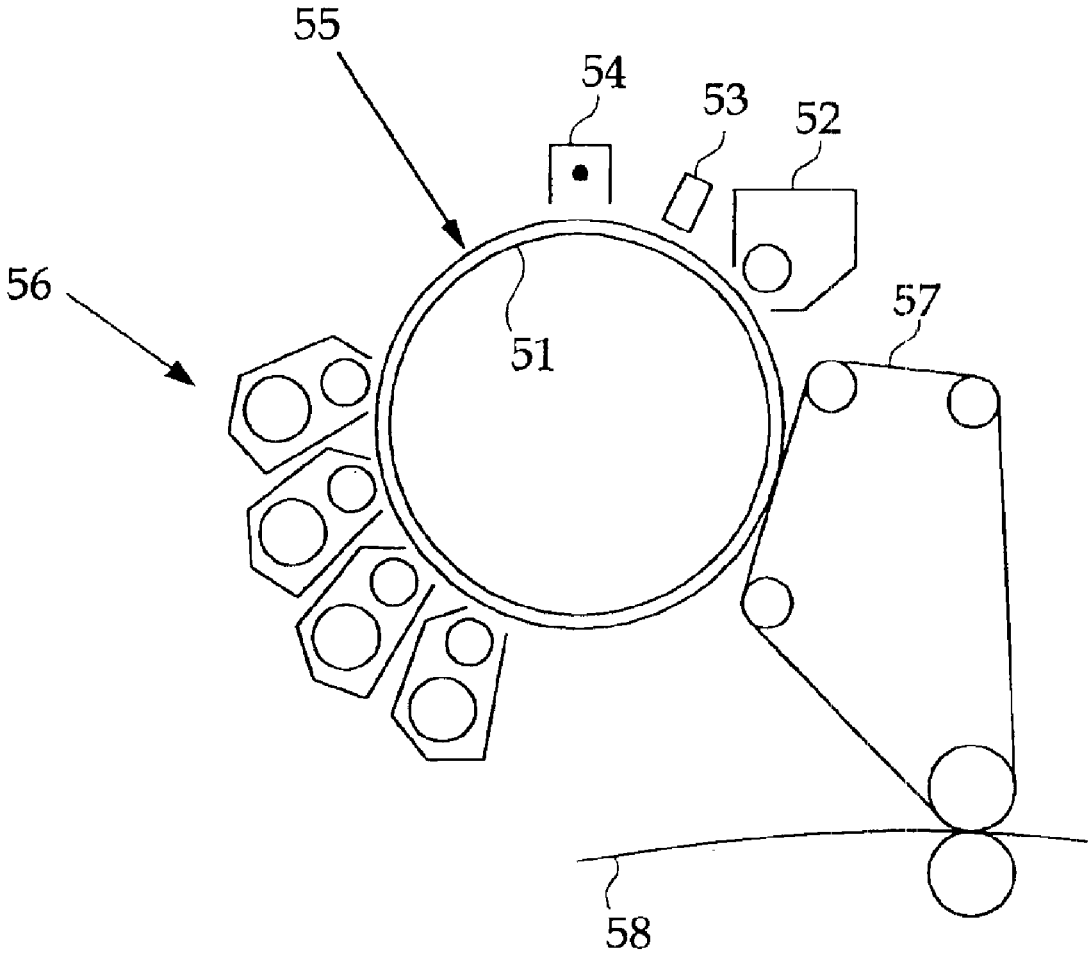
FIG. 7 is a schematic view describing an example of an electrophotographic apparatus comprising an intermediate transfer belt relating to the present invention.

Next, the toner image rendered visible on the photoconductor is transferred to paper or an intermediate transfer. FIG. 7 is a schematic view of an example of an electrophotographic apparatus in which an intermediate transfer belt 57 contacts the photoconductor 51 of the present invention, and the photoconductor 51 and a recording medium 58 do not come in direct contact. In FIG. 7, "52" is a cleaner, "53" is an antistatic lamp, "54" is a charger, "55" is light irradiating portion, and "56" is developing unit. The intermediate transfer may be drum-like, or it may have the shape of a sheet, or of an endless belt. The toner image formed on the intermediate transfer or intermediate transfer belt is immediately transferred to a transfer medium. The transfers may be any of those used in the art, for example, electrostatic transfer such a transfer charger or bias roller, mechanical transfer such as tack adhesion transfer or pressure transfer, and magnetic transfer. As the photoconductor 51 comes in contact with the intermediate transfer belt 57, and the photoconductor and the transfer medium 58 do not come into direct contact, soiling of the photoconductor surface is suppressed, which is more preferred for the purpose of the present invention. The adhesion of discharge products and toner external additives to the photoconductor surface tends to attract paper particles of the transfer medium, and this may promote filming, but as the photoconductor and the transfer medium such as paper are prevented from coming into direct contact by the intermediate transfer belt, this effect is largely suppressed. In particular, it may be said that, in photoconductors containing the acryl-modified polyorganosiloxane compound, soiling of the photoconductor surface is largely reduced by reducing the effect of paper particles, so the surface energy reduction effect is more stable, and higher image quality is obtained together with higher durability.

Figure 8:
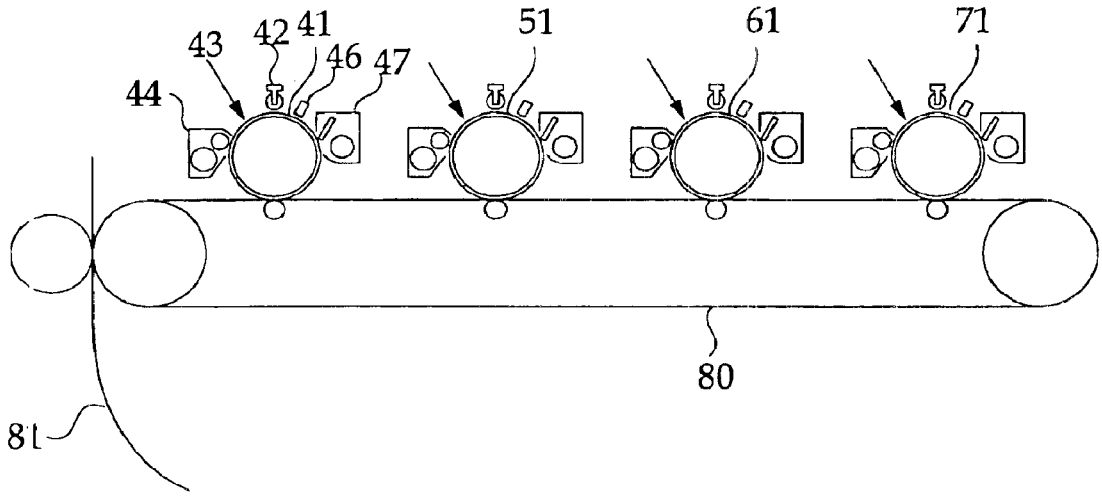
FIG. 8 is a schematic view describing an example of an electrophotographic apparatus comprising an intermediate transfer belt relating to the present invention.

FIG. 8 shows a schematic view of an example of an electrophotographic apparatus provided with a tandem system and an intermediate transfer belt, in which "42" is a charging roller, "43" is a light irradiating part, "44" is developing unit, "45" is a cleaner and "46" is an antistatic lamp. In this tandem type electrophotographic apparatus, toner images formed on the photoconductors 41, 51, 61 and 71 are first transferred to an intermediate transfer belt 80 (intermediate transfer), and then transferred to a transfer medium 81 (paper). In this way, the photoconductors 41, 51, 61 and 71 do not come into direct contact with the paper 81, which has an extremely high effect on improving durability and image quality. In particular, a the tandem electrophotographic apparatus, time-dependent deterioration variations between photoconductors must be reduced as far as possible. If there is a large difference between photoconductors regarding not only the wear on the photoconductor surface but also soiling of the photoconductor surface, since one image is formed from four photoconductors, it will inevitably lead to image deterioration, for example, a decline of color reproducibility and resolution. This is because the photoconductors remain in contact with the paper until at least four colors have been transferred, and because, although the toner usage amount is different depending on the color being printed, the photoconductors are always in contact with the paper regardless of the toner usage amount. For example, if only black is to be printed, a mechanism might be conceived wherein the three photoconductors other than black do not come in contact with the paper, however in practice there is not much demand to print only one color, so there is generally a large effect due to paper particles. Due to this, in a tandem electrophotographic apparatus, the toner image on the photoconductor is first transferred to an intermediate transfer body or intermediate transfer belt and the photoconductor does not come into direct contact with the paper. This is highly effective to improve the durability of the photoconductor, suppress image blurring and filming, and improve color reproducibility and resolution. Also, it permits further continuity enhancement of the surface energy reduction effect obtained by making the photoconductor surface contain the acryl-modified polyorganosiloxane compound, which gives even better stabilization of the image. In particular, if the acryl-modified polyorganosiloxane compound of the present invention is contained in the photoconductor surface, adhesion of paper particles and the resultant filming are suppressed, and the continuance of this effect is largely improved, which is highly desirable.

Next, in order to clean the toner left behind on the photoconductor after transfer, a fur brush or a cleaning blade may be used, or these may be used together. In order to clean more efficiently, a pre-cleaning charger may be used. Other cleaners are a web type and a magnetic brush type. Any of these means can being used alone, or plural methods can be used in conjunction.

Next, a charge elimination means is used in order to remove the latent electrostatic image on the photoconductor if necessary. The charge elimination members may be a discharge lamp or a discharge charger, for which the above-mentioned exposure light source and charge members can be used, respectively.

In addition, all other processes known in the art which do not come in proximity with the photoconductor, such as document reading, paper feed, fixing and paper delivery, can be used.

The electrophotography process illustrated above in the drawings is only an example of one embodiment of the present invention, and other embodiments are of course possible. For example, the optical irradiation steps shown were an image exposure, pre-cleaning exposure and discharge exposure, but the photoconductors may be irradiated for example by a pre-transfer exposure, pre-image exposure and other irradiation steps known in the art.

Figure 9:
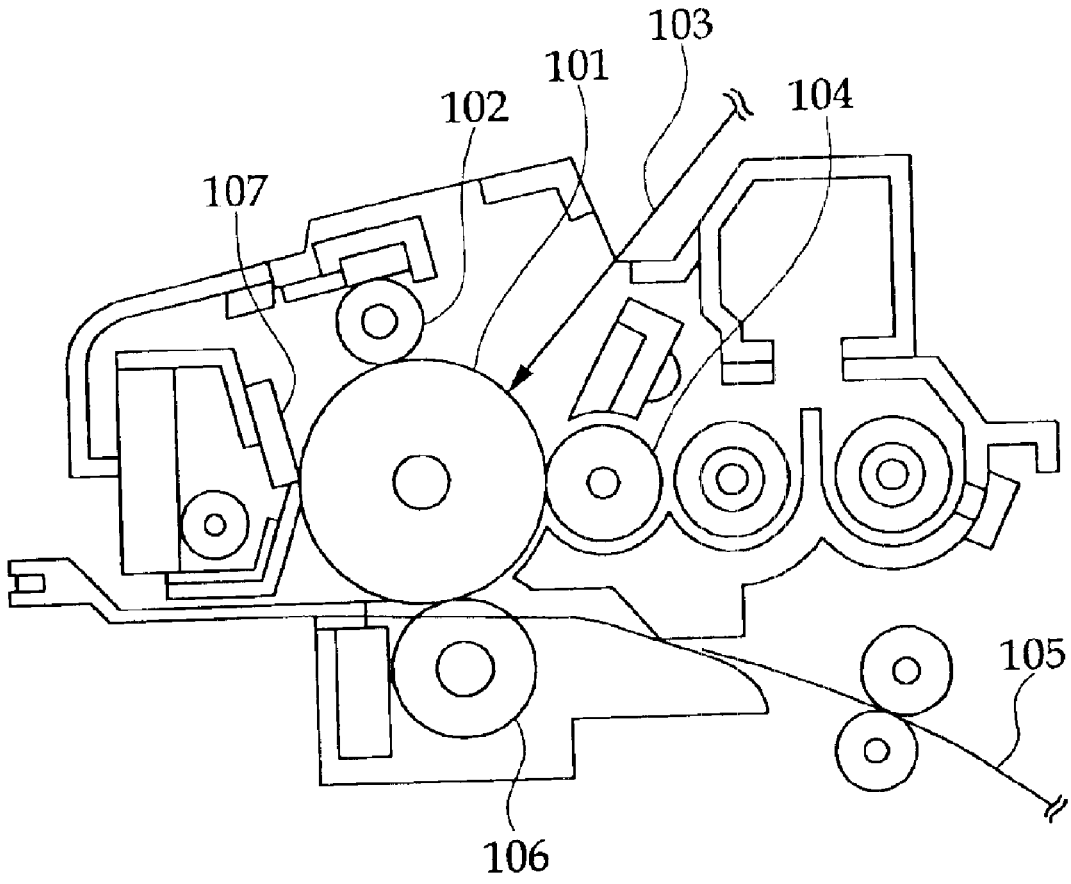
FIG. 9 is a schematic view showing an example of the process cartridge according to the present invention.

These image-forming units may be incorporated into copying devices, fax machines and printers, or they may be built into these devices in the form of a process cartridge which can be freely attached or removed. FIG. 9 is a schematic view of an example of an electrophotography process cartridge. In the figure, the outermost layer (protective layer) of a photoconductive drum 101 of the present invention contains at least the acryl-modified polyorganosiloxane compound and an acrylic resin and/or a methacrylic resin. The process cartridge is a part which has a built-in photoconductor together with at least one of a charger, an image-developer, a transfer, a cleaner and a discharger, and it can be freely attached to or removed from the electrophotographic apparatus. The present invention includes all electrophotographic apparatuses wherein the photoconductor is built into the process cartridge which can be freely attached to or removed from the electrophotographic apparatus body, and the process cartridge is built into a tandem electrophotographic apparatus, electrophotographic apparatuses wherein the photoconductor built into the process cartridge does not come into direct contact with paper in the transfer step, electrophotographic apparatuses combining these types, and these process cartridges.

The present invention will now be described by means of specific examples, but the invention is not to be construed as being limited in any way thereby. In the examples, all parts are weight parts.

EXAMPLE 1

An underlayer of approximately 3.5 μm, a charge-generating layer of approximately 0.2 μm and a charge transport layer of approximately 20 μm were formed by impregnation coating method, in which an underlayer coating solution, a charge-generating layer coating solution and a charge transport layer coating solution having the following compositions, were sequentially applied on an aluminium drum of diameter 30 mm. A protective layer of approximately 5.0 μm was then formed by spray coating method, in which a protective layer coating solution was prepared as described below, and heated in an oven at 150° C. for 30 minutes so as to manufacture a photoconductor 1.

[Underlayer Coating Solution]

| | |
|---|---|
| Alkyde resin (Bekozole 1307-60-EL, DAINIPPON INK AND CHEMICALS, INCORPORATED) | 6 parts |
| Melamine resin (Super Bekamine G-821-60, DAINIPPON INK AND CHEMICALS, INCORPORATED) | 4 parts |
| Titanium oxide | 40 parts |
| Methyl ethyl ketone | 50 parts |

[Charge-generating layer coating solution]

| | |
|---|---|
| Bis-azo pigment expressed by Formula (i) | 2.5 parts |

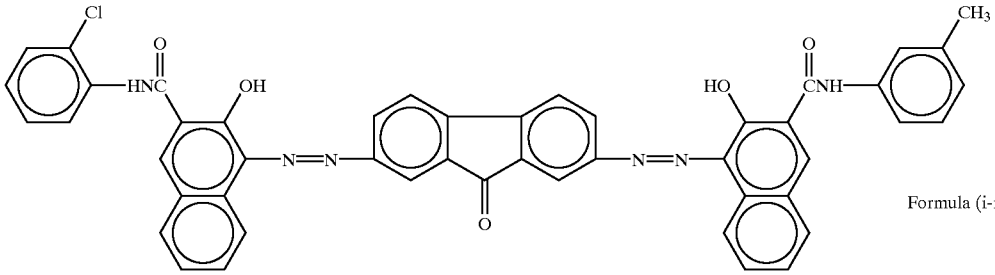

Formula (i-i)

| | |
|---|---|
| Polyvinyl butyral (Butvaw B-90, Monsanto Company) | 0.5 parts |
| Cyclohexanone | 200 parts |
| Methyl ethyl ketone | 80 parts |

[Charge transport layer coating solution]

| | |
|---|---|
| Acryl-modified polyorganosiloxane compound (CHALINE R-170S, Nissin Chemical Industry Co., Ltd.) | 2 parts |
| Bisphenol Z polycarbonate (Panlite TS-2050, Teijin Chemicals, Ltd.) | 1 part |
| Low molecular weight charge transport material expressed by Formula (i-ii) | 7 parts |

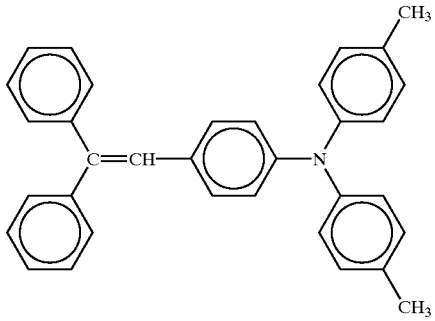

Formula (i-ii)

| | |
|---|---|
| Tetrahydrofuran | 100 parts |
| 1% silicone oil (KF50-100CS, Shin-Etsu Chemical Co, Ltd.) | 1 part |
| Tetrahydrofuran solution | |

[Protective Layer Coating Solution]

4 parts of acryl-modified polyorganosiloxane (CHALINE R-170S, an acryl-modified polyorganosiloxane compound comprising 70% polyorganosiloxane component and 30% of acrylic component, Nissin Chemical Industry Co., Ltd.), 10 parts of styrene-MMA (methyl methacrylate)-2-HEMA (hydroxyethyl methacrylate) copolymer, 20 parts of tin oxide particles (average particle diameter approx. 0.1 $\mu$m, Mitsubishi Materials Corporation), 50 parts of cellosolve acetate and 30 parts of methyl isobutyl ketone were mixed and dispersed by a ball mill for 120 hours. 100 parts of a mixed solution of hexamethylene diisocyanate-trimethylolpropane adduct (Sumiju HT, Sumitomo Bayer), cellosolve acetate and methyl ethyl ketone, was added, and stirred to give a coating solution.

EXAMPLE 2

A photoconductor 2 was manufactured in the same way as in Example 1, except that the protective layer coating solution of Example 1 was changed to the following protective layer coating solution.

[Protective Layer Coating Solution]

6 parts of acryl-modified polyorganosiloxane (CHALINE R-170S, Nissin Chemical Industry Co., Ltd.), 15 parts of styrene-MMA (methyl methacrylate)-2-HEMA (hydroxyethyl methacrylate) copolymer (20% by weight 2-ethoxyethyl acetate/methylisobutyl ketone solution), 3 parts of a polymer having a charge transport function, expressed by Formula (ii), 30 parts of cellosolve acetate and 10 parts of methyl isobutyl ketone were mixed and dispersed by a ball mill for 120 hours. 40 parts of a mixed solution of hexamethylene diisocyanate-trimethylolpropane adduct, acetone and ethyl acetate, was then added, and stirred to prepare a coating solution.

Formula (ii)

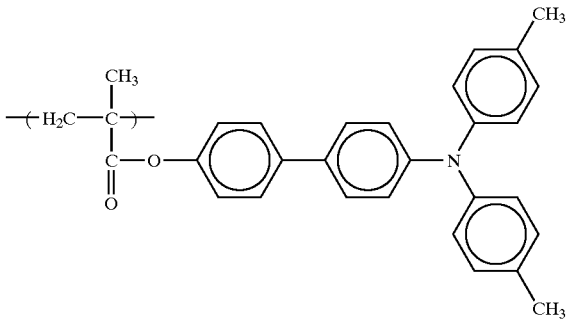

EXAMPLE 3

A photoconductor 3 was manufactured in the same way as in Example 1, except that the protective layer coating solution of Example 1 was changed to the following protective layer coating solution.

[Protective Layer Coating Solution]

3 parts of acryl-modified polyorganosiloxane (CHALINE R-170S, Nissin Chemical Industry Co., Ltd.), 15 parts of MMA (methyl methacrylate)-BMA (butyl methacrylate)-HEMA (hydroxyethyl methacrylate) copolymer (50% by weight toluene/butyl acetate solution), 2 parts of α-alumina (Sumi Corundum AA-03, average first-order particle diameter: 0.3 μm, Sumitomo Chemical Industries), 0.05 parts of a polycarbonate compound (BYK-P104, 50% by weight xylene solution, BYK-Chemie Japan K.K.) and 20 parts of cyclohexanone were mixed and dispersed by a ball mill for 50 hours. A mixed solution of 5 parts benzoguanamine resin (80% by weight butyl cellosolve solution), 0.05 parts of an aromatic sulfonic acid (40% by weight isopropyl alcohol solution), 7 parts of a low molecular weight charge transport material expressed by Formula (iii), 350 parts of tetrahydrofuran and 50 of parts cyclohexanone was then added, and stirred to prepare a coating solution.

Formula (iii)

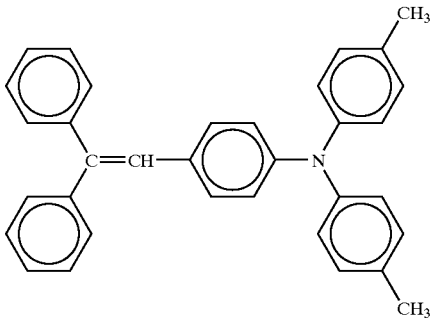

EXAMPLE 4

A photoconductor 4 was manufactured in the same way as in Example 1, except that the protective layer coating solution of Example 1 was changed to the following protective layer coating solution.

[Protective Layer Coating Solution]

2 parts of acryl-modified polyorganosiloxane (CHALINE R-170, an acryl-modified polyorganosiloxane compound comprising 10% polyorganosiloxane component and 90% of acrylic component, Nissin Chemical Industry Co., Ltd.), 15 parts of MMA (methyl methacrylate)-BMA (butyl methacrylate)-2-HEMA (hydroxyethyl methacrylate) copolymer (50% by weight toluene/butyl acetate solution), 4 parts of silica (KMPX-100, average first-order particle diameter approx. 0.1 μm, Shin-Etsu Chemical, Co., Ltd.) and 30 parts of cyclohexanone were mixed and dispersed by a ball mill for 50 hours. A mixed solution of 5 parts of melamine resin, 0.05 parts of aromatic sulfonic acid (40% by weight isopropyl alcohol solution), 7 parts of a low molecular weight charge transport material expressed by Formula (iv), 350 parts tetrahydrofuran and 80 parts cyclohexanone was then added, and stirred to prepare a coating solution.

Formula (iv)

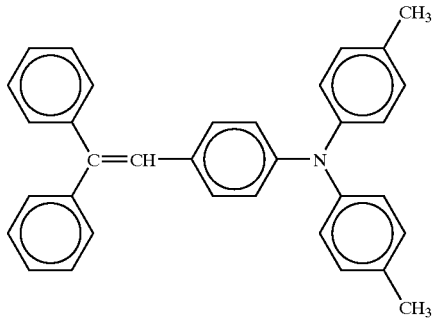

EXAMPLE 5

A photoconductor 5 was manufactured in the same way as in Example 1, except that the protective layer coating solution of Example 1 was changed to the following protective layer coating solution.

[Protective Layer Coating Solution]

2 parts of acryl-modified polyorganosiloxane (CHALINE R-170S, Nissin Chemical Industry Co., Ltd.), 3 parts of α-alumina (Sumi Corundum AA-03, average first-order particle diameter: 0.3 μm, Sumitomo Chemical Industries), 0.07 parts of a polycarbonate compound (BYK-P104, 50% by weight xylene solution, BYK-Chemie Japan K.K.) and 10 parts of cyclohexanone were mixed and dispersed by a ball mill for 24 hours. A mixed solution of 10 parts styrene-MMA (methyl methacrylate)-BMA (butyl methacrylate) random copolymer, 8 parts of a low molecular weight charge transport material expressed by Formula (v), 420 parts of tetrahydrofuran and 110 parts of cyclohexanone was then added, and stirred to prepare a coating solution.

Formula (v)

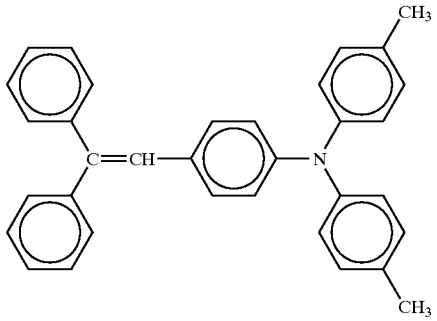

Formula (vi)

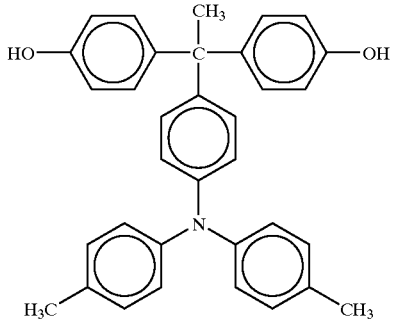

EXAMPLE 6

A photoconductor 6 was manufactured in the same way as in Example 1, except that the protective layer coating solution of Example 1 was changed to the following protective layer coating solution.

[Protective Layer Coating Solution]

2 parts of acryl-modified polyorganosiloxane (CHALINE R-170S, Nissin Chemical Industry Co., Ltd.), 1 part of α-alumina (Sumi Corundum AA-03, average first-order particle diameter: 0.3 μm, Sumitomo Chemical Industries), 0.08 parts of a polycarbonate compound (BYK-P104, 50% by weight xylene solution, BYK-Chemie Japan K.K.), 10 parts of MMA (methyl methacrylate)-HEMA (hydroxyethyl methacrylate) copolymer and 30 parts of cyclohexanone were mixed and dispersed by a ball mill for 24 hours. A mixed solution of 4 parts of a low molecular weight charge transport material expressed by Formula (vi), 5 parts of benzoguanamine resin, 0.05 parts of an aromatic sulfonic acid (40% by weight isopropyl alcohol solution), 400 parts of tetrahydrofuran and 50 parts of cyclohexanone was then added, and stirred to prepare a coating solution.

EXAMPLE 7

A photoconductor 7 was manufactured in the same way as in Example 1, except that the protective layer coating solution of Example 1 was changed to the following protective layer coating solution.

[Protective Layer Coating Solution]

3 parts of acryl-modified polyorganosiloxane (CHALINE R-170S, Nissin Chemical Industry Co., Ltd.), 3 parts of α-alumina (Sumi Corundum AA-03, average first-order particle diameter: 0.3 μm, Sumitomo Chemical Industries), 0.06 parts of a polycarbonate compound (BYK-P104, 50% by weight xylene solution, BYK-Chemie Japan K.K.), 10 parts of MMA (methyl methacrylate)-BMA(butyl methacrylate)-HEMA (hydroxyethyl methacrylate) random copolymer and 30 parts of toluene were mixed and dispersed by a ball mill for 24 hours. A mixed solution of 4 parts of benzoguanamine resin, 7 parts of a low molecular weight charge transport material expressed by Formula (vii-i) below, 0.15 parts of an antioxidant expressed by Formula (vii-ii) below (Sanol LS-2626, Sankyo Co. Ltd.), 500 parts of tetrahydrofuran and 120 parts of cyclohexanone was then added, and stirred to prepare a coating solution.

Formula (vii-i)

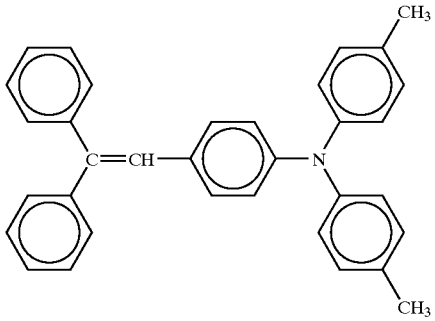

Formula (vii-ii)

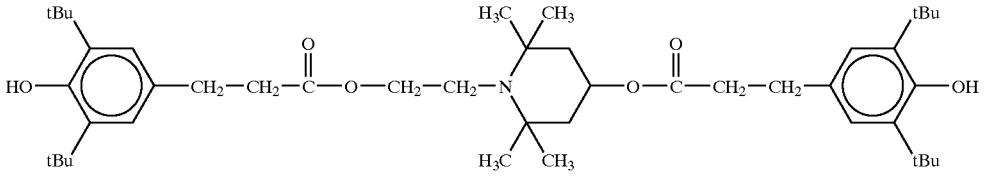

EXAMPLE 8

A photoconductor 8 was manufactured in the same way as in Example 1, except that the protective layer coating solution of Example 1 was changed to the following protective layer coating solution.

[Protective Layer Coating Solution]

2 parts of acryl-modified polyorganosiloxane (CHALINE R-170S, Nissin Chemical Industry Co., Ltd.), 7 parts of MMA (methyl methacrylate)-BMA(butyl methacrylate)-HEMA (hydroxyethyl methacrylate) copolymer, 3 parts of titanate-coupled a alumina (Sumi Corundum AA-03, average first-order particle diameter: 0.3 μm, Sumitomo Chemical Industries), 0.10 parts of a polycarbonate compound (BYK-P104, 50% by weight xylene solution, BYK-Chemie Japan K.K.) and 30 parts of cyclohexanone were mixed and dispersed by a ball mill for 24 hours. A mixed solution of 3 parts of bisphenol-Z-polycarbonate (Panlite TS-2050, Teijin Chemicals Ltd.), 7 parts of a low molecular weight charge transport material expressed by Formula (viii), 400 parts tetrahydrofuran and 100 parts cyclohexanone was then added, and stirred to prepare a coating solution.

Formula (viii)

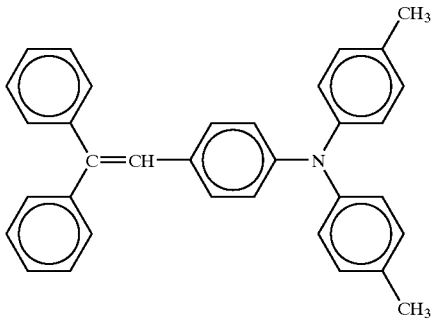

EXAMPLE 9

A photoconductor 9 was manufactured in the same way as in Example 1, except that the protective layer coating solution of Example 1 was changed to the following protective layer coating solution.

[Protective Layer Coating Solution]

2 parts of acryl-modified polyorganosiloxane (CHALINE R-170S, Nissin Chemical Industry Co., Ltd.), 3 parts of α-alumina (Sumi Corundum AA-03, average first-order particle diameter: 0.3 μm, Sumitomo Chemical Industries), 0.12 parts of a polycarbonate compound (BYK-P104, 50% by weight xylene solution, BYK-Chemie Japan K.K.) and 30 parts of cyclohexanone were mixed and dispersed by a ball mill for 24 hours. A mixed solution of 6 parts of MMA (methyl methacrylate)-BMA(butyl methacrylate)-HEMA (hydroxyethyl methacrylate) random copolymer, 4 parts of a low molecular weight charge transport material expressed by Formula (ix), 400 parts tetrahydrofuran and 100 parts cyclohexanone was then added, and stirred to prepare a coating solution.

Formula (ix)

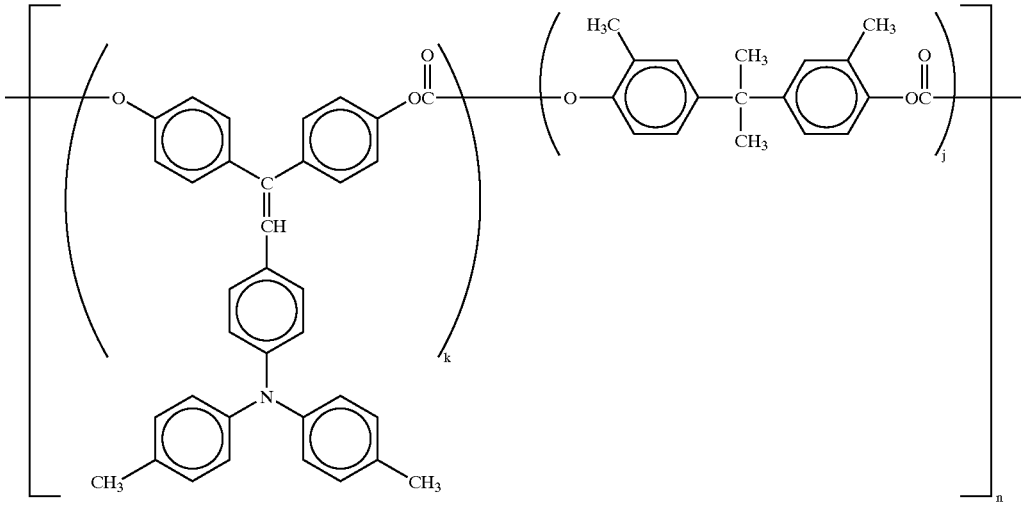

EXAMPLE 10

A photoconductor 10 was manufactured in the same way as in Example 1, except that the protective layer coating solution of Example 1 was changed to the following protective layer coating solution.

The dispersion of the acryl-modified polyorganosiloxane compound in the surface protective layer of this photoconductor at a maximum particle diameter of approximately 0.4 μm was verified by TEM observation of a cross-section.

[Protective Layer Coating Solution]

2 parts of acryl-modified polyorganosiloxane (CHALINE R-170S, Nissin Chemical Industry Co., Ltd.), 8 parts of styrene-MMA (methyl methacrylate) copolymer, 4 parts of a low molecular weight charge transport material expressed by Formula (x) and 30 parts of tetrahydrofuran were mixed, and dispersed by a shaker for 2 hours. A mixed solution of hexamethylene diisocyanate-trimethylolpropane adduct (80% by weight ethyl acetate solution), tetrahydrofuran and cyclohexanone was then added, and stirred to prepare a coating solution.

Formula (x)

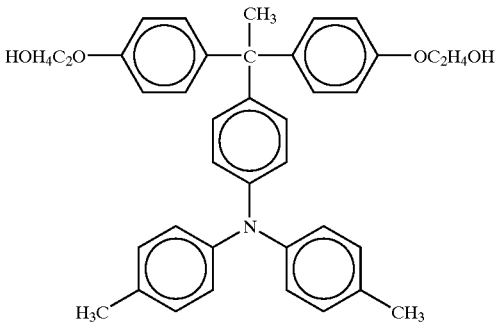

EXAMPLE 11

An underlayer of approximately 3.5 μm, a charge-generating layer of approximately 0.2 μm and a charge transport layer of approximately 17 μm were formed by impregnation coating method, in which an underlayer coating solution, charge-generating layer coating solution and charge transport layer coating solution having the following compositions, were applied on an aluminium drum of diameter 30 mm. A protective layer of approximately 5.0 μm was then formed by ring coating method, in which a protective layer coating solution prepared as described below was applied so as to manufacture a photoconductor 11.

[Underlayer Coating Solution]

Figure 10:
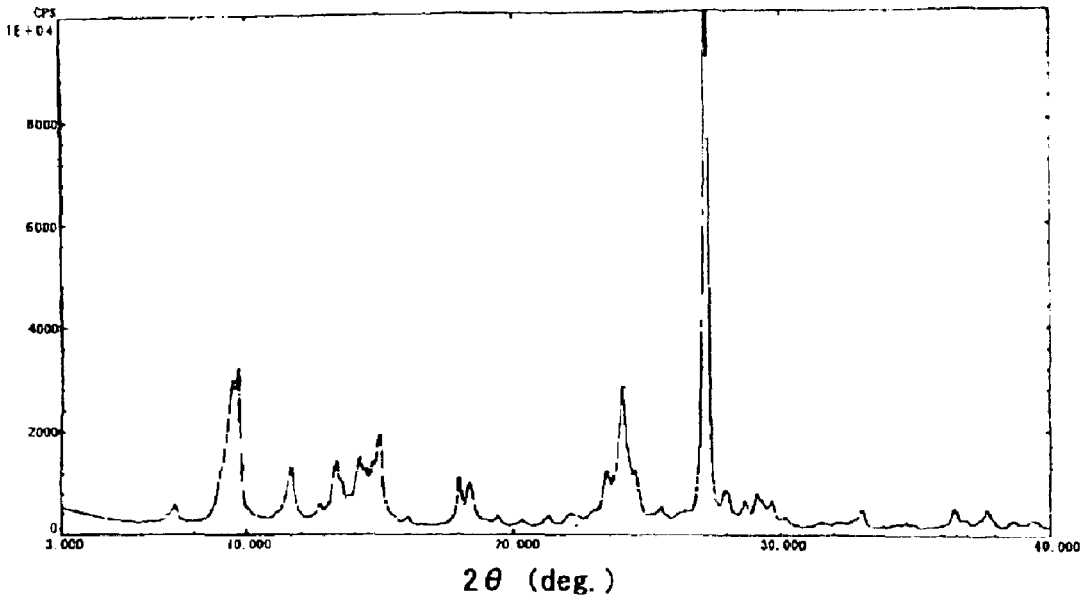
FIG. 10 is a drawing showing a XD spectrum of oxytitanium phthalocyanine.

| | |
|---|---|
| Alkyde resin (Bekozole 1307-60-EL, DAINIPPON INK AND CHEMICALS, INCORPORATED) | 6 parts |
| Melamine resin (Super Bekamine G-821-60, DAINIPPON INK AND CHEMICALS, INCORPORATED) | 4 parts |
| Titanium oxide | 40 parts |
| Methyl ethyl ketone | 50 parts |
| [Charge-generating layer coating solution] | |
| Titanyl phthalocyanin having an XD spectrum shown in FIG. 10 | 8 parts |
| Polyvinyl butyral (Esrec BM-S, Sekisui Chemical Industries) | 0.5 parts |
| Methyl ethyl ketone | 400 parts |
| [Charge transport layer coating solution] | |
| Bisphenol Z polycarbonate (Panlite TS-2050, Teijin Chemicals Ltd.) | 10 parts |
| Low molecular weight charge transport material expressed by Formula (xi-i) | 7 parts |

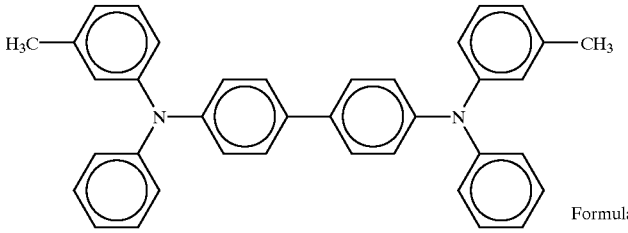

Formula (xi-i)

| | |
|---|---|
| Tetrahydrofuran | 100 parts |
| 1% silicone oil (KF50-100CS, Shin-Etsu Chemical Co., Ltd.) Tetrahydrofuran solution | 1 part |
| [Protective layer coating solution] | |

5 parts of acryl-modified polyorganosiloxane (CHALINE R-170S, Nissin Chemical Industry Co., Ltd.), 15 parts of MMA (methyl methacrylate)-BMA(butyl methacrylate)-2-HEMA (hydroxyethyl methacrylate) random copolymer (50% by weight toluene/butyl acetate solution), 2 parts of α-alumina (Sumi Corundum AA-03, average first-order particle diameter: 0.3 μm, Sumitomo Chemical Industries), 0.05 parts of a polycarbonate compound (BYK-P104, 50% by weight xylene solution, BYK-Chemie Japan K.K.) and 70 parts of cyclohexanone were mixed and dispersed by a ball mill for 50 hours. A mixed solution of 5 parts of melamine resin, 0.05 parts of an aromatic sulfonic acid (40% by weight isopropyl alcohol solution), 8 parts of a low molecular weight charge transport material expressed by Formula (xi-ii), 350 parts of tetrahydrofuran and 50 parts of cyclohexanone was then added, and stirred to prepare a coating solution.

Formula (xi-ii)

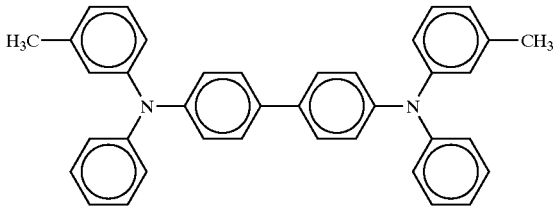

COMPARATIVE EXAMPLE 1

A photoconductor 12 was manufactured in the same way as in Example 1, except that the protective layer coating solution of Example 1 was changed to the following protective layer coating solution.

[Protective Layer Coating Solution]

2 parts of α-alumina (Sumi Corundum AA-03, average first-order particle diameter: 0.3 μm, Sumitomo Chemical Industries), 0.08 parts of a polycarbonate compound (BYK-P104, 50% by weight xylene solution, BYK-Chemie Japan K.K.) and 20 parts of cyclohexanone were mixed and dispersed by a ball mill for 24 hours. A mixed solution of 10 parts of bisphenol Z polycarbonate (Panlite TS-2050, Teijin Chemicals Ltd.), 7 parts of a low molecular weight charge transport material expressed by Formula (xii), tetrahydrofuran and cyclohexanone was then added to prepare a dispersion solution.

Formula (xii)

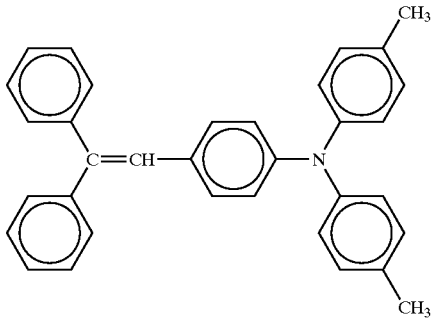

COMPARATIVE EXAMPLE 2

A photoconductor 13 was manufactured in the same way as in Example 1, except that the protective layer coating solution of Example 1 was changed to the following protective layer coating solution.

[Protective Layer Coating Solution]

10 parts of styrene-MMA (methyl methacrylate)-2-HEMA (hydroxyethyl methacrylate) random copolymer, 30 parts of fine tin oxide particles (average first-order particle diameter: approx. 0.1 um, Mitsubishi Materials Corporation), 40 parts of cellosolve acetate and 20 parts of methyl isobutyl ketone were mixed and dispersed by a ball mill for 120 hours. 5 parts of hexamethylene diisocyanate-trimethylolpropane adduct (Sumiju HT, Sumitomo Bayer), 2 parts of styrene-MMA-2-HEMA random copolymer, 30 parts of cellosolve acetate and 70 parts of methyl ethyl ketone were then added to this dispersion solution, and stirred.

COMPARATIVE EXAMPLE 3

A photoconductor 14 was manufactured in the same way as in Example 1, except that the protective layer coating solution of Example 1 was changed to the following protective layer coating solution.

[Protective Layer Coating Solution]

2 parts of α-alumina (Sumi Corundum AA-03, average first-order particle diameter: 0.3 μm, Sumitomo Chemical Industries), 0.05 parts of a polycarbonate compound (BYK-P104, 50% by weight xylene solution, BYK-Chemie Japan K.K.), 15 parts of MMA (methyl methacrylate)-BMA(butyl methacrylate)-2-HEMA (hydroxyethyl methacrylate) copolymer (50% by weight toluene/butyl acetate solution) and 30 parts of cyclohexanone were mixed and dispersed by a ball mill for 48 hours. A mixed solution of 5 parts of benzoguanamine resin (80% by weight butyl cellosolve solution), 0.05 parts of aromatic sulfonic acid (40% by weight isopropyl alcohol solution), 8 parts of a low molecular weight charge transport material expressed by Formula (xiv), tetrahydrofuran and cyclohexanone was then added to prepare a coating solution.

Formula (xiv)

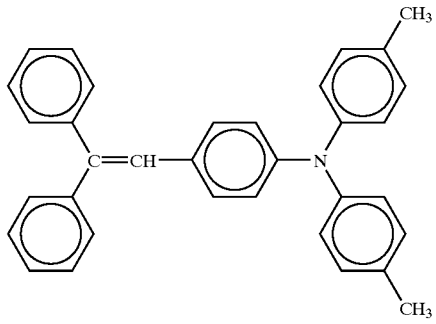

COMPARATIVE EXAMPLE 4

A photoconductor 15 was manufactured in the same way as in Example 1, except that the protective layer coating solution of Example 1 was changed to the following protective layer coating solution.

The dispersion of the acryl-modified polyorganosiloxane compound in the protective layer of this electrophotographic photoconductor at a maximum particle diameter of approximately 3.0 μm was verified by TEM observation of a cross-section.

[Protective Layer Coating Solution]

2 parts of acryl-modified polyorganosiloxane (CHALINE R-170S, Nissin Chemical Industry Co., Ltd.), 10 parts of bisphenol-Z-polycarbonate (Panlite TS-2050, Teijin Chemicals Ltd.) and 30 parts of toluene were mixed, by using a three-roll mill, then a mixed solution of 7 parts of a low molecular weight charge transport material expressed by Formula (xv), 160 parts of tetrahydrofuran and 50 parts of cyclohexanone was then added to prepare a coating solution.

Formula (xv)

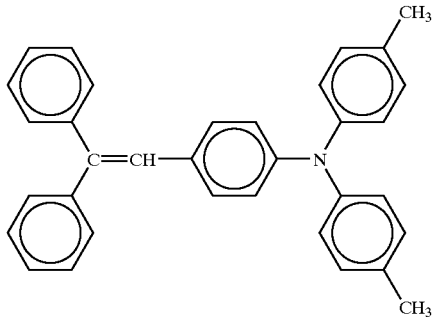

COMPARATIVE EXAMPLE 5

A photoconductor 16 was manufactured in the same way as in Example 1, except that the protective layer coating solution of Example 1 was changed to the following protective layer coating solution.

[Protective Layer Coating Solution]

5 parts of acryl-modified polyorganosiloxane (CHALINE R-170S, Nissin Chemical Industry Co., Ltd.), 3 parts of α-alumina (Sumi Corundum AA-03, average first-order particle diameter: 0.3 μm, Sumitomo Chemical Industries), 0.06 parts of a polycarbonate compound (BYK-P104, approx.

50% solids, BYK-Chemie Japan K.K.) and 40 parts cyclohexanone were mixed and dispersed by a ball mill for 50 hours. A mixed solution of 10 parts of bisphenol-Z-polycarbonate (Panlite TS-2050, Teijin Chemicals Ltd.), 7 parts of a low molecular weight charge transport material expressed by Formula (xvi-i), 0.15 parts of an antioxidant expressed by Formula (xvi-ii) (Sanol LS-2626, Sankyo Co., Ltd.), tetrahydrofuran and cyclohexanone was then added to prepare a coating solution.

Formula (xvi-i)

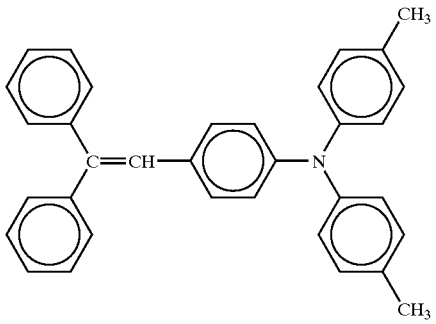

Formula (xvi-ii)

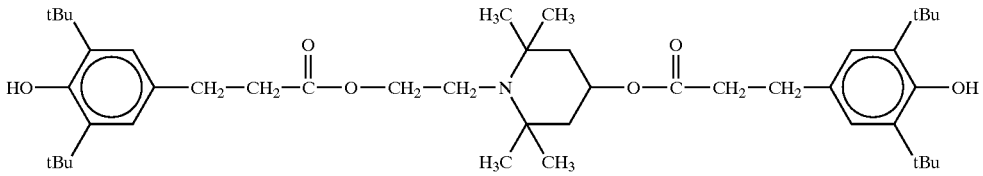

COMPARATIVE EXAMPLE 6

A photoconductor 17 was manufactured in the same way as in Example 1, except that the protective layer coating solution of Example 1 was changed to the following protective layer coating solution.

[Protective Layer Coating Solution]

4 parts of spherical silicone fine particles (Tospar 105, Toshiba Silicones), 15 parts of MMA (methyl methacrylate)-BMA(butyl methacrylate)-2-HEMA (hydroxyethyl methacrylate) random copolymer (50% by weight toluene/butyl acetate solution), 2 parts of α-alumina (Sumi Corundum AA-03, average first-order particle diameter: 0.3 μm, Sumitomo Chemical Industries), 0.05 parts of a polycarbonate compound (BYK-P104, approx. 50% solids, BYK Chemicals) and 70 parts of cyclohexanone were mixed and dispersed by a ball mill for 50 hours. A mixed solution of 5 parts benzoguanamine resin (80% by weight butyl cellosolve solution), 0.05 parts of aromatic sulfonic acid (40% by weight isopropyl alcohol solution), 8 parts of the low molecular weight charge transport material used in Example 1, 350 parts of tetrahydrofuran and 50 parts of cyclohexanone was added, and stirred so as to prepare a coating solution.

The surface roughness (ten point height average roughness Rz) and water contact angle were measured for the electrophotographic photoconductors 1 to 17 produced as described above. Next, using a modified machine incorporating a 655 nmLD unit in a Ricoh imagioMF2200, a durability test of 500 sheets was performed, and the surface roughness (Rz) and water contact angle were measured again. The photoconductors were, moreover, fitted in a modified Ricoh full color printer Ipsio8000, continuous full color printing of 50,000 sheets was performed, and image quality was evaluated after the first stage and after printing 50,000 sheets. The abrasion loss was evaluated from the thickness difference at the early stage and after printing 50,000 sheets. A charge roller was used as the charger, a Teflon (registered trademark) tape of 50 μm thickness was wound around and fixed to both ends (non-image forming region) of the charge roller, and the charger was brought into proximity with the photoconductor. AC(1 kHz, 1.8 kV (peak to peak))+DC (−750V) was applied to the charge roller. These results are shown in Table 1. The image quality was classified according to the symbols shown below.

◎: image quality does not deteriorate, good level

○: image quality deterioration is observed, but its level is not a problem

Δ: image quality deterioration is observable

X: image quality deterioration severe, difficult to distinguish image

TABLE 1

| Example Comp. Ex. | Photoconduct or No. | Rz (μm) Initial | Water contact angle (°) Initial | Water contact angle (°) After durability test | Image evaluation Initial | | Image evaluation After durability test | | wear resistance (μm) |
|---|---|---|---|---|---|---|---|---|---|
| Example 1 | 1 | 0.57 | 108 | 92 | ○ | decrease in resolution | ○ | decrease in resolution | 0.1 |
| Example 2 | 2 | 0.6 | 109 | 96 | ◎ | good | ◎ | good | 2.2 |
| Example 3 | 3 | 0.62 | 109 | 94 | ◎ | good | ◎ | good | 0.7 |

TABLE 1-continued

| Example Comp. Ex. | Photoconduct or No. | Rz (μm) Initial | Water contact angle (°) Initial | After durability test | Image evaluation Initial | | After durability test | | wear resistance (μm) |
|---|---|---|---|---|---|---|---|---|---|
| Example 4 | 4 | 0.65 | 107 | 81 | ⊙ | good | ○ | decrease in resolution | 1.1 |
| Example 5 | 5 | 1.32 | 107 | 97 | ○ | decrease in image density | ⊙ | good | 2.8 |
| Example 6 | 6 | 0.71 | 108 | 95 | ⊙ | good | ⊙ | good | 0.5 |
| Example 7 | 7 | 0.74 | 108 | 94 | ⊙ | good | ⊙ | good | 0.6 |
| Example 8 | 8 | 1.41 | 107 | 93 | ○ | decrease in image density | ⊙ | good | 1.1 |
| Example 9 | 9 | 1.37 | 107 | 94 | ○ | decrease in image density | ⊙ | good | 0.9 |
| Example 10 | 10 | 0.57 | 109 | 95 | ⊙ | good | ⊙ | good | 2.1 |
| Example 11 | 11 | 0.88 | 109 | 101 | ⊙ | good | ⊙ | good | 0.7 |
| Comp. Ex. 1 | 12 | 0.55 | 95 | 73 | ⊙ | good | x | image blurring | 0.9 |
| Comp. Ex. 2 | 13 | 0.57 | 92 | 71 | ○ | decrease in resolution | x | image blurring | 0.1 |
| Comp. Ex. 3 | 14 | 0.58 | 93 | 72 | ⊙ | good | x | image blurring | 0.7 |
| Comp. Ex. 4 | 15 | 2.2 | 108 | 94 | Δ | decrease in image density | Δ | decrease in color reproducibility | 4.1 |
| Comp. Ex. 5 | 16 | 2.56 | 110 | 102 | x | decrease in image density | x | decrease in resolution, decrease in gradation | 0.6 |
| Comp. Ex. 6 | 17 | 2.82 | 95 | 75 | Δ | decrease in image density | x | image blurring | 1.2 |

In Example 2, metal oxide particles were not added, so abrasion loss was increased. Wear resistance is further improved by addition of metal oxide particles. In Example 4, as the siloxane content of the acryl-modified polyorganosiloxane (R-210) used was as low as 10%, the water contact angle of after the durability test was largely fluctuated. By increasing the siloxane content, the reduction in surface energy can be lessened. In Example 5, only styrene-MMA-BMA copolymer was present and a cross linking agent was not included, so there was a tendency to increased surface roughness. To further improve dispersibility and improve surface flatness and smoothness, crosslinking components such as HEMA must be included. Example 6 was a case where the charge transport material was also crosslinked, and its wear resistance was improved. Example 9 was a case where a polymer charge transport material was included, and there was a wear resistance improvement effect. Comparative Example 6 contained spherical silicone particles and resulted in markedly high surface roughness, therefore, image density falls, and resolution falls due to decrease of water contact angle after the durability test.

From Table 1, if the photoconductor comprised a protective layer containing an acryl-modified polyorganosiloxane compound and an acrylic resin or a methacrylic resin, not only was the surface energy reduction effect high, but its stability improved. Further, by considerably improving the surface flatness and smoothness of the photoconductor, not only was image deterioration suppressed, but an electrophotographic apparatus which can stably output a high definition image was obtained. On the other hand, it was evident that if the acryl-modified polyorganosiloxane compound of the invention was not added and another particulate lubricant was added, the continuity of the surface energy reduction effect declined, whereas if the composition did not contain the acrylic resin or the methacrylic resin, even if it did contain the acryl-modified polyorganosiloxane compound of the invention, surface flatness and smoothness fell and led to image deterioration from the start. Hence, the present invention makes it possible to obtain an electrophotographic apparatus which realizes high wear resistance, stable image quality and high durability.

By arranging the protective layer formed in the outermost layer of the photoconductor to contain the acryl-modified polyorganosiloxane compound according to the present invention, and contain an acrylic resin and/or a methacrylic resin, the following effects could be obtained.

(1) By incorporating the acryl-modified polyorganosiloxane compound, an acrylic resin and/or a methacrylic resin, compatibility with the binder resin and the organic solvent of the acryl-modified polyorganosiloxane compound is largely improved. As dispersibility improves, the optical transmittance of the photoconductor improves, surface flatness/smoothness improves, and surface energy reduction is stabilized. Due to these effects, high image quality is realized, adhesion of foreign matter to the photoconductor surface is reduced, image defects are suppressed, and image quality is stabilized in the long term.

(2) As the acryl-modified polyorganosiloxane compound has a siloxane as the main chain, and an acrylic polymer is graft copolymerized therewith, compatibility with the binder resin or organic solvent is further enhanced, and the efficacy of dispersion stabilization is increased. As the siloxane content in the main chain can easily be increased, release properties can be improved while maintaining dispersibility.

(3) When the acryl-modified polyorganosiloxane compound is produced by emulsion polymerization, ultrafine particles can be formed. Normally, although aggregation increases and it is difficult to maintain the ultrafine particle state in the layer, in the present invention, an acrylic resin and/or a methacrylic resin is included which permits uniform dispersion in a layer in the ultrafine particle state. Local variations of the surface energy reduction effect on the photoconductor surface decrease, and a remarkable improvement of stabilization is thereby achieved. Due to the uniform dispersion of the ultrafine particles, the flatness/smoothness of the layer surface improves, the effect on light scattering nature is mitigated, high image quality is obtained and is further stabilized.

(4) The acryl-modified polyorganosiloxane compound reduces the adverse effect of residual potential rise, and also of suppressing residual potential rise over time. It is thus possible to increase the addition amount, and this gives a margin to the surface energy reduction effect. Even if a relatively large amount is added, there is little adverse effect on wear resistance or optical transmittance.

(5) In the present invention, it is also possible to cure the acrylic resin and/or the methacrylic resin, and it was discovered that the dispersibility of the acryl-modified polyorganosiloxane compound is thereby further improved. This not only enhances the surface energy reduction effect and stabilizes it, but also allows wear resistance to be obtained at the same time.

(6) In the present invention, by including a charge transport material, residual potential is reduced and sensitivity deterioration is suppressed. The charge transport material can also be crosslinked with the acrylic resin and/or the methacrylic resin, which imparts wear resistance and stabilizes electrostatic characteristics while improving the stability of image quality.

(7) In the present invention, by including metal oxide particles in the protective layer, the surface energy reduction effect is maintained, and a remarkable improvement of wear resistance is realized. Hence, wear resistance is improved and image quality is stabilized, while the durability of the photoconductor is enhanced. As the acryl-modified polyorganosiloxane compound is dispersed in an ultrafine particle state in the present invention, there is little adverse effect even if metal oxide particles with a relatively large particle size are also present, and the function of each is not compromised.

(8) In the present invention, by including a carboxylic acid compound in the protective layer, the dispersibility of both the metal oxide particles and the acryl-modified polyorganosiloxane compound is enhanced. Further, even if the residual potential should increase due to the addition of some kind of metal oxide particles, by including the carboxylic acid compound, a large reduction of residual potential is attained and the rise of residual potential with time can be suppressed.

(9) Although the present invention can be applied to an electrophotographic apparatus having any type of construction, by using an electrophotographic apparatus provided with an intermediate transfer or intermediate transfer belt wherein the photoconductor and a transfer medium such as paper do not come into direct contact in the transfer process, a further improvement in the durability of the surface energy reduction effect in the photoconductor can be achieved, and image stabilization is improved.

(10) By the use of the present invention, even in a tandem type full color printer, image blurring and image defects are suppressed by decreasing the foreign matter adhesion which occurs over time, and by suppressing time-dependent variations of deterioration in the four photoconductors, high speed and high image quality are realized.

In the present invention, the surface energy reduction effect and its continuity can be considerably enhanced without any adverse effect on light scattering, residual potential, surface flatness/smoothness and layer quality in the protective layer, so image defects due to addition of foreign matter is suppressed, and wear resistance is improved while at the same time image quality is stabilized. Further, transfer efficiency is increased, cleaning properties are enhanced, filming is suppressed, image defects such as character dropout is suppressed, wear resistance is improved and uneven wear is suppressed. The electrophotographic apparatus of the present invention not only suppresses image defects such as image blurring without the need for a dehumidifier such as a drum heater or a lubrication apparatus, and gives higher durability and image stability, but is also effective for achieving greater compactness and reducing power consumption.

What is claimed is:

1. An electrophotographic photoconductor comprising:

an electroconductive support;

a photoconductive layer on the electroconductive support, which formed of at least one layer; and a protective layer on the photoconductive layer, which is an outermost layer of the electrophotographic photoconductor, wherein the protective layer contains a resin mixture comprising (a) at least one member selected from the group consisting of acrylic resins and methacrylic resins, and (b) a resin composition comprising an acryl-modified polyorganosiloxane compound.

2. An electrophotographic photoconductor according to claim 1, wherein the resin composition comprising an acryl-modified polyorganosiloxane compound is dispersed in at least one of the acrylic resin and the methacrylic resin.

3. An electrophotographic photoconductor according to claim 1, wherein the resin composition comprising an acryl-modified polyorganosiloxane compound is compatible with at least one of the acrylic resin and the methacrylic resin.

4. An electrophotographic photoconductor according to claim 1, wherein the acryl-modified polyorganosiloxane compound is a graft copolymer of an acrylic polymer, and siloxane as a principal chain.

5. An electrophotographic photoconductor comprising:

an electroconductive support;

a photoconductive layer on the electroconductive support, which is formed of at least one layer; and a protective layer on the photoconductive layer, which is an outermost layer of the electrophotographic photoconductor, wherein the protective layer contains a resin mixture comprising (a) at least one member selected from the group consisting of acrylic resins and methacrylic resins, and (b) a resin composition comprising an acryl-modified polyorganosiloxane compound, wherein the acryl-modified polyorganosiloxane compound is formed by emulsion graft copolymerization of (A) a polyorganosiloxane expressed by Formula 1:

Formula 1

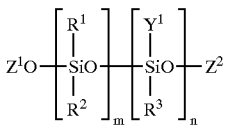

wherein, each of "R1", "R2" and "R3" is one of a hydrocarbon group and halogenated hydrocarbon group having 1 to 20 carbon atoms, and may be identical or different, "Y1" is one of a radical reactive group, an SH group and an organic group containing both, each of "Z1" and "Z2" is respectively one of a hydrogen atom, a lower alkyl group and a group expressed by the following formula, and may be identical or different:

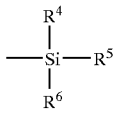

(each of "R4" and "R5" is respectively one of a hydrocarbon group and a alogenated hydrocarbon group having 1 to 20 carbon atoms, and may be identical or different and "R6" is one of a hydrocarbon group, a halogenated hydrocarbon group, a radical reactive group, an SH group and an organic group containing both), "m" is a positive integer of 10,000 or less, and "n" is an integer of one or more, and (B) one of a (meth)acrylic ester expressed by Formula 2:

Formula 2

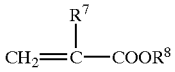

(wherein, "R7" in Formula 2 is one of a hydrogen atom and a methyl group, and "R8" is one of an alkyl group, alkoxy-substituted alkyl group, cycloalkyl group and an aryl group), and a mixture of 70% by weight or more of the (meth) acrylic ester with 30% by weight or less of a copolymerizable monomer, in a weight ratio of from 5:95 to 95:5.

6. An electrophotographic photoconductor according to claim 5, wherein a content of (A) the polyorganosiloxane expressed by Formula 1, is larger in weight than a content of (B) one of the (meth)acrylic ester expressed by Formula 2, and the mixture of 70% by weight or more of the (meth) acrylic ester with 30% by weight or less of the copolymerizable monomer.

7. An electrophotographic photoconductor according to claim 1, wherein at least one of the acrylic resin and the methacrylic resin, is at least one of a acrylic resin formed by copolymerization of one or more of curing acrylic monomers and curing acrylic oligomers, and a methacrylic resin formed by copolymerization of one or more of curing methacrylic monomers and curing methacrylic oligomers.

8. An electrophotographic photoconductor according to claim 7, wherein one or more of the curing methacrylic monomers and the curing methacrylic oligomers is hydroxyethylmethacrylate.

9. An electrophotographic photoconductor according to claim 5, wherein the monomer is one of polyfunctional monomer and ethylenic unsaturated monomer.

10. An electrophotographic photoconductor according to claim 1, wherein a content of the acryl-modified polyorganosiloxane compound relative to total solids in the protective layer is 1% by weight to 40% by weight.

11. An electrophotographic photoconductor according to claim 1, wherein a content of the acryl-modified polyorganosiloxane compound relative to total solids in the protective layer is 5% by weight to 20% by weight.

12. An electrophotographic photoconductor according to claim 5, wherein the protective layer further comprises a cross linking agent.

13. An electrophotographic photoconductor according to claim 5, wherein the protective layer further comprises a carboxylic acid compound.

14. An electrophotographic photoconductor according to claim 1, wherein the protective layer further comprises a charge transport material.

15. An electrophotographic photoconductor according to claim 14, wherein the charge transport material is contained by polymerizing with at least one of the acrylic resin formed by copolymerization of one or more curing acrylic monomers and oligomers, and the methacrylic resin formed by copolymerization of one or more curing methacrylic monomers and oligomers.

16. An electrophotographic photoconductor according to claim 1, wherein the protective layer further comprises metal oxide particles.

17. An electrophotographic photoconductor according to claim 16, wherein an average first-order particle diameter of the metal oxide particles is 0.01 $\mu$m to 0.9 $\mu$m.

18. An electrophotographic photoconductor according to claim 1, wherein the protective layer further comprises a cross linking agent.

19. An electrophotographic photoconductor according to claim 1, wherein the protective layer further comprises a carboxylic acid compound.

20. An electrophotographic photoconductor according to claim 1, wherein the photoconductive layer comprises at least one of a charge-generating layer and a charge transport layer.

21. An electrophotographic apparatus comprising:

an electrophotographic photoconductor;

a charger configured to uniformly charge the electrophotographic photoconductor;

a light irradiator configured to irradiate a light to the electrophotographic photoconductor after charging, so as to form a latent electrostatic image;

an image-developer configure to develop the latent electrostatic image so as to form a toner image; and a transfer configured to transfer the toner image to a recording medium, wherein the electrophotographic photoconductor comprises:

an electroconductive support;

a photoconductive layer on the electroconductive support, which is formed of at least one layer; and a protective layer on the photoconductive layer, which is an outermost layer of the electrophotographic photoconductor, in which the protective layer contains a resin mixture comprising (a) at least one member selected from the group consisting of acrylic resins and methacrylic resins, and (b) a resin composition comprising an acryl-modified polyorganosiloxane compound.

22. An electrophotographic apparatus according to claim 21, wherein the resin composition comprising an acryl-modified polyorganosiloxane compound is dispersed at least one of the acrylic resin and the methacrylic resin.

23. An electrophotographic apparatus according to claim 21, wherein the resin composition comprising acryl-modified polyorganosiloxane compound is compatible with at least one of the acrylic resin and the methacrylic resin.

24. A process cartridge comprising:

an electrophotographic photoconductor; and an image-developer configured to develop a latent electrostatic image on the electrophotographic photoconductor, wherein the process cartridge is freely detachable from and attachable to an electrophotographic apparatus, and the electrophotographic photoconductor comprises:

an electroconductive support;

a photoconductive layer on the electroconductive support, which is formed of at least one layer; and a protective layer on the photoconductive layer, which is an outermost layer of the electrophotographic photoconductor, in which the protective layer contains a resin mixture comprising (a) at least one member selected from the group consisting of acrylic resins and methacrylic resins, and (b) a resin composition comprising an acryl-modified polyorganosiloxane compound.

25. A process cartridge according to claim 24, wherein the resin composition comprising an acryl-modified polyorganosiloxane compound is dispersed at least one of the acrylic resin and the methacrylic resin.

26. A process cartridge according to claim 24, wherein the resin composition comprising acryl-modified polyorganosiloxane compound is compatible with at least one of the acrylic resin and the methacrylic resin.

27. An electrophotographic photoconductor according to claim 5, wherein the protective layer further comprises a charge transport material.

28. An electrophotographic photoconductor according to claim 5, wherein the resin composition comprising an acryl-modified polyorganosiloxane compound is dispersed in at least one of the acrylic resin and the methacrylic resin.

29. An electrophotographic photoconductor according to claim 5, wherein the resin composition comprising an acryl-modified polyorganosiloxane compound is compatible with at least one of the acrylic resin and the methacrylic resin.

30. An electrophotographic photoconductor according to claim 5, wherein at least one of the acrylic resin and the methacrylic resin, is at least one of a acrylic resin formed by copolymerization of one or more of curing acrylic monomers and curing acrylic oligomers, and a methacrylic resin formed by copolymerization of one or more of curing methacrylic monomers and curing methacrylic oligomers.

31. An electrophotographic photoconductor according to claim 30, wherein one or more of the curing methacrylic monomers and the curing methacrylic oligomers is hydroxyethylmethacrylate.

32. An electrophotographic photoconductor according to claim 5, wherein a content of the acryl-modified polyorganosiloxane compound relative to total solids in the protective layer is 1% by weight to 40% by weight.

33. An electrophotographic photoconductor according to claim 5, wherein a content of the acryl-modified polyorganosiloxane compound relative to total solids in the protective layer is 5% by weight to 20% by weight.

34. An electrophotographic photoconductor according to claim 5, wherein glass transition temperature of the (meth) acrylic ester expressed by Formula 2, and the mixture of 70% by weight or more of the (meth)acrylic ester with 30% by weight or less of the copolymerizable monomer, is 20° C. or more.

35. An electrophotographic photoconductor according to claim 27, wherein the charge transport material is contained by polymerizing with at least one of the acrylic resin formed by copolymerization of one or more curing acrylic monomers and oligomers, and the methacrylic resin formed by copolymerization of one or more curing methacrylic monomers and oligomers.

36. An electrophotographic photoconductor according to claim 5, wherein the protective layer further comprises metal oxide particles.

37. An electrophotographic photo conductor according to claim 36, wherein an average first-order particle diameter of the metal oxide particles is 0.01 μm to 0.9 μm.

38. An electrophotographic photoconductor comprising:

an electroconductive support;

a photoconductive layer on the electroconductive support, which is formed of at least one layer; and a protective layer on the photoconductive layer, which is an outermost layer of the electrophotographic photoconductor, wherein the protective layer contains a resin mixture comprising (a) at least one member selected from the group consisting of acrylic resins and methacrylic resins, and (b) a resin composition comprising an acryl-modified polyorganosiloxane compound, wherein the acryl-modified polyorganosiloxane compound is dispersed in the resin composition in the fine particle-form having a particle diameter of 1.0 μm or less.

39. An electrophotographic photoconductor according to claim 38, wherein the resin composition comprising an acryl-modified polyorganosiloxane compound is dispersed in at least one of the acrylic resin and the methacrylic resin.

40. An electrophotographic photoconductor according to claim 38, wherein the resin composition comprising an acryl-modified polyorganosiloxane compound is compatible with at least one of the acrylic resin and the methacrylic resin.

41. An electrophotographic photoconductor according to claim 38, wherein the acryl-modified polyorganosiloxane compound is formed by emulsion graft copolymerization of (A) a polyorganosiloxane expressed by Formula 1:

Formula 1

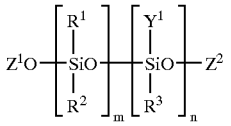

wherein, each of "R1", "R2" and "R3" is one of a hydrocarbon group and halogenated hydrocarbon group having 1 to 20 carbon atoms, and may be identical or different, "Y1" is one of a radical reactive group, an SH group and an organic group containing both, each of "Z1" and "Z2" is respectively one of a hydrogen atom, a lower alkyl group and a group expressed by the following formula, and may be identical or different:

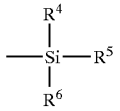

(each of "R4" and "R5" is respectively one of a hydrocarbon group and a halogenated hydrocarbon group having 1 to 20 carbon atoms, and may be identical or different and "R6" is one of a hydrocarbon group, a halogenated hydrocarbon group, a radical reactive group, an SH group and an organic group containing both), "m" is a positive integer of 10,000 or less, and "n" is an integer of one or more, and (B) one of a (meth)acrylic ester expressed by Formula 2:

Formula 2

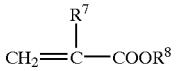

(wherein, "R7" in Formula 2 is one of a hydrogen atom and a methyl group, and "R8" is one of an alkyl group, alkoxy-substituted alkyl group, cycloalkyl group and an aryl group), and a mixture of 70% by weight or more of the (meth) acrylic ester with 30% by weight or less of a copolymerizable monomer, in a weight ratio of from 5:95 to 95:5.

42. An electrophotographic photoconductor according to claim 41, wherein a content of (A) the polyorganosiloxane expressed by Formula 1, is larger in weight than a content of (B) one of the (ineth)acrylic ester expressed by Formula 2, and the mixture of 70% by weight or more of the (meth) acrylic ester with 30% by weight or less of the copolymerizable monomer.

43. An electrophotographic photoconductor according to claim 38, wherein at least one of the acrylic resin and the methacrylic resin, is at least one of a acrylic resin formed by copolymerization of one or more of curing acrylic monomers and curing acrylic oligomers, and a methacrylic resin formed by copolymerization of one or more of curing methacrylic monomers and curing methacrylic oligomers.

44. An electrophotographic photoconductor according to claim 43, wherein one or more of the curing methacrylic monomers and the curing methacrylic oligomers is hydroxyethylmethacrylate.

45. An electrophotographic photoconductor according to claim 41, wherein the monomer is one of polyfunctional monomer and ethylenic unsaturated monomer.

46. An electrophotographic photoconductor according to claim 38, wherein a content of the acryl-modified polyorganosiloxane compound relative to total solids in the protective layer is 1% by weight to 40% by weight.

47. An electrophotographic photoconductor according to claim 38, wherein a content of the acryl-modified polyorganosiloxane compound relative to total solids in the protective layer is 5% by weight to 20% by weight.

48. An electrophotographic photoconductor according to claim 41, wherein glass transition temperature of the (meth) acrylic ester expressed by Formula 2, and the mixture of 70% by weight or more of the (meth)acrylic ester with 30% by weight or less of the copolymerizable monomer, is 20° C. or more.

49. An electrophotographic photoconductor according to claim 38, wherein the protective layer further comprises a charge transport material.

50. An electrophotographic photoconductor according to claim 49, wherein the charge transport material is contained by polymerizing with at least one of the acrylic resin formed by copolymerization of one or more curing acrylic monomers and oligomers, and the methacrylic resin formed by copolymerization of one or more curing methacrylic monomers and oligomers.

51. An electrophotographic photoconductor according to claim 38, wherein the protective layer further comprises metal oxide particles.

52. An electrophotographic photoconductor according to claim 51, wherein an average first-order particle diameter of the metal oxide particles is 0.01 $\mu$m to 0.9 $\mu$m.

53. An electrophotographic photoconductor according to claim 38, wherein the protective layer further comprises a cross linking agent.

54. An electrophotographic photoconductor according to claim 38, wherein the protective layer further comprises a carboxylic acid compound.

* * * * *